US006141926A

United States Patent [19]

Rossiter et al.

[11] Patent Number: 6,141,926

[45] Date of Patent: Nov. 7, 2000

[54] PANEL CONSTRUCTION AND CONNECTION SYSTEM

[75] Inventors: Paul Rossiter; Scott Gammon, both of Carleton Place; Steven Jones, Nepean, all of Canada; Andrew Schoenherr, San Jose, Calif.

[73] Assignee: Tetrad Marketing/Sales Ltd., Ontario, Canada

[21] Appl. No.: 09/092,612

[22] Filed: Jun. 5, 1998

Related U.S. Application Data

[63] Continuation-in-part of application No. 09/055,535, Apr. 6, 1998, which is a continuation of application No. 08/735,642, Oct. 23, 1996, Pat. No. 5,737,893.

[60] Provisional application No. 60/007,941, Dec. 4, 1995.

[30] Foreign Application Priority Data

Oct. 26, 1995 [CA] Canada ..... 2161459

[51] Int. Cl.[7] ..... E04C 2/24

[52] U.S. Cl. ..... 52/239; 160/135; 160/371; 160/351

[58] Field of Search ..... 52/239, 475.1, 52/476, 656.9, 657, 280, 281, 282.2, 285.2, 285.12, 284; 160/135, 351, 371, 381

[56] References Cited

U.S. PATENT DOCUMENTS

| | | | |
|---|---|---|---|
| 3,480,313 | 11/1969 | Halko, Sr. . | |
| 3,749,432 | 7/1973 | Janssen | 287/189.36 A |
| 3,768,222 | 10/1973 | Birum . | |
| 4,104,838 | 8/1978 | Hage et al. . | |
| 4,147,198 | 4/1979 | Ytter . | |
| 4,458,461 | 7/1984 | Holley | 52/239 |
| 4,561,229 | 12/1985 | Gartung | 52/239 |
| 4,690,192 | 9/1987 | Stilling . | |
| 4,761,922 | 8/1988 | Black . | |
| 4,891,922 | 1/1990 | Hozer et al. . | |
| 5,054,255 | 10/1991 | Maninfior . | |
| 5,067,543 | 11/1991 | Bove . | |
| 5,070,666 | 12/1991 | Looman . | |
| 5,125,193 | 6/1992 | Beaulieu . | |
| 5,274,975 | 1/1994 | Haag . | |
| 5,347,778 | 9/1994 | Bray . | |
| 5,394,658 | 3/1995 | Schreiner et al. . | |
| 5,586,593 | 12/1996 | Schwartz | 160/135 |
| 5,682,719 | 11/1997 | Huang | 52/775 |
| 5,724,779 | 3/1998 | Chang | 52/239 |
| 5,737,893 | 4/1998 | Rossiter et al. . | |
| 5,881,789 | 3/1999 | Melashenko et al. | 160/135 |

FOREIGN PATENT DOCUMENTS

| | | |
|---|---|---|
| 1058372 | 7/1979 | Canada . |
| 2017666 | 12/1990 | Canada . |
| 2090386 | 8/1994 | Canada . |
| 2027194 | 12/1971 | Germany . |
| 2161193 | 1/1986 | United Kingdom . |

*Primary Examiner*—Richard Chilcot
*Attorney, Agent, or Firm*—Killworth, Gottman, Hagan & Schaeff, LLP

[57] ABSTRACT

A light weight panel for use in modular and free standing office landscaping systems. The panels form free standing partitions which can be rearranged and assembled into space divider or partition systems. Panels can be interconnected and positioned in a variety of ways relative to adjacent panels via posts and/or special connectors. The panels are constructed with perimeter frame members along each edge, the perimeter frame members being inter-connected with the vertical frame members by corner connectors. The corner connectors have protrusions which engage hollow cavities in the ends of the frame members. The perimeter frame members incorporate formations to secure panel fabric and trim as desired. An inter-panel connection system cooperates with the corner connectors to provide an easy to assemble but rigid partition system.

44 Claims, 42 Drawing Sheets

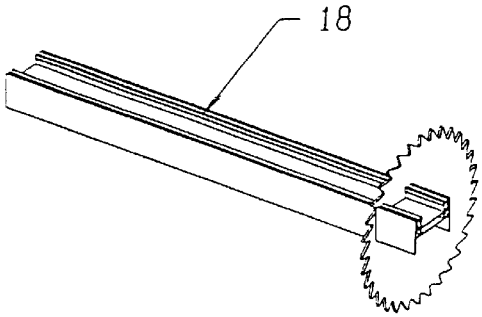
Figure 6A
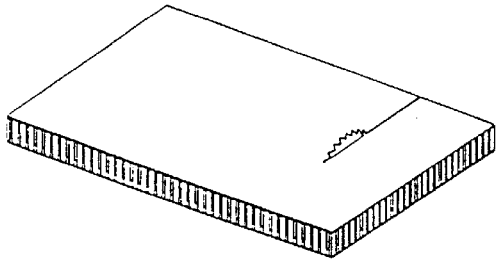
Figure 6B
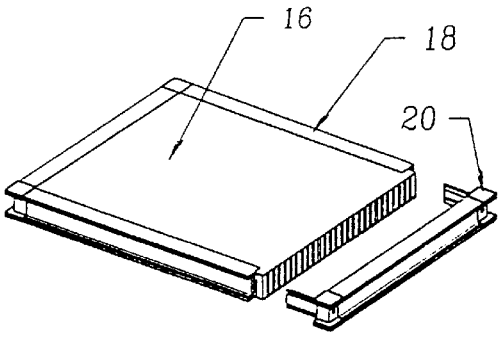
Figure 6C
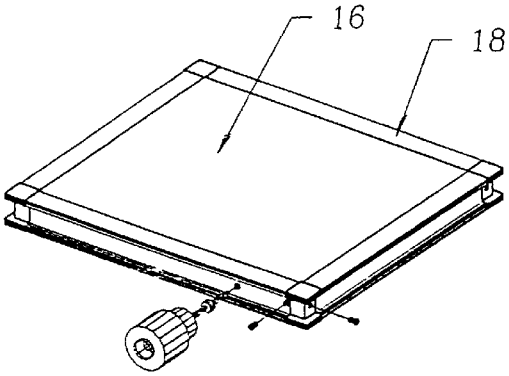
Figure 6D
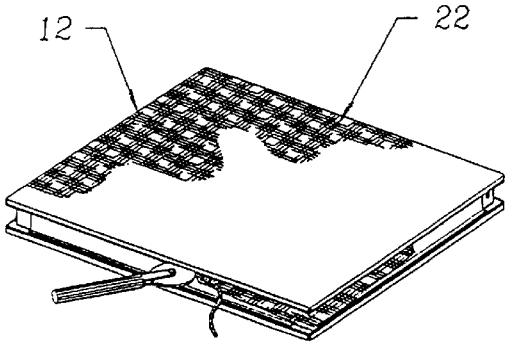
Figure 6E
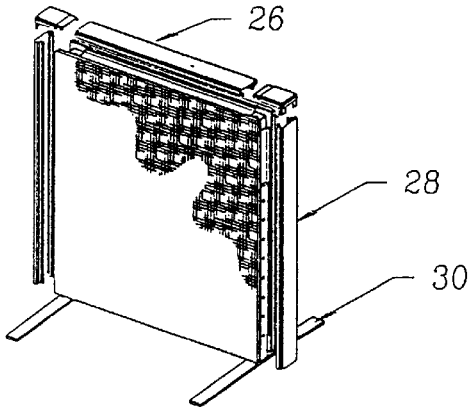
Figure 6F
Figure 6

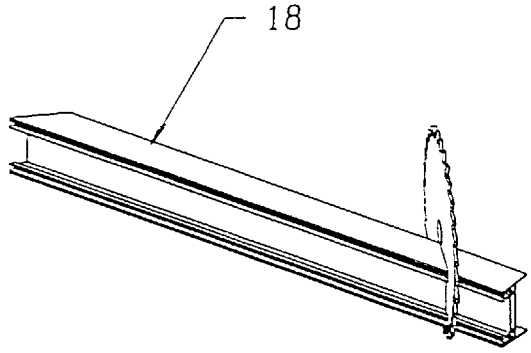
Figure 9A
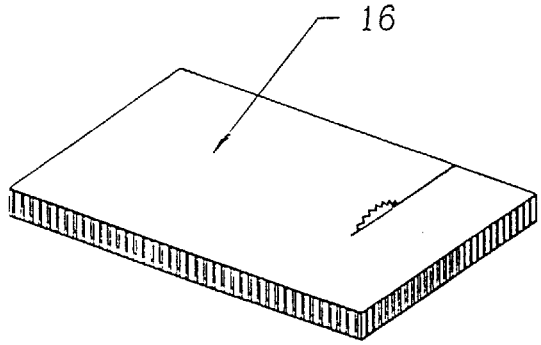
Figure 9B
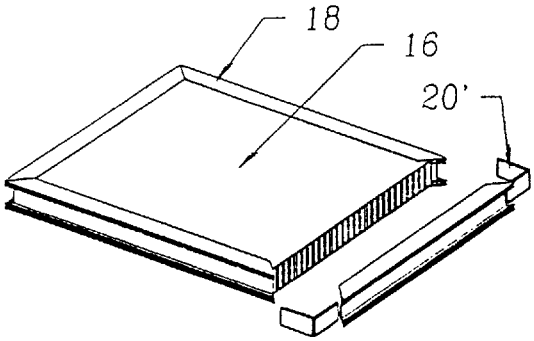
Figure 9C
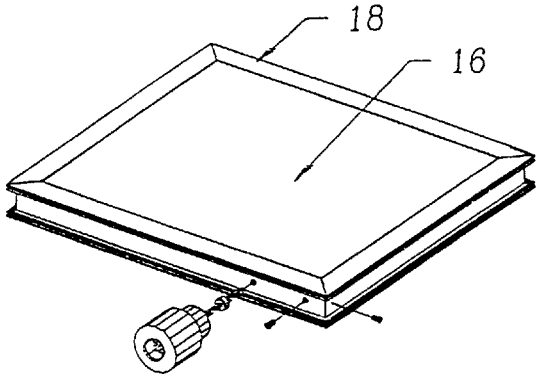
Figure 9D
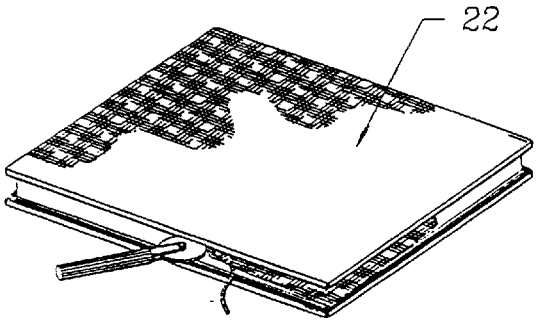
Figure 9E
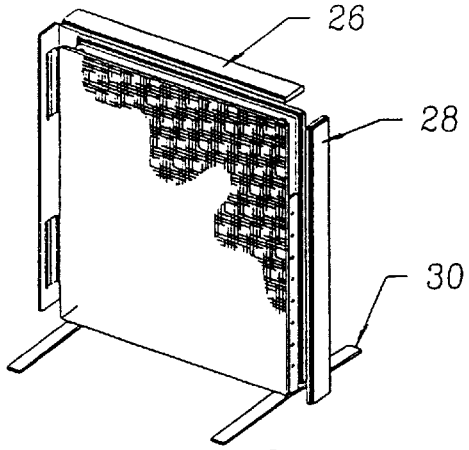
Figure 9F
Figure 9

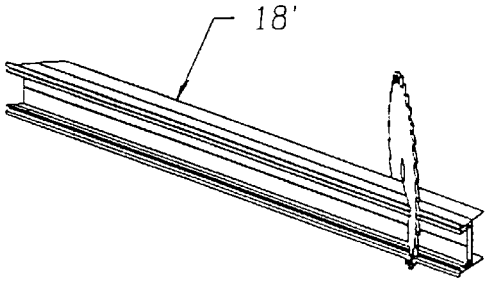
Figure 11A
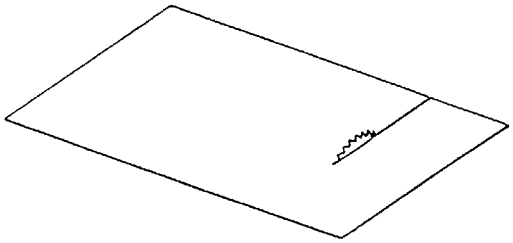
Figure 11B
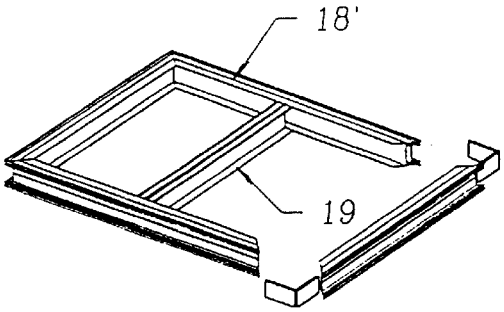
Figure 11C
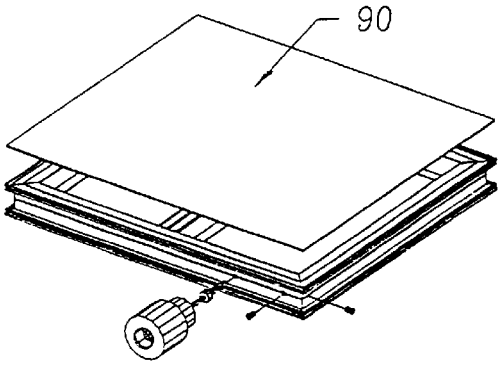
Figure 11D
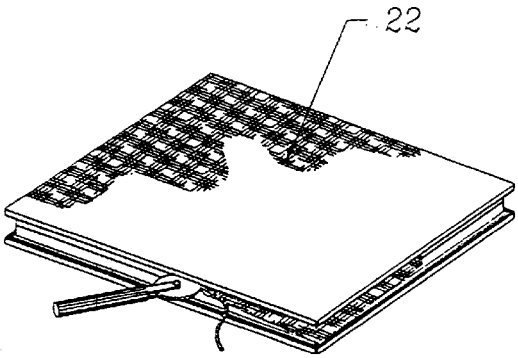
Figure 11E
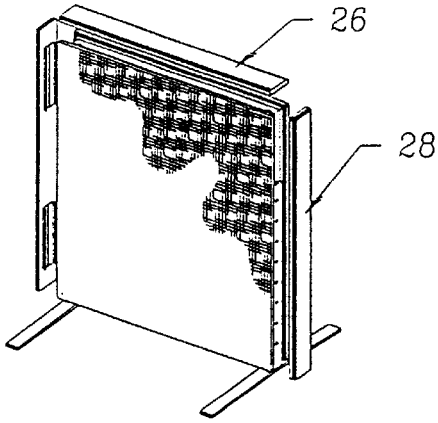
Figure 11F
Figure 11

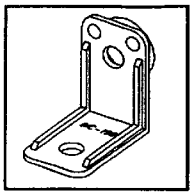
Figure 57
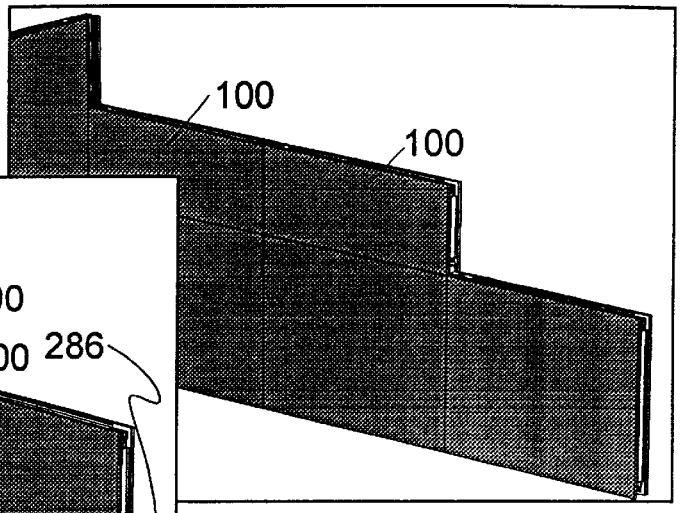
Figure 56
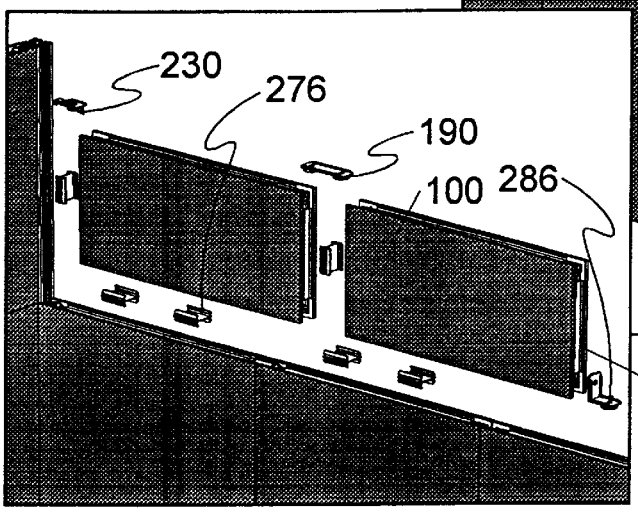
Figure 59
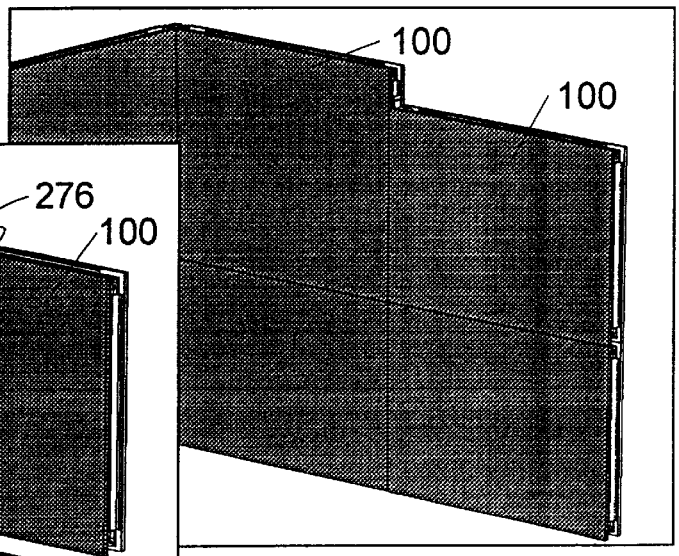
Figure 58
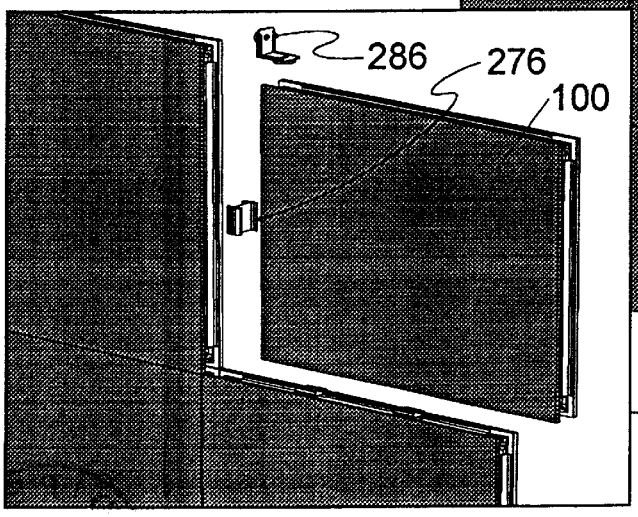

PANEL CONSTRUCTION AND CONNECTION SYSTEM

This is a continuation-in-part of application Ser. No. 09/055,535 filed Apr. 6, 1998 which in turn is a continuation of application Ser. No. 08/735,642 filed Oct. 23, 1996 (now U.S. Pat. No. 5,737,893 issued Apr. 14, 1998). This application claims benefit of Provisional Appl. No. 60/007,941 filed Dec. 4, 1995.

BACKGROUND OF THE INVENTION

This invention relates to simple light weight panel constructions, frame assemblies having connections to secure components to a perimeter frame of the panel and means to secure said panels in various arrangements in an office landscape.

Modem office landscaping systems, be they free standing or modular, typically comprise a panel with a structural frame enclosing a core. In these constructions, all loads are resolved within the frame which consists typically of wood or metal encasing a core usually having acoustic absorption properties. In larger panels, the frame may require substantial cross-bracing to maintain panel rigidity. This construction adds weight and reduces space for core material, thus reducing performance if the core material is acoustical in nature.

Panel frames are typically made from wood or steel. Wood frame components require substantial processing before they can be assembled into panel frames. In both cases the resultant panel is of considerable weight, and this imposes extra requirements and costs on the design of related components. This increased weight also increases the complexity of the system since heavy panels require strong fastening systems to hold them in place. The high weight and complex fastening systems also increase the difficulty in assembling and configuring the system.

The panels usually are constructed with flat or curved cores surrounded by a perimeter frame. Typically, the panels are assembled and interconnected in an edge to edge relationship to form an office workspace environment with combinations of continuous walls and corner joints. Common connection systems, where a vertical edge is constructed with a male connection frame member which engages a vertical female frame member along the longitudinal axis on the adjacent edge are limited to configurations with standard panel sizes and set angles as disclosed for example by U.S. Pat. No. 5,054,255 and Can. Pat. No. 2,090,386. A significant drawback to this type of panel connection system is that panels must always be disposed in a similar manner thus limiting the flexibility of the system and any reconfiguration thereof.

In further typical office systems, changes in directions require the addition of transition posts to effect the angle change. While these posts offer limited flexibility, each variation of post must be fabricated, inventoried, and stored thus requiring extensive labour and cost to reconfigure such systems, reference being had to U.S. Pat. No. 4,101,838.

As noted above, most panels are constructed with a perimeter frame around the acoustic core. Typically the frame members are inter connected through means of a corner connector. These corner connections tend to be permanent and do not enable disassembly without damaging the adjacent frame members. This results from the corner connector having barbs which "lock" in the hollow cavities into which they are inserted. Examples of this type of component are disclosed by U.S. Pat. No. 5,054,255. The penalty for this type of construction is that it limits re-sizing of the panels during reconfiguration of the system.

SUMMARY OF INVENTION

Basic objectives of the invention are to alleviate the disadvantages of the prior art systems noted above by providing a partition panel and associated components as described hereafter.

The invention in one aspect relates to a partition panel of generally rectangular outline having a plurality of marginal edges and a plurality of corners, and a perimeter frame assembly comprising a plurality of frame members extending along the marginal edges of the panel, and a plurality of corner connectors each located at a respective one of the corners of the panel and attaching between adjacent ends of said frame members, said frame members including spaced primary flanges, said frame members each further including a double-walled web extending between said primary flanges and providing a lengthwise extending hollow cavity, each corner connector including a pair of tongues each fitting tightly into adjacent ends of the frame members via the associated hollow cavities to secure said frame members together at said corners of the panel.

In a preferred embodiment each said corner connector has shoulders thereon which butt-up against respective adjacent ends of the perimeter frame members when the tongues of the corner connectors are fully inserted into said hollow cavities of said frame members, said tongues being in a close friction fit within said cavities.

The corner connectors and the frame members are typically provided with grooves therein which engage marginal portions of fabric material extending over at least one of the major faces of the panel to provide an exterior covering therefor and/or to engage edge trim pieces to finish the edges of rigid panels.

The frame members preferably comprise plastics extrusions of uniform cross-section throughout their lengths, said spaced primary flanges having a U-shaped groove therebetween directed outwardly of the panel and said corner connectors also having spaced corner flanges thereon mating with said primary flanges and having U-shaped recesses therebetween mating with the U-shaped recesses of said frame members.

According to one feature of the invention each corner preferably has, adjacent a proximal end of each of said tongues, a respective boss, said bosses being at right angles to one another and each of which bosses is adapted to mate with a corresponding recess in a panel connector for securing panels together or to a post or other fixtures (e.g. coat hook, legs or work surface brackets). Each corner connector also preferably has a pair of apertures therein each of which is adjacent a respective one of said bosses and being adapted to receive a lug of a panel connector.

As a further feature of the invention each frame member preferably includes a flexible rib extending therealong intermediate said primary flanges and projecting outwardly of the margins of the partition panel for contacting a frame member of an adjacent panel when in use to prevent light and inhibit sound transmission therebetween.

In one embodiment of the panel said primary flanges of the frame members are each provided with an outwardly directed ledge, said ledges being disposed adjacent the marginal edges of the panel such that said ledges encompass a rectangular area, and a sheet of rigid material seated in said rectangular area in close juxtaposition to said primary flanges to define a major face of the panel with said ledges extending along the perimeter of the rigid sheet and encompassing the latter.

In another embodiment of the panel a wall of said double-walled web of each frame member has a spaced pair of further flanges extending therealong and defining a center channel supporting one or more rigid panels in a plane intermediate the planes defined by said major faces of the panel either within said center channel or to one or both sides thereof in engagement with a respective one of said further flanges.

A panel assembly according to one embodiment of the invention comprises a plurality of panels and further includes panel-to-panel connectors securing adjacent pairs of panels together, each said panel-to-panel connector extending between an adjacent pair of said panels and having a pair of recesses each receiving a respective one of the bosses on said corner connectors of the adjacent panels and also having a pair of lugs thereon mating in special apertures of the corner connectors to prevent rotation of the panel-to-panel connectors about the bosses of the corner connectors.

Another aspect of the invention provides a corner connector adapted to be located at a corner of a partition panel to secure together elongated frame members disposed generally at right angles to one another, said corner connector having a pair of tongues at right angles to one another adapted to be snugly fitted into end portions of lengthwise extending hollow cavities in said frame members, each corner connector having shoulders defined thereon which butt-up against respective adjacent ends of the elongated frame members when said tongues are fully inserted into said hollow cavities, each corner connector having, adjacent a proximal end of each of said tongues, a respective boss, said bosses being at right angles to one another and each of which bosses is adapted to mate, in use, with a corresponding recess in a panel connector for securing adjacent partition panels together or to a post.

The corner connector is preferably adapted for use with frame members having primary flanges defining a U-shaped groove therebetween, said corner connector having spaced corner flanges thereon defining said shoulders adapted to abut the ends of the frame members, said corner flanges defining U-shaped recesses adapted to mate with the U-shaped recesses of the frame members and said bosses being located between said spaced corner flanges.

The corner connector preferably has a pair of apertures therein each of which is located adjacent a respective one of said bosses for simultaneously receiving therein a lug of a panel connector as and when the latter is engaged with the boss next adjacent thereto thereby firmly securing said panel connector relative to said corner connector.

Other aspects of the invention include special panel-to-panel straight and perpendicular connectors, panel-to-post connectors and transition panel connectors as well as a special vertical post construction adapted to cooperate therewith, all of which will be described and claimed hereafter.

The foregoing and other advantages of the invention will be discussed in the following specification and claims, combined with reference to the appended drawings.

BRIEF DESCRIPTION OF THE VIEWS OF DRAWINGS

FIGS. 6A–6F illustrate the steps involved in the manufacture and assembly of one embodiment of the partition panel;

FIGS. 9A–9F show steps involved in the manufacture and assembly of the partition panel when utilizing the corner connector of FIGS. 7 and 8;

FIGS. 11A–11F illustrate steps in the manufacture and assembly of a partition panel utilizing the modified perimeter frame members illustrated in FIG. 10;

Figure 60:
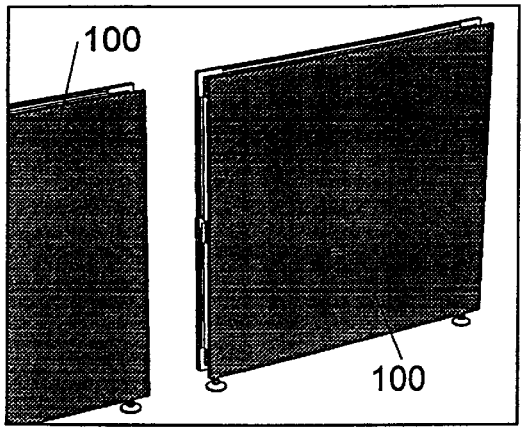
Figure 61:
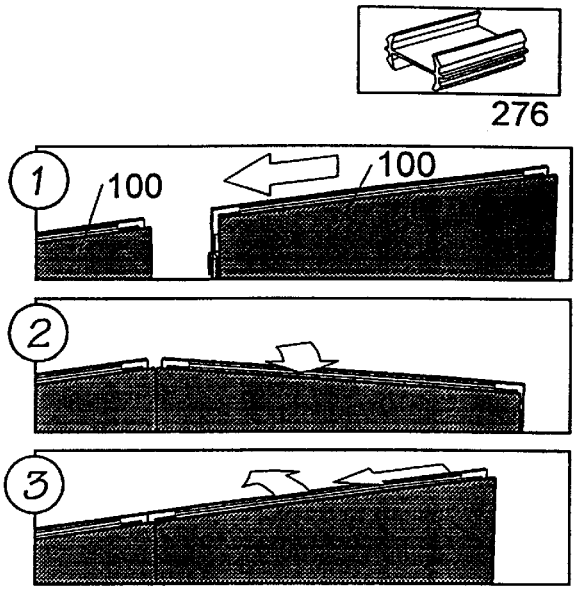
Figure 62:
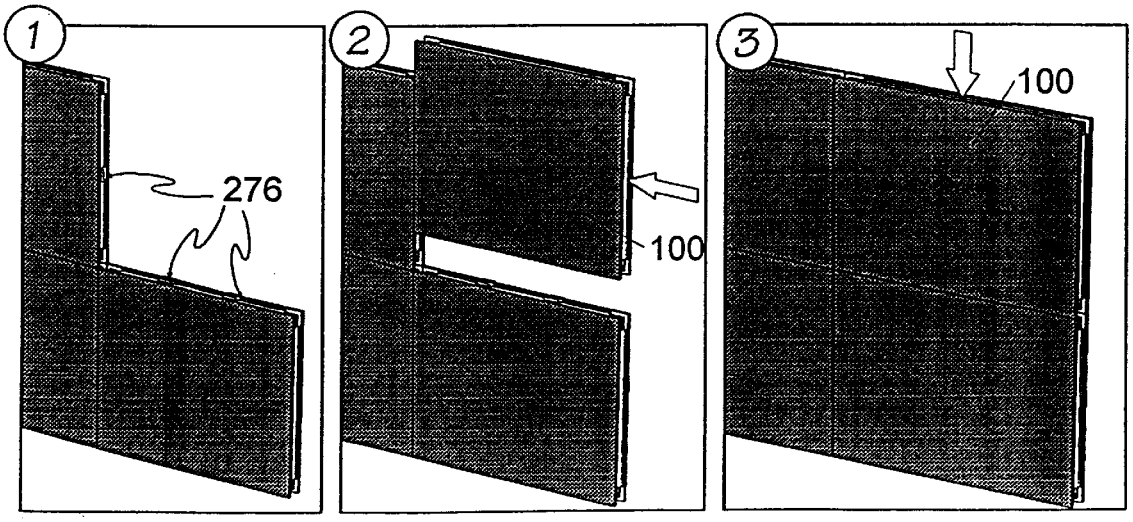
Figure 63:
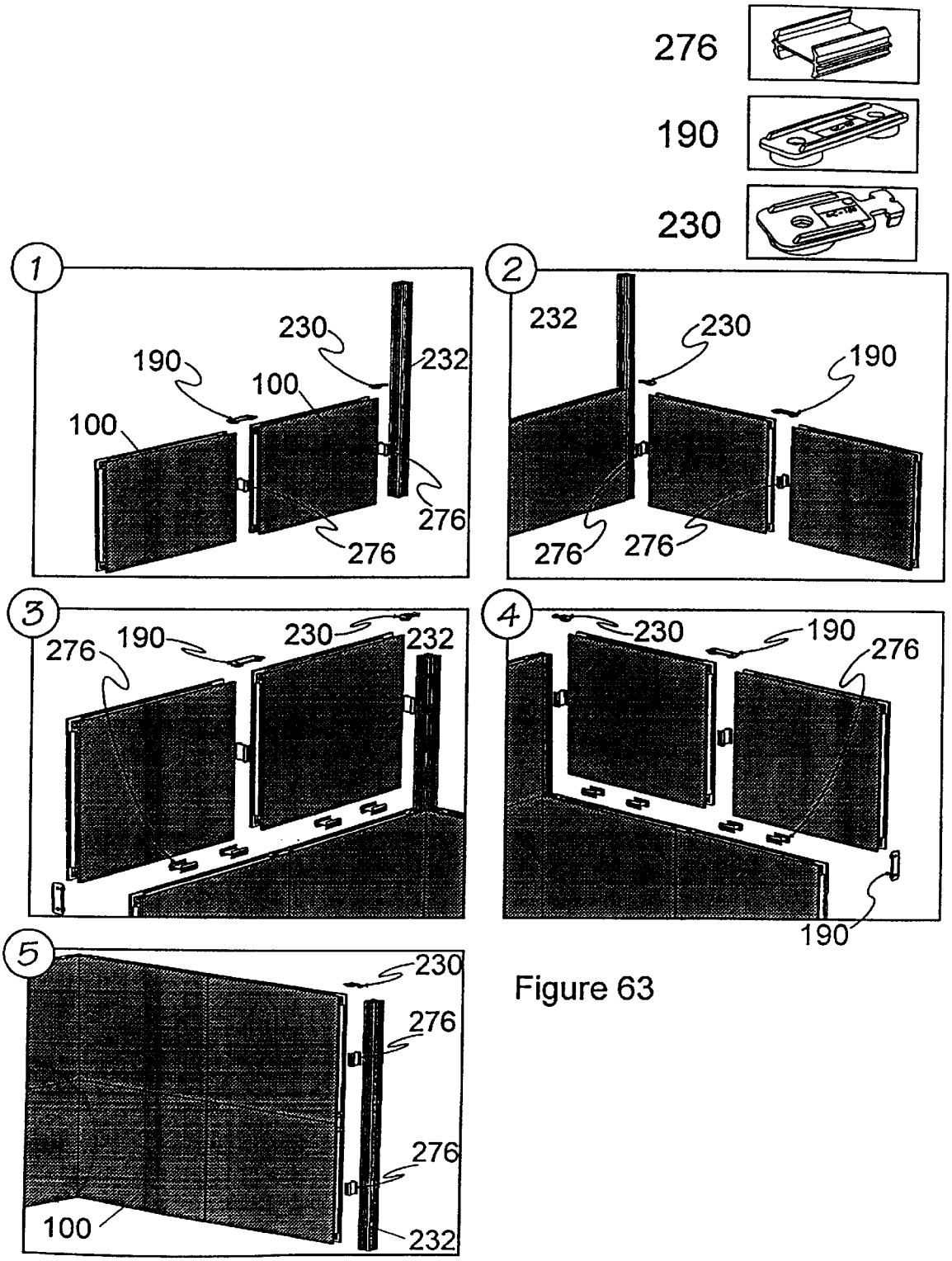

FIGS. 56–59 together with FIGS. 57A and 59A are perspective views illustrating the manner in which transition panel connectors may be utilized to connect together panels of the same or differing height;

FIGS. 60 and 61 are perspective views illustrating the sequence of steps for joining panels horizontally using the H-connector referred to previously;

FIG. 62 comprises perspective views illustrating the sequence of steps involved for joining panels vertically utilizing the aforementioned H connector; and FIG. 63 comprises a series of perspective views illustrating the steps involved in assembling panels utilizing the aforementioned H connector, the panel-to-panel straight connector and the panel-to-post connector.

DETAILED DESCRIPTION OF PREFERRED EMBODIMENTS

Figure 1:
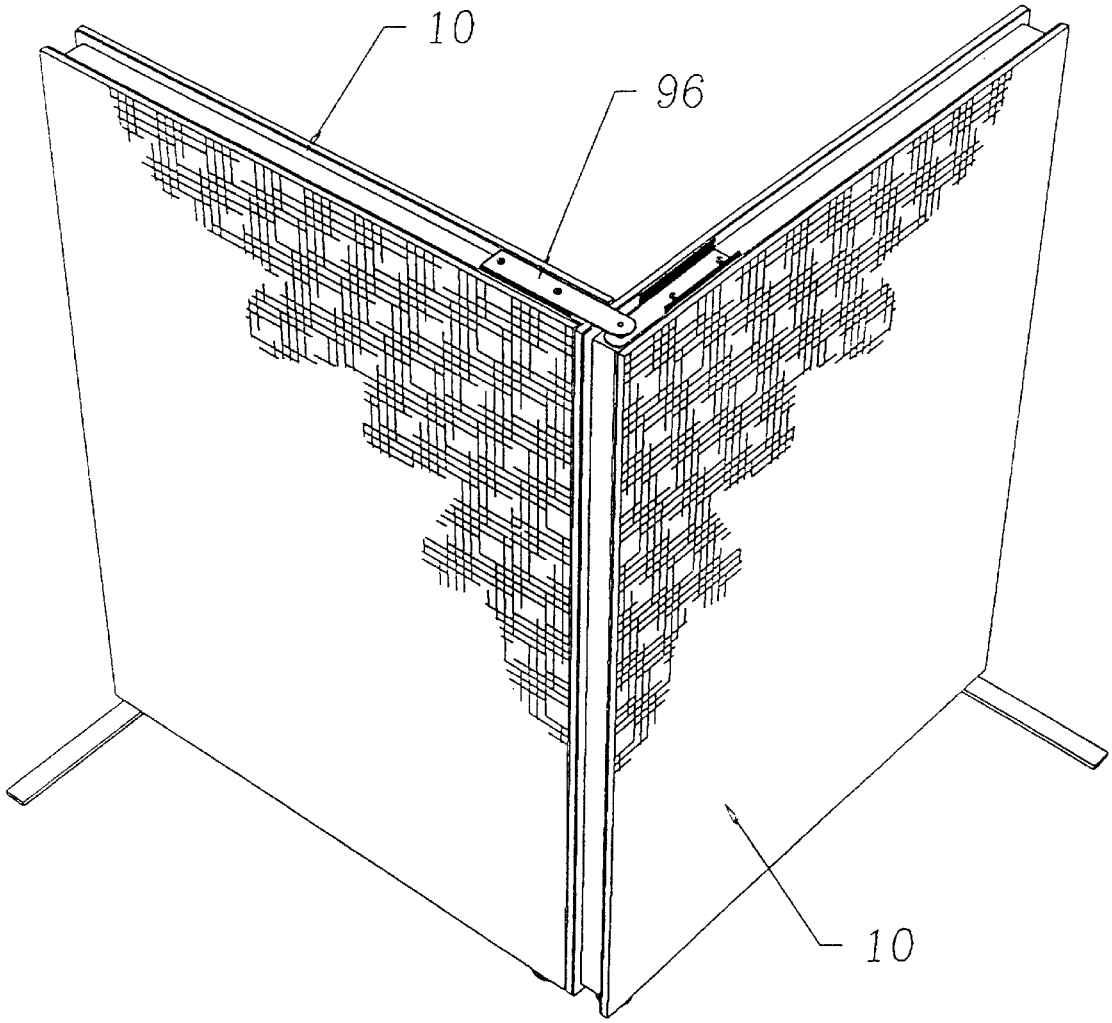
FIG. 1 is a perspective view showing two lightweight panels disposed in close relation and configured to form a partition corner.

With reference to FIG. 1 there is shown an office partition comprising a pair of panels 10 constructed in accordance with the present invention and arranged in an edge-to-edge transverse manner and connected together by means of a panel connecting device 96 to be described hereinafter.

With reference to FIGS. 2–5, each of the panels 10 is constructed utilizing a perimeter frame assembly 14 which encompasses the perimeter of a composite structural core 16 which is shown as being of rectangular outline shape. The perimeter frame assembly 14 comprises a plurality of frame members 18*a*, 18*b*, 18*c* and 18*d* extending along each of the four marginal edges of the core 16. A plurality of corner connectors 20 are provided, each located at a respective one of the corners of the assembly 14 and attaching adjacent ends of the frame members 18 together. The exterior major faces of the panel assembly 12 are covered with suitable covering materials, e.g. an exterior flexible covering fabric 22 and an underlying layer of thin foam 24. Top and side edge trim covers 26, 28 respectively extend along and cover up the peripheral edges of the panel assembly to provide a finished panel appearance compatible with modem office decor.

Figure 2:
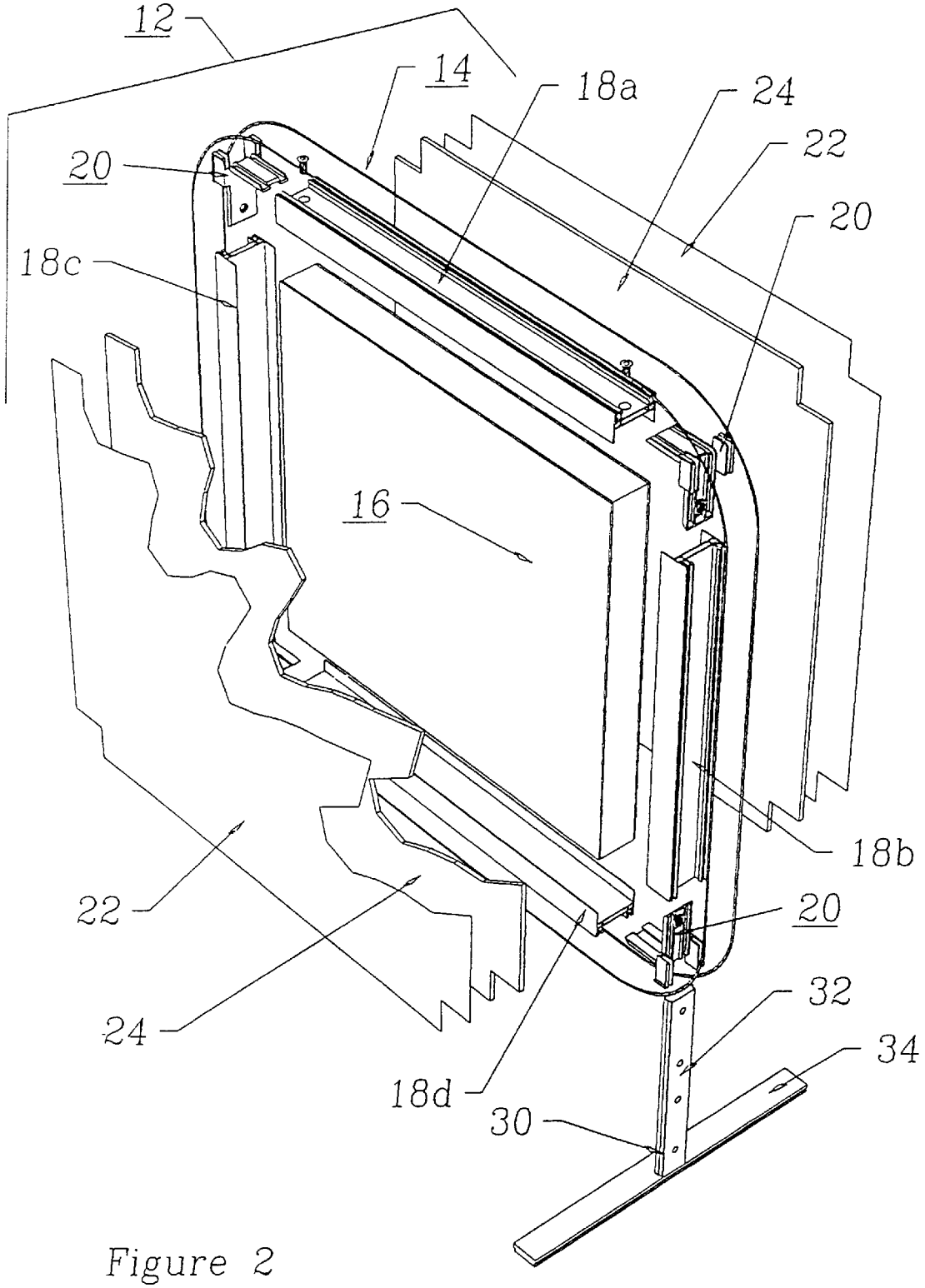
FIG. 2 is an exploded view of a panel in accordance with one embodiment of the invention.

With reference to FIG. 2, feet members 30 are attached to the panel assembly by way of the vertical perimeter frame members 18*b*, 18*c* at the opposing ends of the panel assembly by means of fasteners (not shown) which extend through suitable apertures (providing vertical height adjustment of the panel assembly) provided in the vertical legs 32 of the feet members. The transverse feet 34 of members 30 bear directly against the floor in well known manner.

Figure 3:
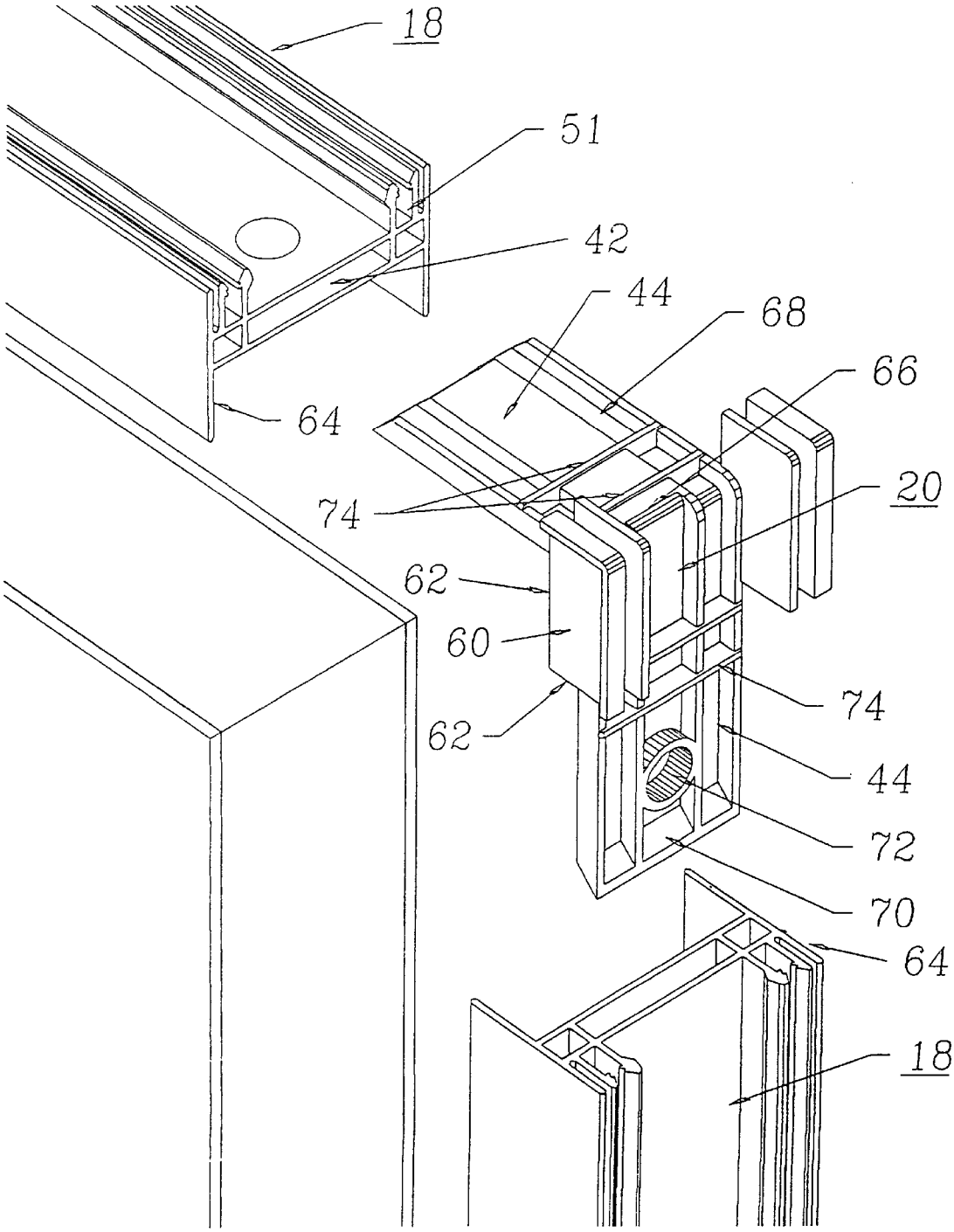
FIG. 3 is a further exploded view showing the details of one form of corner connector.
Figure 4:
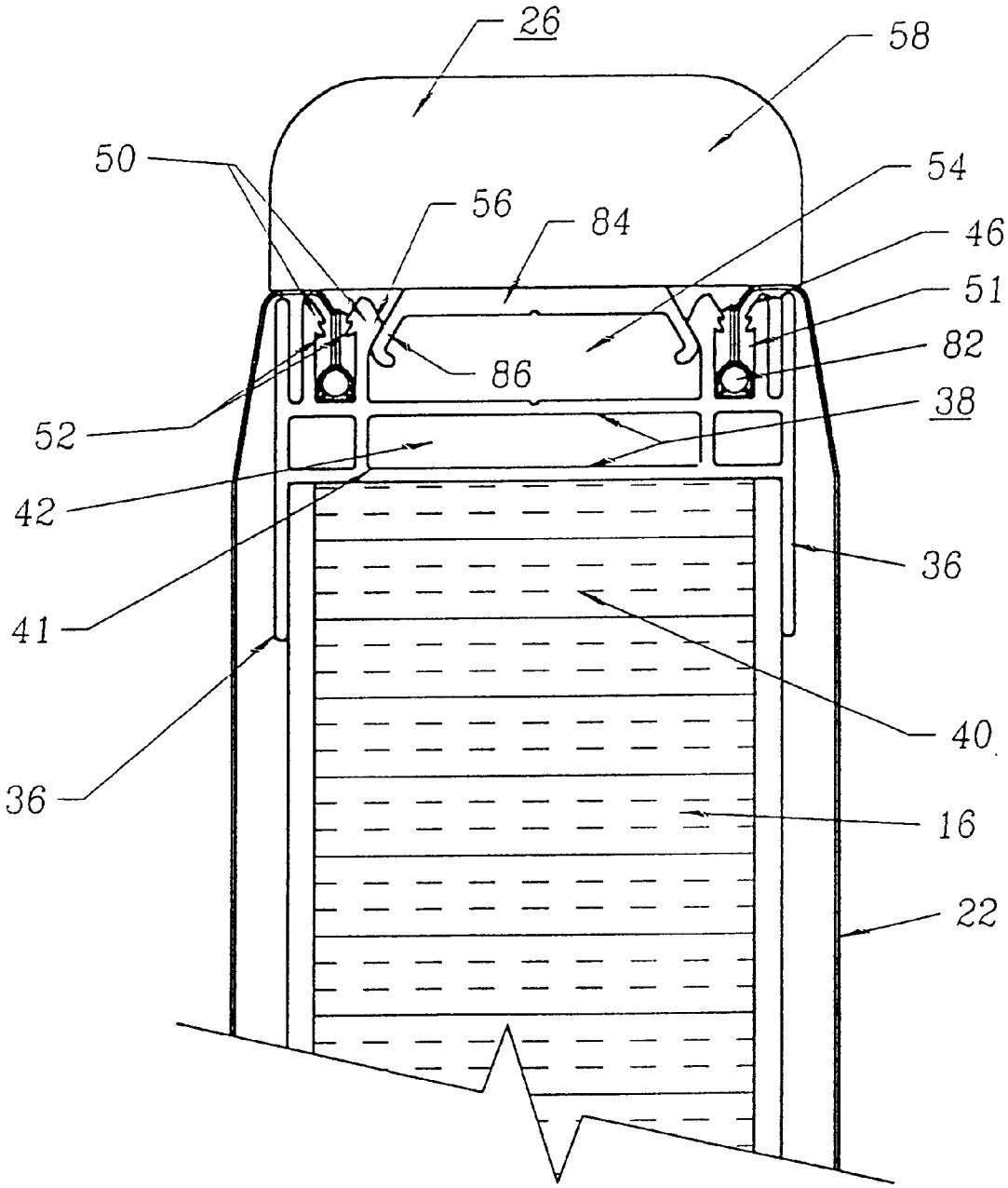
FIG. 4 is a cross-section view of one portion of a panel showing a panel edge trim cover in snap-fitting engagement with a perimeter frame member.

With reference particularly to FIGS. 2, 3 and 4, the perimeter frame members 18 comprise extruded members of uniform cross-section along their lengths preferably made from a synthetic plastics material such as rigid polyvinyl chloride (PVC). Each frame member includes a spaced apart pair of generally parallel primary flanges 36 and a double-walled web 38 extending between and fixed to the primary flanges 36 generally at right angles thereto to define a primary channel 40 extending along one wall 41 of the web 38, which primary channel 40 receives therein a marginal edge portion of the panel core 16. The double-walled web 38 serves to define a lengthwise extending hollow cavity 42 adapted to receive a leg 44 of an associated corner connector 20 for joining adjacent frame members 18 together at the corners of the panel assembly. A spaced apart pair of groove-defining elements 46 extend along opposing longitudinal marginal portions of the double-walled web 38 with each of these elements 46 being adjacent a respective one of the primary flanges 36 but disposed on that wall 43 of the web 38 which is opposite to said one wall 41 referred to above. These groove-defining elements 46 are in the form of spaced pairs 48 of secondary flanges 50 which are generally parallel to the primary flanges 36. The secondary flanges 50 have retaining means thereon to assist in securing marginal edge portions of the panel covering fabric 22, 24 therein in the form of tooth-like projections 52 formed on the interior distal end portions of the secondary flanges 50 and directed into the interior or mouth portions of the grooves 51 to provide a re-entrant shape to the latter for retention of the panel covering therein as will be described hereinafter.

It will also be noted that the primary flanges 36 have a shallow U-shape channel 54 located therebetween, the channel actually being defined by the inner pair of the secondary flanges 50 as well as said opposite wall 43 of the web. Each of the inner pair of secondary flanges 50 has enlargements 56 which are inwardly directed toward each other and extending along the free distal edges thereof. Their purpose is to secure a panel edge trim cover 58 in snap-fitting engagement with the secondary flanges as will be described hereinafter.

In the assembled condition of the partition panel the above-described frame members 18 extend along the top, bottom and vertical side edges of the panel core 16 with the marginal edges of the panel core being received within the primary channels 40 of the several frame members, with the primary flanges 36 thereof disposed in flanking relation to edge portions of the core 16 and snugly embracing the same. As a result of this overlap of the primary flanges 36 of the perimeter frame members 18 with the composite structural core 16, sufficient rigidity is maintained within the panel structure as to resist point loads applied to the perimeter frame 14, i.e. these point loads tend to be distributed more evenly to the core 16.

As noted previously, the perimeter frame members 18 are secured firmly together at the four corners of the panel assembly 12 by means of corner connectors 20, one being disposed at each corner of the assembly. Each corner connector 20 includes a pair of tongues 44 at right angles to each other, each tongue fitting tightly into the adjacent ends of the frame members 18 by way of the hollow cavities 42 described previously thereby to secure the frame members 18 together at the corners of the panel assembly.

Referring to the corner connector 20 as seen in FIG. 3 for example it has, as noted previously, a pair of tongues 44 extending at 90° angles to one another away from a central body 60. The central body has opposing pairs of shoulders 62 formed thereon also at right angles to each other and which shoulders butt up against the adjacent ends 64 of the frame members 18 in the assembled condition. It should also be noted that this central body 60 of the corner connector has formations 66 thereon defining spaced apart grooves 68 which are arranged so as to communicate with and be generally co-planar with the above-described grooves 51 in the frame members 18 thereby to enable the marginal edges of the covering fabric 22, 24 to be engaged and held in the grooves 51 all around the perimeter of the panel assembly including its corners. It should be noted however that the grooves 68 in the corner connectors 20 do not include the aforementioned re-entrant shape nor any form of projections as described previously in connection with the frame members.

Insofar as the two tongues 44 of the corner connector are concerned, each tongue has one surface of generally continuous flattened shape while the other surface is formed to define a plurality of stiffening ribs 70. A hole 72 is formed in one of these tongues through which a fastener may be inserted. Such fasteners are typically used to secure the above-mentioned feet members 30 to the panel assembly 12 either at the partition panel corners or in a line of partitions interconnected together. Each corner connector tongue tapers slightly from the central portion out to the distal end thereof to facilitate insertion of the tongues 44 into the adjacent perimeter frame members 18 while at the same time the dimensions are carefully selected as to require a light force fit therebetween to ensure that these components are all snugly and securely connected together. To enhance this secure connection between the perimeter frame members 18 and the corner connector 20, transverse ribs 74 are provided on each leg adjacent the central portions thereof. These ribs 74 act so as to ensure an interference fit between the corner connector tongues 44 and the interior walls 41, 43 of the frame members 18 and in fact serve to provide a type of interference fit. When fully assembled with the ends 64 of the perimeter frame members 18 abutting against the shoulders 62 of the central portion 60 of the corner connector 20, the corner connectors serve to further enhance the structural rigidity of the overall assembly.

Figure 3A:
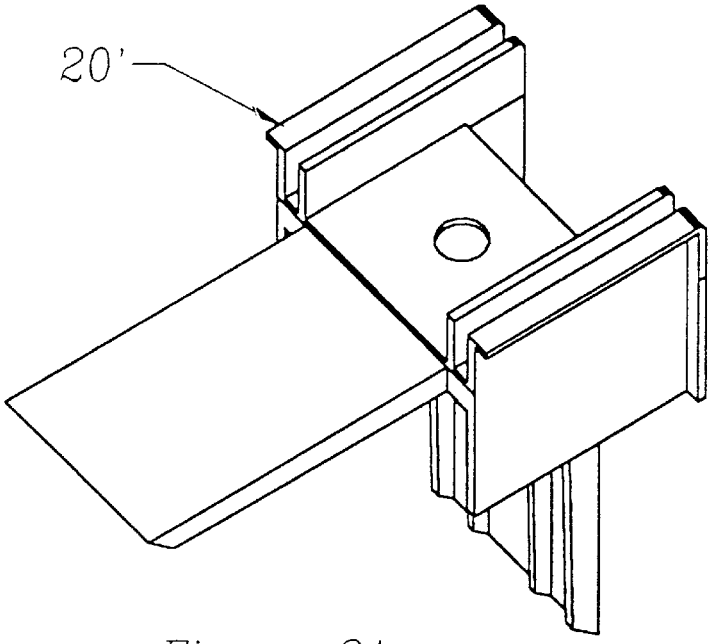
FIGS. 3A and 3B are perspective views of a modified form of corner connector usable in a manner very similar to that illustrated in FIG. 3.
Figure 3B:
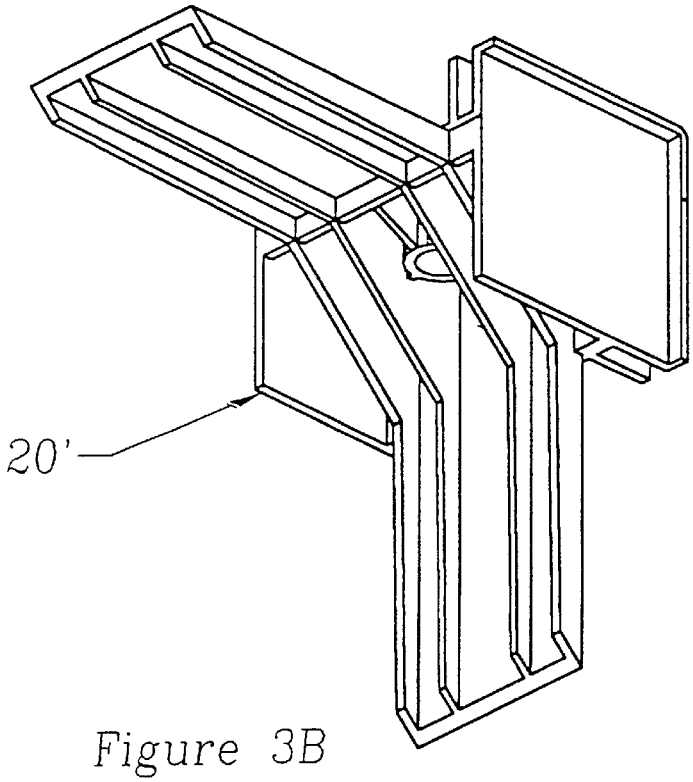

A slightly modified form of corner connector 20' is illustrated in FIGS. 3A and 3B. However, the overall principle of operation is essentially the same as that described previously.

Figure 5:
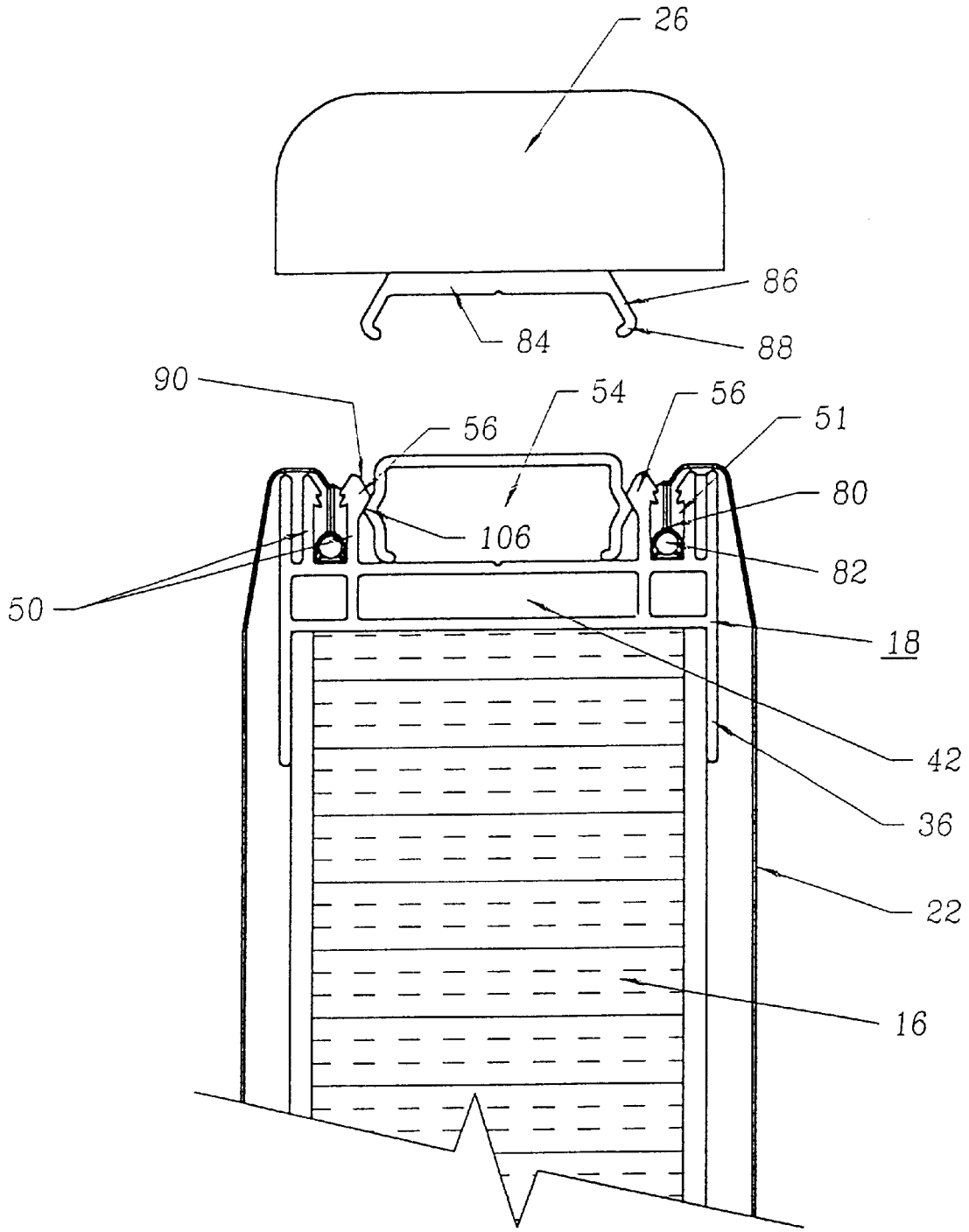
FIG. 5 is a view similar to FIG. 4 but showing the trim cover member removed from the panel assembly and with one portion of a panel connector disposed in snap-fitting engagement with a perimeter frame member.

With further reference to FIG. 4 as well as FIG. 5, it will be seen that the marginal edge portions 80 of the covering fabric are disposed within the grooves 51, 68 of the frame members 18 and corner members 20 to thereby snugly secure the covering material 22, 24 in overlying relation to the major faces of the panel assembly 12. In order to provide secure retention of the covering fabric, the marginal edges 80 of same have an enlargement or bead 82 extending therealong which becomes firmly entrapped in the above-mentioned grooves and is held there by way of friction and the aforementioned tooth-like projections 52 which are formed on the interior mouth portions of the grooves to provide the aforementioned re-entrant shape.

It was previously noted that the secondary flanges provide a shallow U-shape secondary channel 54 therebetween which faces outwardly of the panel assembly 12. It was also noted that each of the inner pair of secondary flanges 50 has inwardly directed enlargements 56 along the free distal edges of same. As best seen in FIGS. 4 and 5, there is provided a trim cover 26 which is adapted to come into snap-fitting engagement with these enlargements 56 of the secondary flanges. The trim covers 26 are made sufficiently long as to extend substantially the full lengths of the associated top and side edges of the panel assembly 12 thereby to cover up the underlying perimeter frame members 18. The exposed trim covers 26 may be made of wood if desired of have any suitably attractive finish or it may be a composite fabric covered item or made of plastics material as desired. In order to secure this trim cover 26 in snap-fit relationship to the inner pair of secondary flanges 50 as described above, the underside of each trim cover is provided with a shallow channel-shaped clip 84 extending lengthwise thereof and including downwardly and outwardly extending leg portions 86 having inturned marginal edges 88 which serve to engage the slightly sloped surfaces 90 at the inner distal ends of the inner pair of secondary flanges, which leg portions 86 and secondary flanges 50 are then deflected sufficiently as to allow the clip to snap-fit into the position illustrated in FIG. 4 with the leg portions of the clip 86 firmly engaged behind the enlargements 56 of the secondary flanges, with the clip 86 at the same time exerting laterally outwardly directed forces on these inner secondary flanges 50 thus tending to close somewhat the mouth portions of the aforementioned grooves 51 thus firmly retaining the enlargement or bead portions 82 at the marginal edges of the covering fabric 22 (together with any underlying layer of material) firmly in place.

The overall process for the assembly or manufacture of the partition panel assembly described above is illustrated generally in FIGS. 6A–6F. As shown in FIG. 6A, the plastic extrusions are cut to length to form perimeter frame members 18 of the desired length. It will be noted that the saw cuts are made at right angles to the lengthwise dimension of the extrusion. Next, the material for the composite structural core 16 is cut to size (FIG. 6B). It might be mentioned here that the core 16 is typically of a paperboard "honeycomb" construction to provide sound dampening etc. This type of core is well known per se and generally comprises a cellular "honeycomb" interior with the individual cells running transversely to the major surfaces of the core, such major surfaces being of sturdy paperboard sheets adhesively bonded to the interior honeycomb structure.

As shown in FIG. 6C, the perimeter frame members 18 are assembled around the perimeter of the core with the frame members snugly embracing the marginal edge portions of the core 16 and, in the process of this assembly, the legs of the corner connectors 20 are inserted into the opposing ends of the respective frame members such that during assembly of the frame members 18 and the corner connectors 20 become firmly secured to the associated frame members 18 thereby to hold the entire assembly together.

As illustrated in FIG. 6D, any desired holes in the frame members are then drilled following which metal inserts are installed as required thereby to provide for attachment of the feet and any other desired hardware to the plastic frame members.

As illustrated in FIG. 6E, the fabric cover material (together with an underlying foam layer 24 if desired) is applied to the major surfaces of the panel assembly 12 and the marginal edges together with the bead or spline 82 are inserted into the aforementioned grooves provided in the frame members and corner connectors by way of a roller tool (well known per se in the art) thereby to firmly secure the covering materials to the panel assembly.

With reference to FIG. 6, the final assembly procedure involves installing the feet members 30 using suitable fasteners to co-operate with inserts which have been installed previously and following this the several trim covers 26, 28 are snap fitted into place along the side and top edges of the panel assembly 12 thereby to complete the same.

Figure 7:
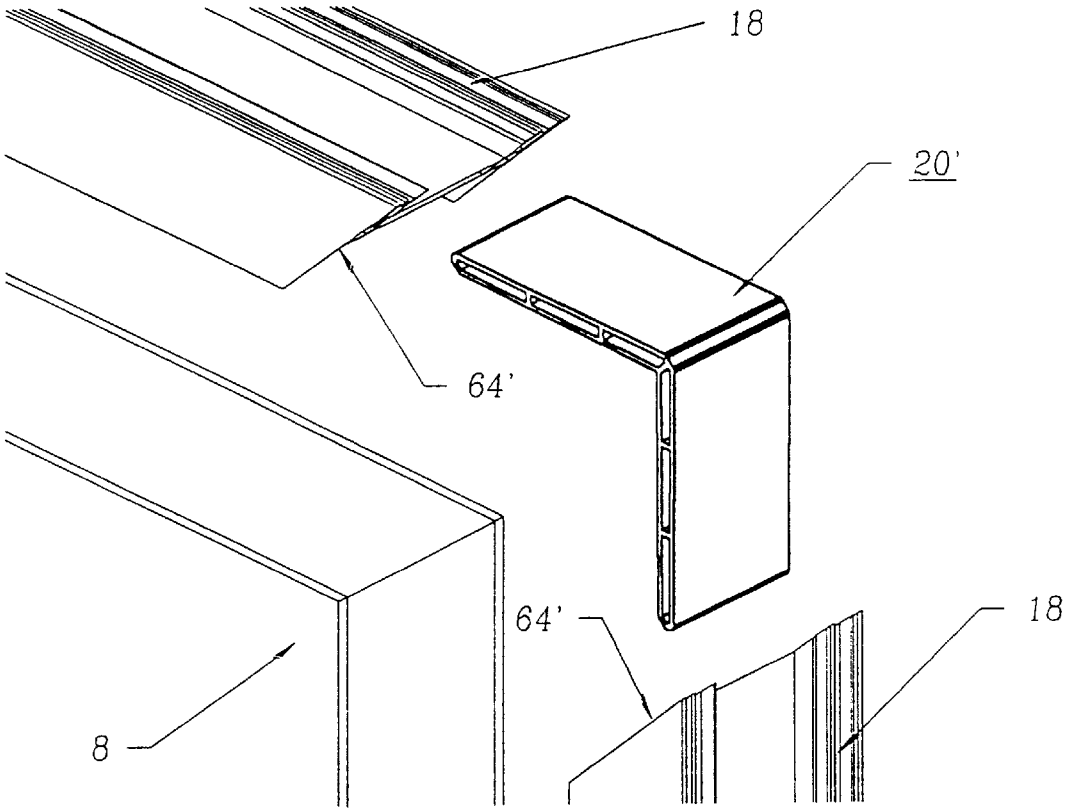
FIG. 7 is a further exploded view somewhat similar to FIG. 3 but illustrating a different form of corner connector.
Figure 8:
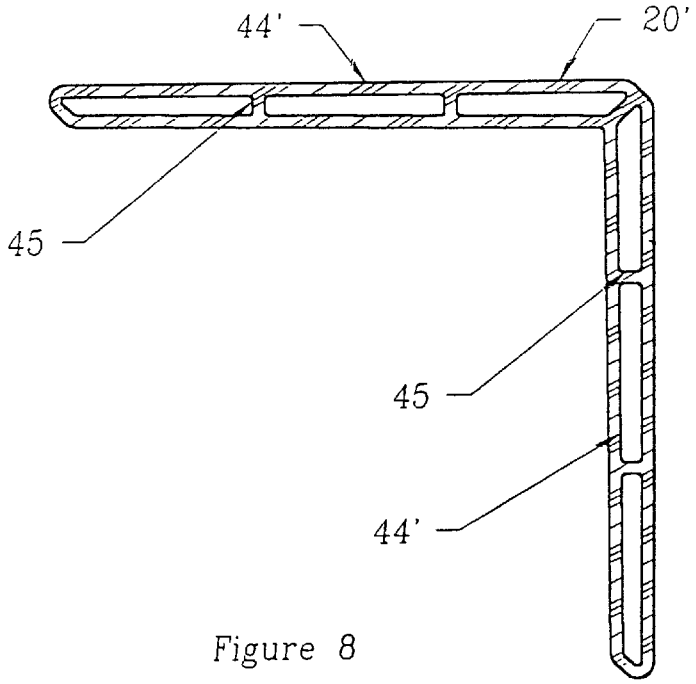
FIG. 8 is a side elevation view illustrating the corner connector utilized in FIG. 7.

A modified form of corner connection arrangement is illustrated in FIGS. 7 and 8. In this arrangement the perimeter frame members 18 are formed exactly as described previously except that the adjacent ends 64' of the perimeter frame members when assembled butt up against each other with these adjacent ends 64' being angled or bevelled at 45° to provide a complementary fit. In this condition, the modified corner connector 20' is fully enclosed by the adjacent end portions of the frame members 18, i.e. it does not have shoulders or grooves in its central portion as with the corner connector 20 previously described.

The modified corner connector 20' is clearly illustrated in FIG. 8. It comprises a simple extrusion of plastics material in an L-shape with the two legs 41' being at right angles to one another. The opposing surfaces of the legs are angled so that there is a slight downward taper therein toward the distal ends of same thereby to provide the light force-fit engagement within the previously described lengthwise extending cavities 42 provided by the perimeter frame members 18. The legs 44' of the modified corner connector are mainly hollow as illustrated in FIG. 8 but have short transverse webs 45 at spaced intervals. These webs prevent excessive deformation of the legs when inserted and when considering the deformation which occurs in the cavity defining portions of the perimeter frame member 18, tends to ensure firm relatively slip-free engagement.

The manufacturing/assembly process for the modified corner arrangement of FIGS. 6 and 7 is depicted in FIGS. 9A–9F. Referring to FIG. 9A, the extrusion is cut to length to form individual perimeter frame members it being noted particularly that the cuts are made at a 45° angle to the lengthwise dimension to provide the bevelled ends 64' as shown in FIG. 7. Following this, the core is cut to size as shown in FIG. 9B; then the frame members are assembled together around the perimeter of the core as shown in FIG. 9C using the modified corner connectors 20' of FIGS. 7 and 8. The remaining steps as illustrated in FIGS. 9D–9F are the same as described previously in conjunction with FIGS. 6D–6F.

Figure 10:
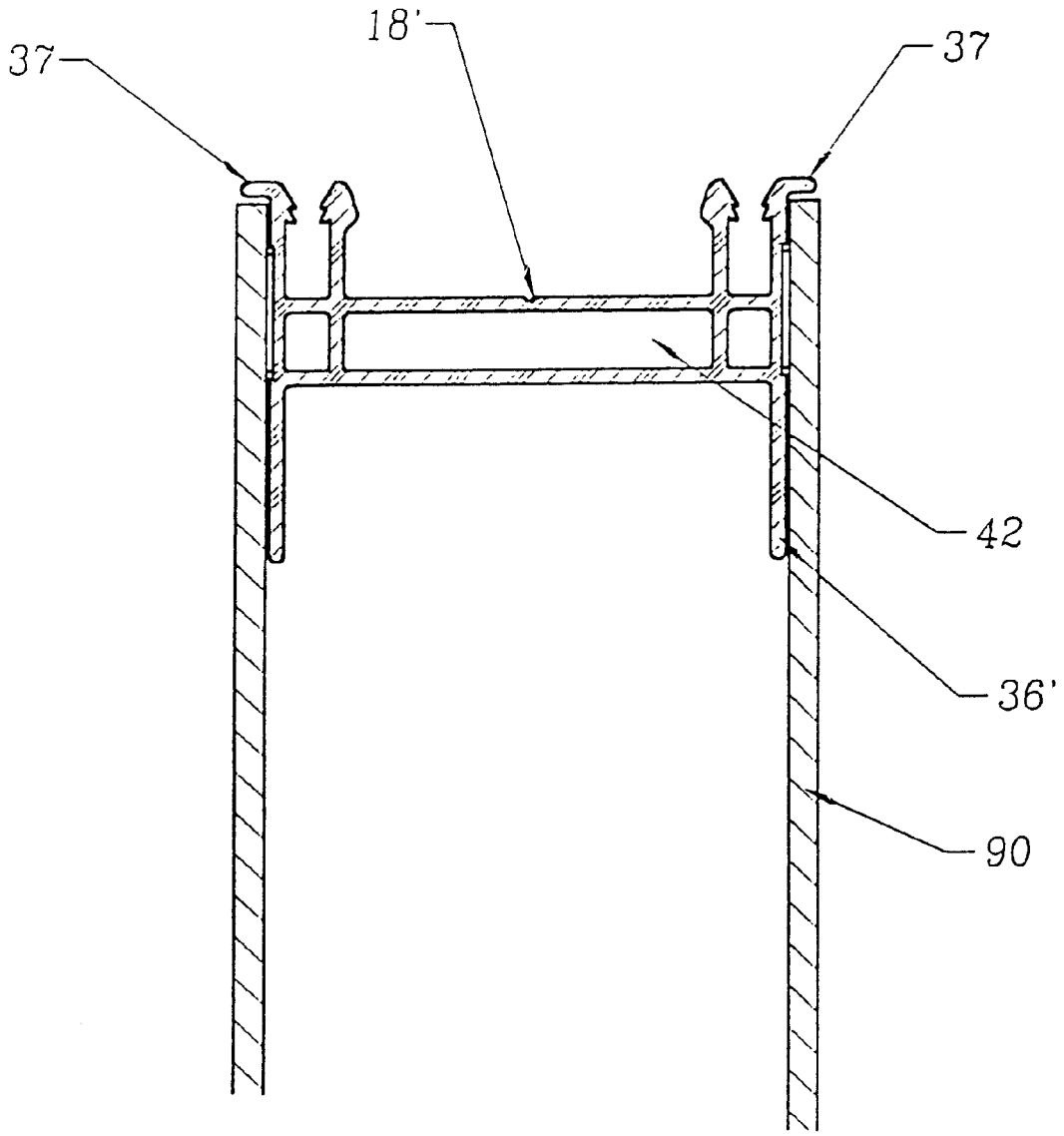
FIG. 10 is a cross-section view of a slightly modified form of perimeter frame member with portions of rigid sheet material illustrated on opposing sides thereof.

A modified perimeter frame member 18' is shown in cross-section in FIG. 10. This modified frame member possesses most of the features described previously, i.e. it includes the double-walled web defining the lengthwise hollow cavity 42 with the double-walled web extending between and fixed to modified primary flanges which, as before, extend parallel to one another. The principal difference is that the modified primary flanges are each outfitted with an outwardly turned ledge 37 extending along the primary flange which is disposed adjacent the outermost peripheral edges of the assembled panel. Hence, when the frame members are assembled together in a rectangular configuration using the desired corner connectors, these ledges 37 encompass a rectangular area within which a panel in the form of a sheet of rigid material 90 such as "Masonite" may be seated, this panel being bonded to the frame members as hereafter described. In this form of construction the composite core is an optional feature, i.e. the composite core may be omitted altogether. The panel may be exposed to the exterior, i.e. no covering fabric is necessary.

With reference to the panel manufacture/assembly process using the modified frame members 18', FIG. 11A again shows the extrusion being cut to length to form individual modified frame members 18' and these frame members are then assembled as in FIG. 11C into a rectangular outline frame (possibly with one or more transverse frame members 19 as desired) using the corner connectors 20' shown previously in FIGS. 7 and 8. The panels 90, such as "Masonite" are then cut to size as shown in FIG. 11B and then such panels are placed on opposing sides of the frame construction previously assembled such that the ledges 37 defined by the modified frame members 18' encompass and surround the opposing panels.

Referring to FIG. 11E, the edge of cover fabric 22 is then rolled into place as described previously in connection with FIG. 6E. Adhesive, double-sided tape or edge trim strips described hereafter retain the opposing panels firmly in place on the perimeter frame following which the trim strips 26, 28 and feet are installed as before with reference to FIG. 11F.

Figure 12:
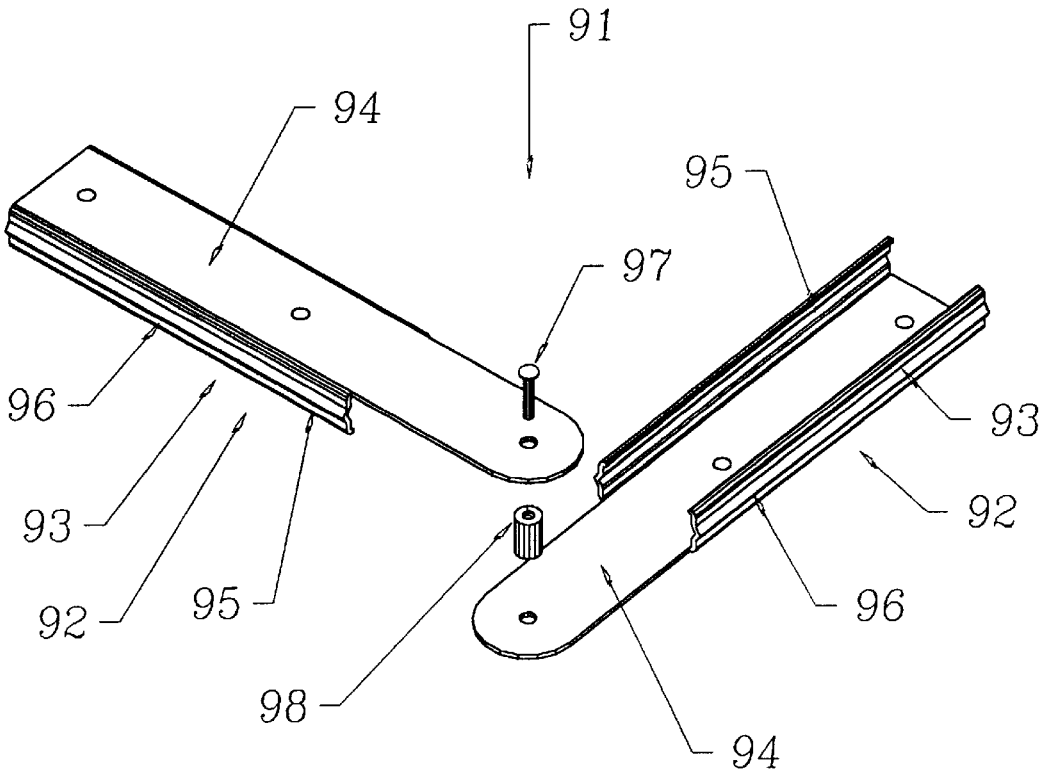
FIG. 12 is an exploded perspective view of one embodiment of panel-to-panel snap-in connector.

Referring now to FIG. 12, there is shown an embodiment of a snap-in panel-to-panel connector 91. Partition panels 10 can be removably connected together by snapping the connector 91 into the perimeter frame secondary channels 54 at the end of each panel of equal height, which connecting device is then secured with a fastener to the perimeter frame member.

Referring again to FIG. 12, the panel-to-panel connector is, as noted above, for use with panels of substantially equal height each having at least a horizontal top frame member which provides a spaced pair of parallel flanges 50 defining a secondary channel 54 with the flanges having protrusions 56 thereon directed inwardly toward each other as illustrated in FIG. 5. As shown in FIG. 12, the connector includes a pair of members 92 pivotally connected together, each such member including at least one retainer clip 93 adapted to be snap-fitted into engagement with the protrusions 56 of the flanges 50 which form the channel 54 of the associated panel frame member 12. The retainer clips 93 are also slidably adjustable along their associated channels 54 before being fixed in place by fasteners thereby to permit a variety of angular orientations of the panels relative to one another.

As seen in FIG. 12, each member includes an elongated flat tongue 94 with the retainer clip or clips for each member being formed at distal end portions of the respective tongues 94 with the tongues of the members being pivotally connected together at a point spaced from the retainer clips.

As seen in FIGS. 5 and 12, each retainer clip 93 comprises a shallow channel-shaped formation defined by a spaced apart pair of walls 95 on opposing sides of the distal end portion of the tongue. These walls each have a projection 96 formed therein which as shown is of a generally shallow lengthwise extending V-shaped configuration which is adapted to complement and come into the snap-fit engagement with the protrusions 56 on the aforementioned flanges of the panel frame members.

In the embodiment of FIG. 12, the two connector members 92 are pivotally connected by a pivot pin 97 with the adjacent ends of the tongues 94 of these members being held in slightly spaced apart relation by a spacer sleeve 98. In this particular embodiment, one retainer clip in effect faces downwardly, i.e. its opposing walls 95 are directed downwardly when fitted into position while the other is in the opposite orientation with its retainer clip facing upwardly.

Figure 13:
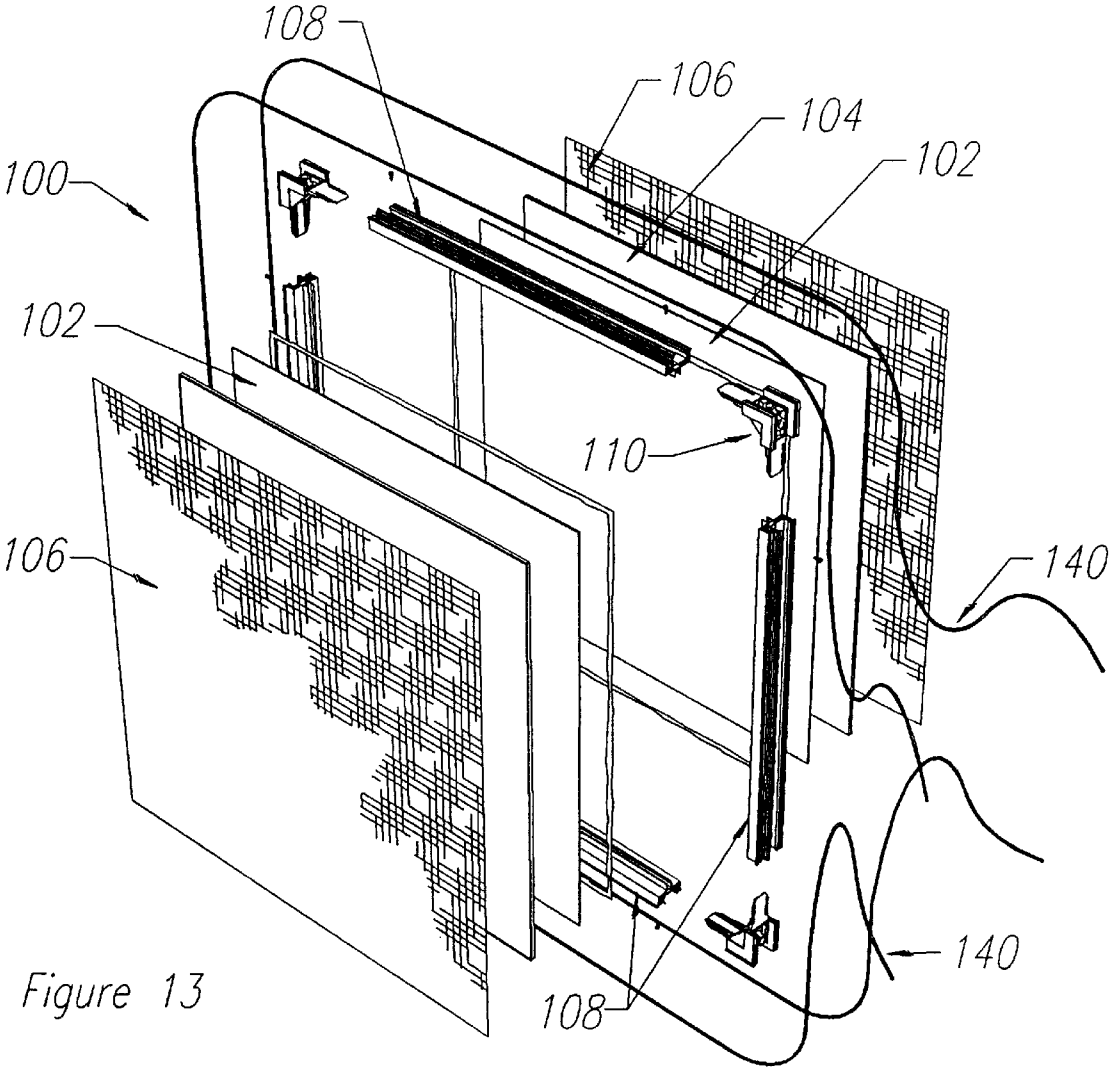
FIG. 13 is an exploded view of a further modified embodiment of the partition panel.

FIG. 13 is an exploded perspective view of a modified panel construction 100 showing a number of components somewhat similar to those illustrated previously in FIG. 2. The partition panel is of generally rectangular outline and includes opposed major faces each comprising one or more layers such as a hardboard panel 102, a layer of foam 104 and a fabric covering 106. The perimeter frame assembly comprises elongated frame members 108 which, as before, comprise plastic PVC extrusions which extend along the marginal edges of the panel 100. A plurality of corner connectors 110 are each located at a respective one of the corners of the panel and they serve to attach together the adjacent ends of the frame members 108. These corner connectors 110 will be described in further detail hereafter.

Figure 14:
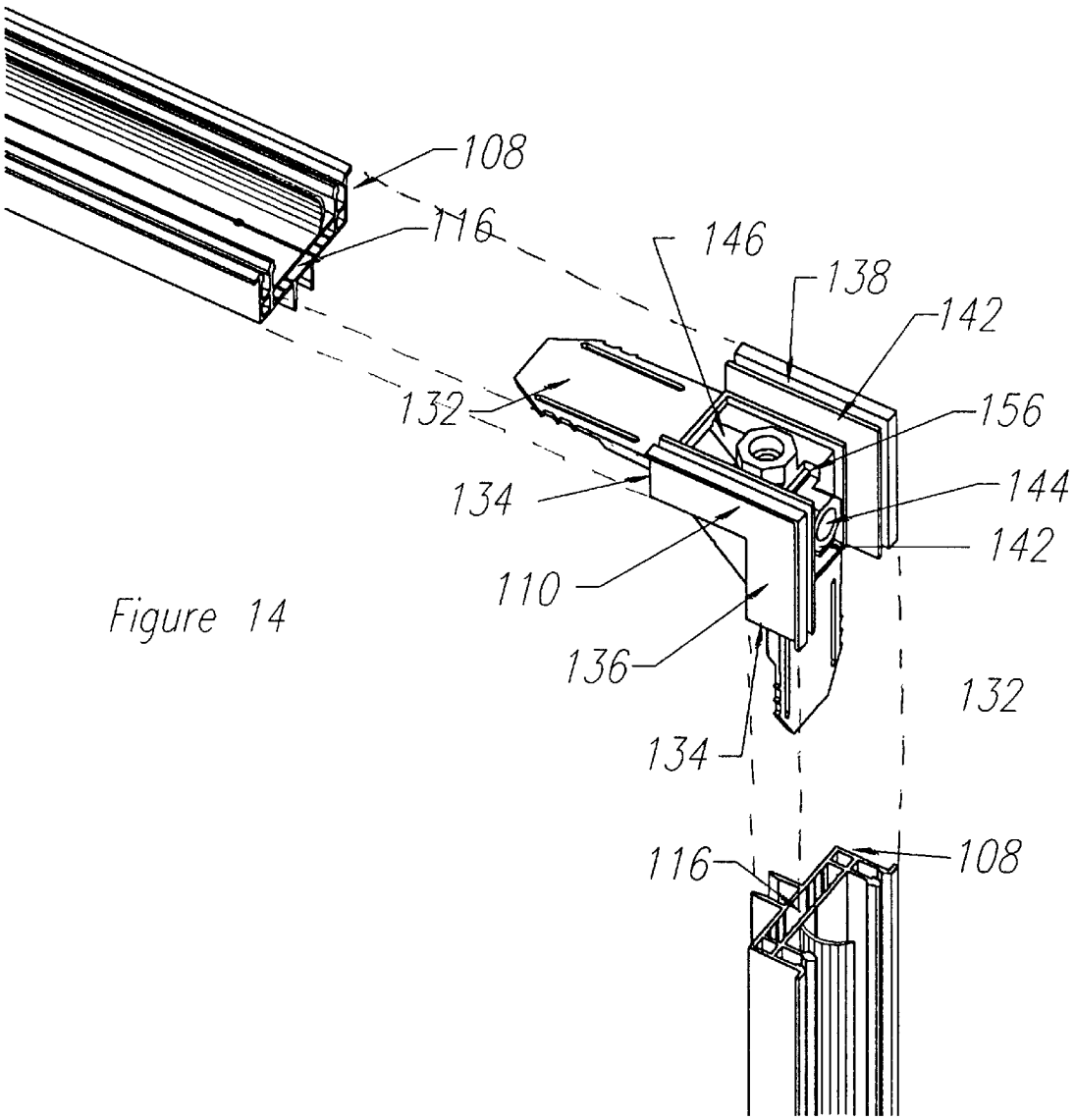
FIG. 14 is an exploded partial perspective view of the modified form of the panel showing the manner in which the corner connector cooperates with the marginal frame members.
Figure 15:
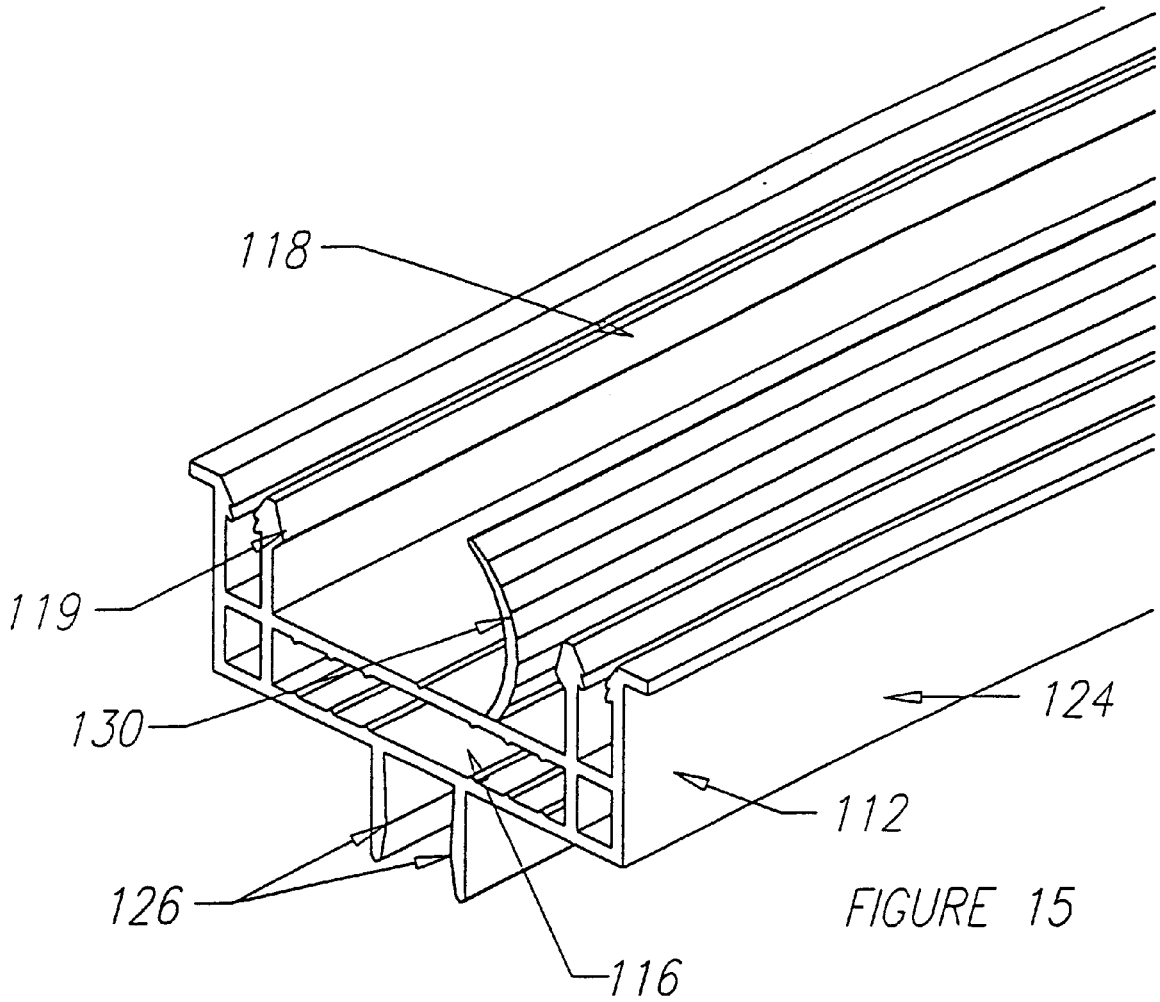
FIG. 15 is a perspective view of an end portion of a marginal frame member.
Figure 16:
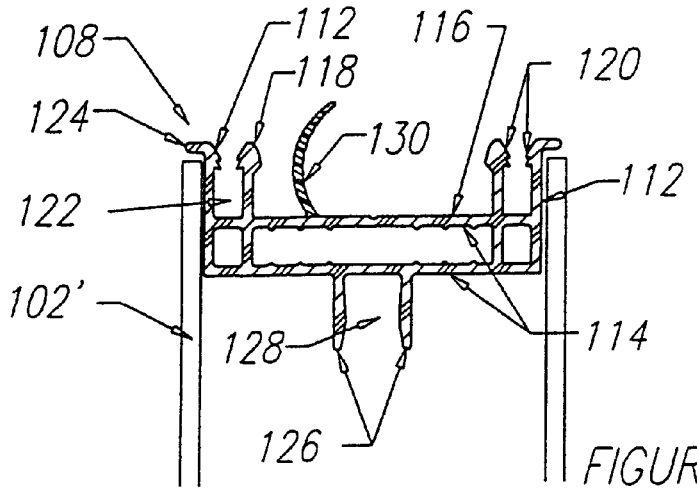
FIG. 16 is a cross-sectional view of the frame member showing panels associated therewith.

As best seen in FIGS. 14, 15 and 16, the frame members include spaced apart generally parallel primary flanges 112 with a double walled web 114 extending between the primary flanges and providing a lengthwise extending hollow cavity 116. These spaced primary flanges as well as the spaced secondary flanges 118 define relatively wide U-shaped grooves therebetween which, when assembled, are directed outwardly of the periphery of the panel. Also, as described previously, the frame members include groove defining elements in the form of spaced pairs of secondary flanges 118 provided with retaining means in the form of tooth-like projections 120 formed on the interior distal end portions of both the primary and secondary flanges 112, 118 and directed into the interior or mouth portions of the grooves 122 to provide a re-entrant shape for retention of marginal edge portions of panel coverings therein. As before the free distal edges of the secondary flanges 118 are provided with enlargements 119 to enable snap-fit of various connectors into the U-shaped grooves between secondary flanges 118. Additionally, the distal ends of the primary flanges 112 are provided with outwardly directed ledges 124 which, in the assembled condition, are disposed adjacent the marginal edges of the panel such that the ledges substantially encompass a rectangular area. This enables a sheet of rigid panel material 102' to be seated in the rectangular area in close juxtaposition to the primary flanges 112 thereby to define a major face or faces of the panel with these ledges 124 extending along the perimeters of the rigid sheet and substantially encompassing the same.

Another feature of the frame members is the presence of a centrally located parallel pair of further flanges 126 extending away from the inner wall of the double walled web 114 with the parallel further flanges 126 defining a central channel. As will be seen hereinafter these further flanges are utilized to support one or more rigid panels in a plane generally intermediate the planes defined by the outer or major faces of the panel.

Another feature of the frame member comprises the presence of a flexible rib 130 extending lengthwise thereof and disposed in the aforementioned U-shaped groove defined by the primary flanges. This rib 130 is of a relatively soft flexible PVC-coextruded and integrally formed with the more rigid PVC utilized for the remainder of the frame member. The flexible rib is sufficiently wide as to extend outwardly beyond the primary and secondary flanges 112, 118 such that when the panels are assembled together light is prevented and sound is inhibited from passing through the joint between the two panels. It is also noted that the rib 130 is curved about its longitudinal axis to ensure that it will always deflect to one side when pressure is applied to it and the rib is also offset from the center of the frame member 108 so there is less chance of it interfering with a flexible rib provided on the other panel that it joins.

Figure 16A:
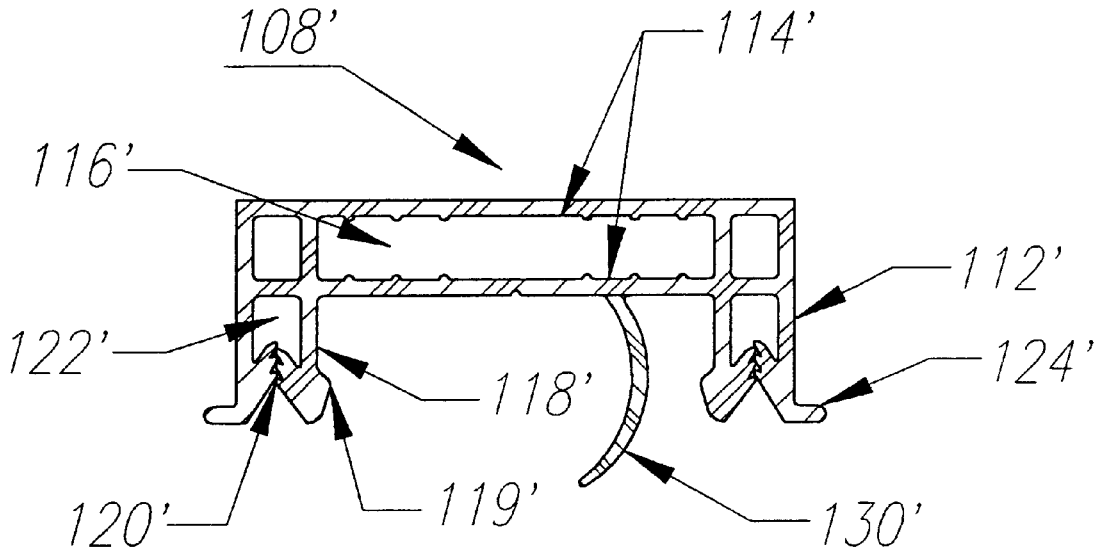
FIGS. 16A and 16B are further cross-sectional views of modified forms of marginal frame members.

The modified frame member of FIG. 16A is similar to that described previously with like but "primed" reference numbers, e.g. 108', designating similar parts. The first main difference is that the further flanges 126 of FIG. 16 are absent. These flanges are not required when there is no internal core to support (see e.g. FIGS. 21B and 21D). The second main difference is that the tooth-like projections 120' on the distal portions of flanges 112', 118' actually engage and/or overlap each other slightly to create a friction fit for the fabric covering as it is rolled into the retaining grooves 122'. The fabric is thus held taut across the faces of the panel assembly.

Figure 16B:
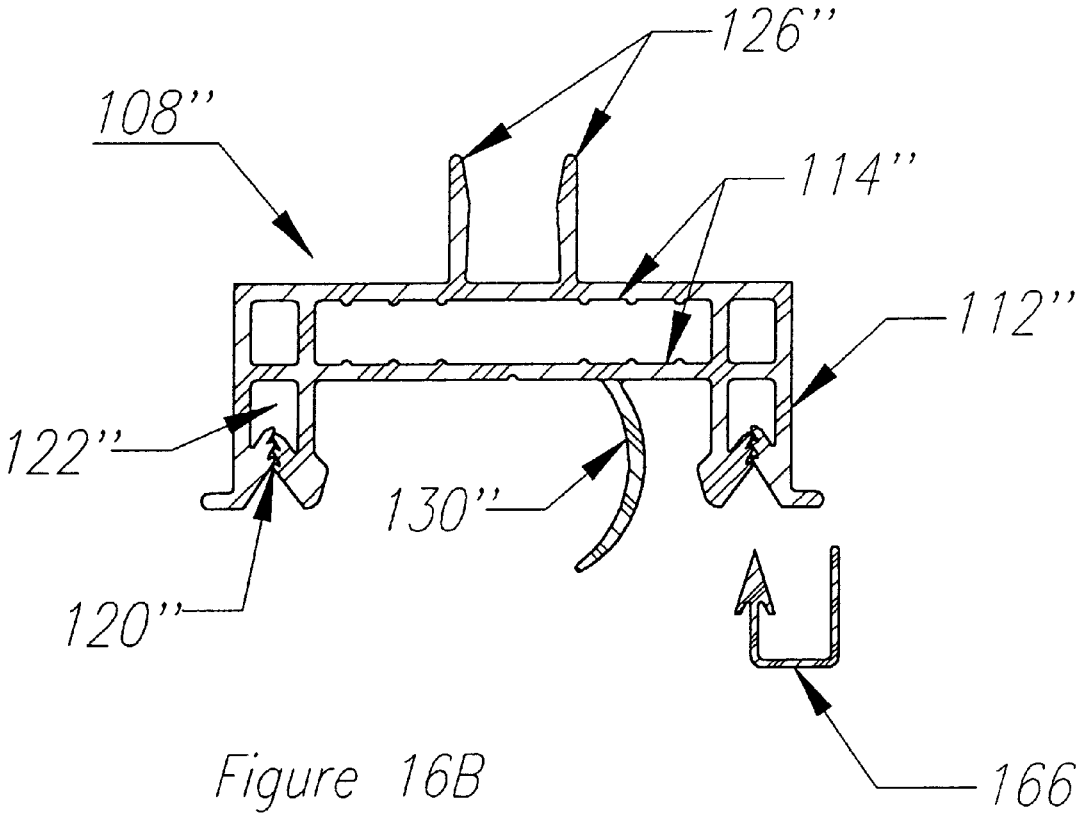

FIG. 16B shows a modification very similar to that of FIGS. 15 and 16, i.e. it includes the further flanges 126". However, in common with FIG. 16A it also includes the engaging and/or overlapping projections 120" to effect a friction fit for the fabric covering exactly as described above. Another option is to use an edge strip 166 as described hereafter to secure a facing panel as in FIG. 20 and/or a fabric covering.

The corner connectors 110 as best shown in FIGS. 14 and 17–19, serve to secure together the elongated frame members 108 generally at right angles to one another. Each corner connector 110 includes a pair of tongues 132 at right angles to one another and sized and arranged to be snugly fitted into the end portions of the lengthwise extending hollow cavities 116 in the frame members as described above. Each corner connector has pairs of shoulders 134 defined thereon which abut up against the respective adjacent ends of the elongated frame members 108 when the tongues 132 are fully inserted into the hollow cavities. As shown in the drawings, each corner connector 110 has spaced corner flanges 136 thereon defining the shoulders which abut the ends of the frame members, these shoulders 134 also being provided with the aforementioned groove-defining means including secondary flanges similar to those provided in the elongated frame members 108 with the grooves 138 defined by the corner connectors communicating with and being generally coplanar with the grooves 122 in the frame members thereby to enable marginal edges of the covering fabric 106 to be engaged and held in the grooves all around the perimeter of the panel including its corners by suitable means such as splines 140 (FIG. 13). It is also noted that the corner flanges 136 together with their associated secondary flanges define generally U-shaped recesses adapted to mate with the U-shaped recesses defined by the frame members.

Each corner connector 110 also has, adjacent a proximal end of each of the tongues 132, a respective short projection or boss 142, extending normal to associated tongue the two bosses for each corner connector 110 thus being at right angles to one another and, as noted, either one of the bosses 142 being adapted to mate, in use, (and depending on orientation of the panel) with a correspondingly shaped recess in a panel-to-panel or panel-to-post connector for securing partition panels (see FIGS. 22–25). It will be noted here that the bosses 142 are of octagonal outline although other outline shapes are possible. This multi-sided shape prevents the connector from rotating about the axis of the boss. Each boss is also internally threaded with the threads 144 being either formed directly in the plastics material or in a metal insert disposed in the boss 142 for receiving connector screws to be described hereafter. Each corner connector further includes a pair of rectangular apertures 146 each of which is located adjacent a respective one of the bosses 142 for simultaneously receiving therein a lug of a panel connector (to be described hereafter) as and when the connector is brought into engagement with the boss next adjacent thereto thereby firmly securing the panel connector against twisting and rotation relative to the associated corner connector 110.

The symmetry of the panel described is worthy of mention. The corner connectors, with their dual sets of bosses 142 and apertures 146 allow the panels to be installed in almost any desired orientation as the panel effectively has no defined top, bottom, left or right side, front or rear, and hence can be rotated and joined in any reasonable direction and fastened in place.

Figure 17:
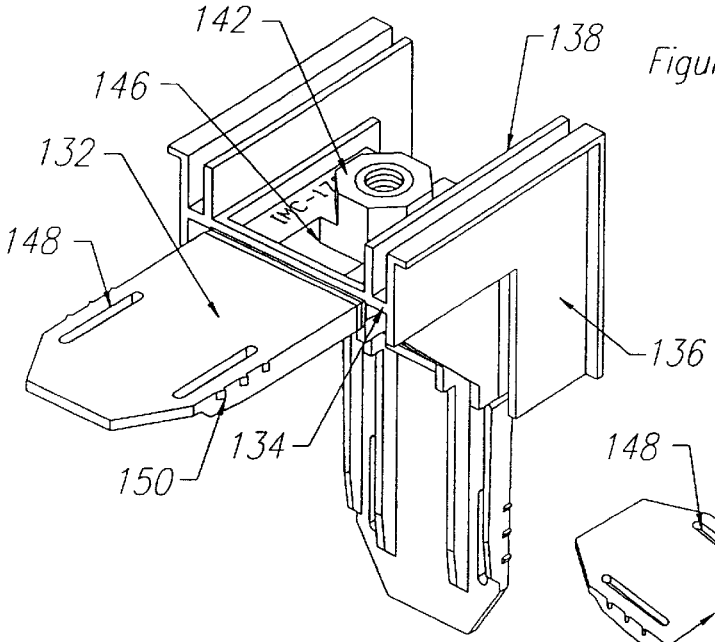
FIGS. 17, 18 and 19 are perspective views from different angles showing the modified corner connector.
Figure 18:
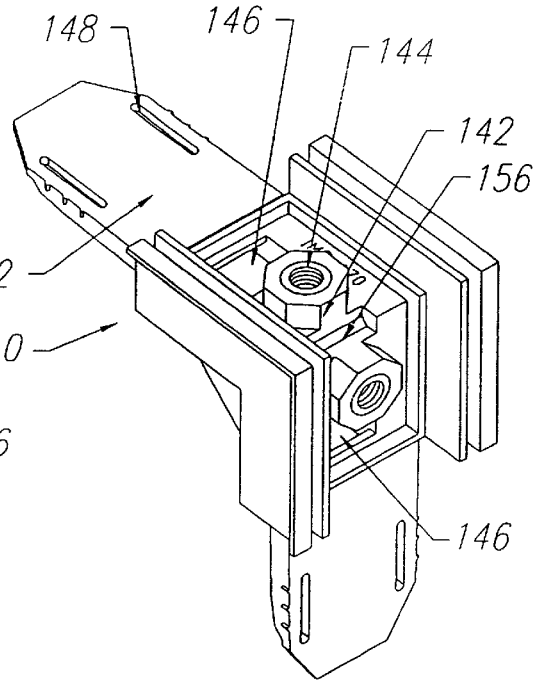
Figure 19:
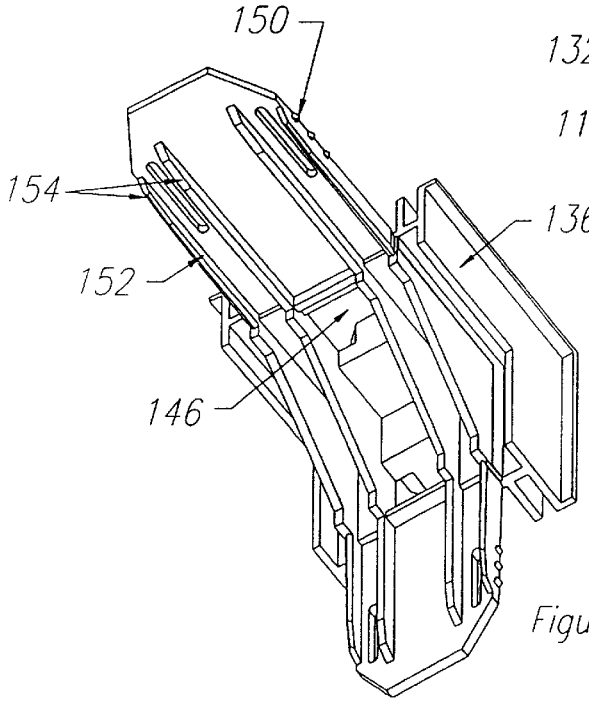

With further reference to FIGS. 17–19 it will be noted that the corner connectors 110 possess a number of additional features. The tongues 132 are each provided with elongated openings 148 adjacent opposing sides thereof to provide a measure of flexibility allowing the tongue 132 to flex inwardly when being inserted into the hollow cavity 116 of the frame member. Outwardly extending shallow barbs 150 on the tongue edges provide a substantial frictional fit. The tongue'sadists end is also provided with bevelled corners for ease of insertion.

With reference to FIG. 19, the underside of the corner connector tongue shows a plurality of ribs 152 to provide for friction fit with the internal walls of the hollow cavity referred to above with suitable steps 154 being provided for engaging the frame member when fully inserted to provide additional support.

The above-noted rectangular apertures 146 immediately adjacent the respective bosses 142, as previously noted, enable lugs on the connectors (to be described hereafter) to locate therein to prevent rotation of the connector on the octagon-shaped boss thus providing a solid panel-to-panel or panel-to-post connection. Additionally, these apertures provide for some ventilation of the interior cavity of the panel and allow for the possibility of routing small wires.

An additional notch 156 is provided on each corner connector intermediate the two bosses 142, again to receive a projection on the panel connectors used to further help prevent rotation of the connectors on the octagon-shaped bosses 142.

Figure 20:
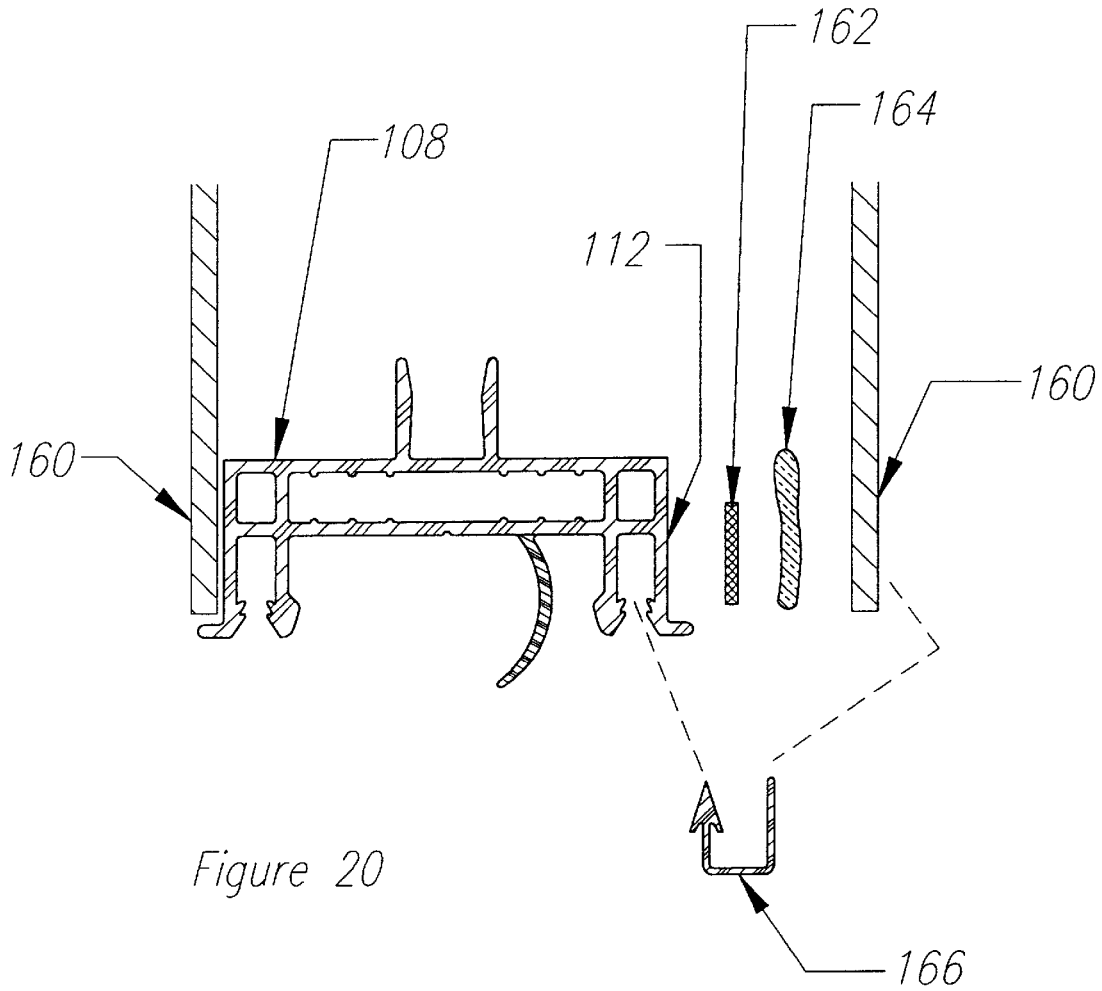
FIG. 20 is a partially exploded end elevation view of a marginal frame member with certain panels associated therewith illustrating the various ways in which panels may be fastened or secured to the frame member.

Turning now to FIG. 20, the manner in which face boards 160 for defining the opposing major faces of the panel may be attached to the perimeter frame assembly will now be described. As will be seen, adhesive double sided tape 162 may be used or a layer of glue 164 or, alternatively, a rigid edge trim strip 166 of generally U-shape configuration may be arranged with the arrow shaped bead of the edge trim firmly engaged within the grooves which, in several other embodiments, are utilized to secure a covering fabric, including vinyl, material.

Thus, as a first example, double sided adhesive tape 162 is interposed between the margins of the face board 160 and the primary flange 112 of the frame member 108. Alternatively, in place of the double sided adhesive tape, a layer of glue 164, preferably one that does not dry out and become brittle so that it remains flexible to accommodate expansion and contraction, is interposed between the primary flange 112 and the margin of the face board 160 to hold the latter securely in place. Finally, by utilizing the edge trim 166 referred to above, the face board may be effectively secured to the frame members (as well as to the corner members) by means of the edge trim without the need for glue or double sided tape.

Figure 21A:
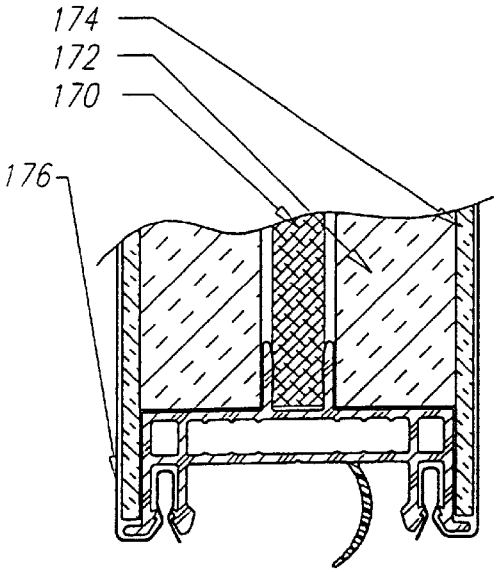
FIGS. 21A–21P are cross-section views taken through the frame member showing various panel constructions and illustrating the many variations and locations of panel boards, core boards, acoustic fillers, glazing panels, covering materials and fabrics etc. which may be utilized depending upon requirements.
Figure 21B:
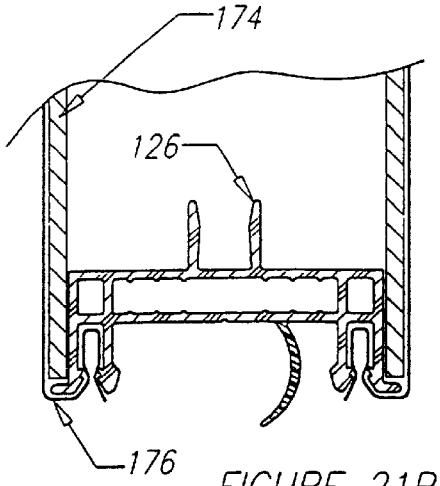
Figure 21C:
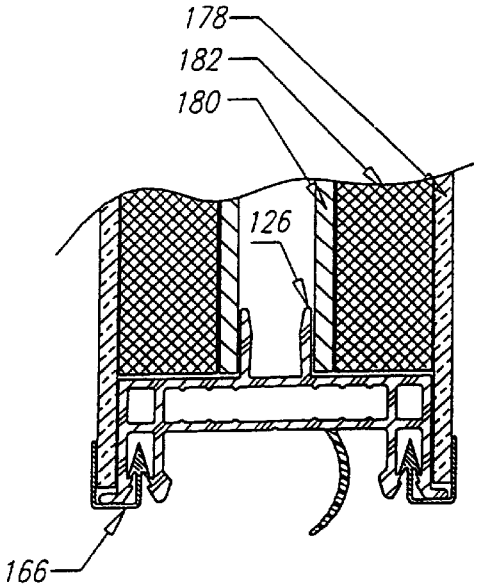
Figure 21D:
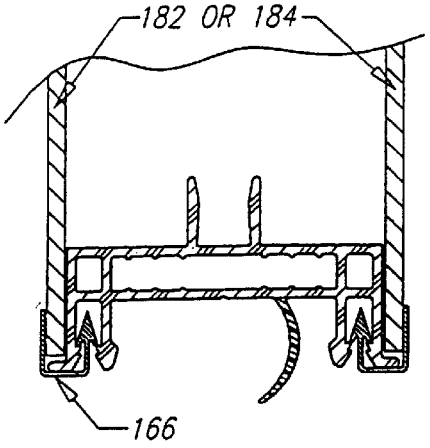
Figure 21E:
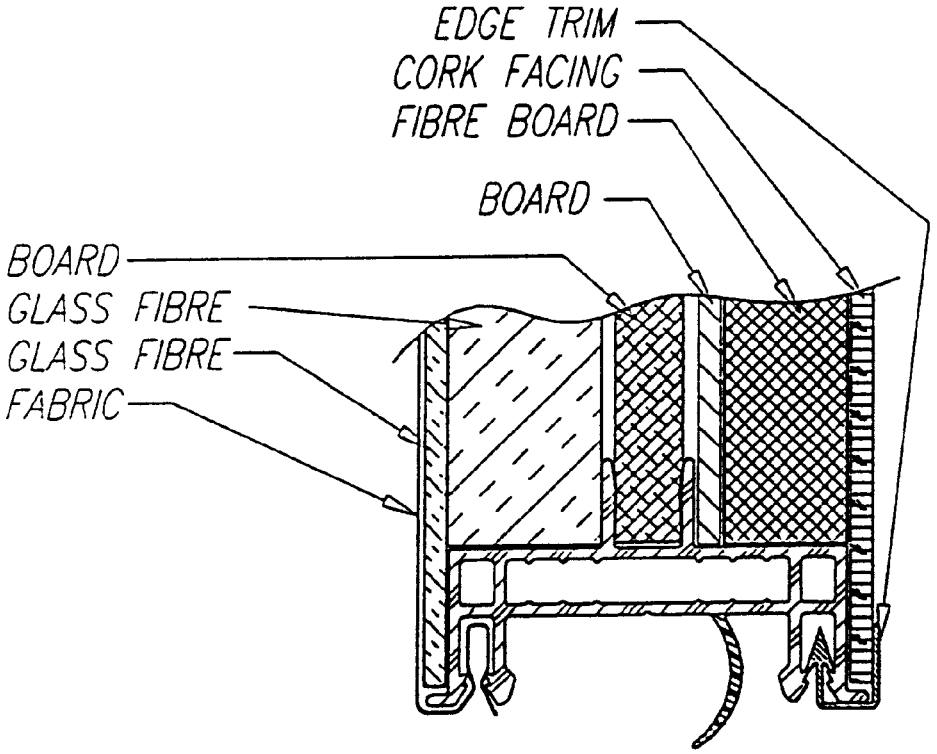
Figure 21F:
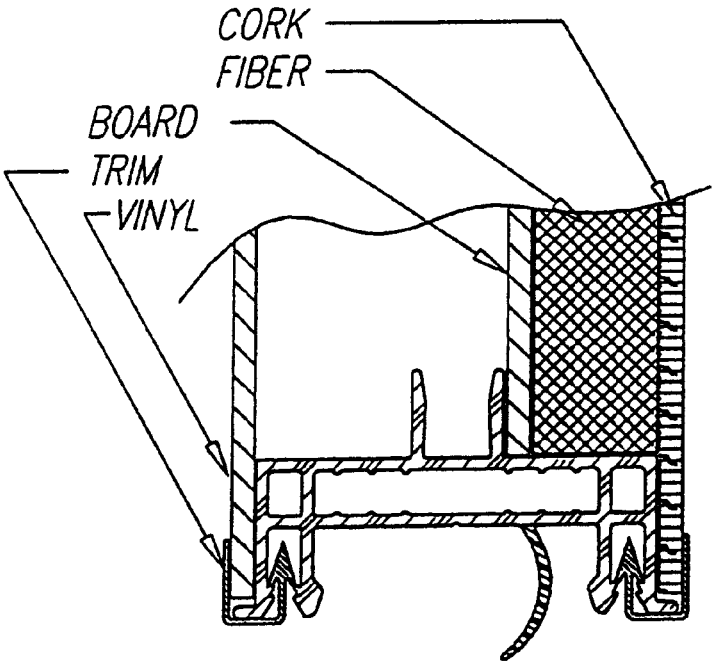
Figure 21G:
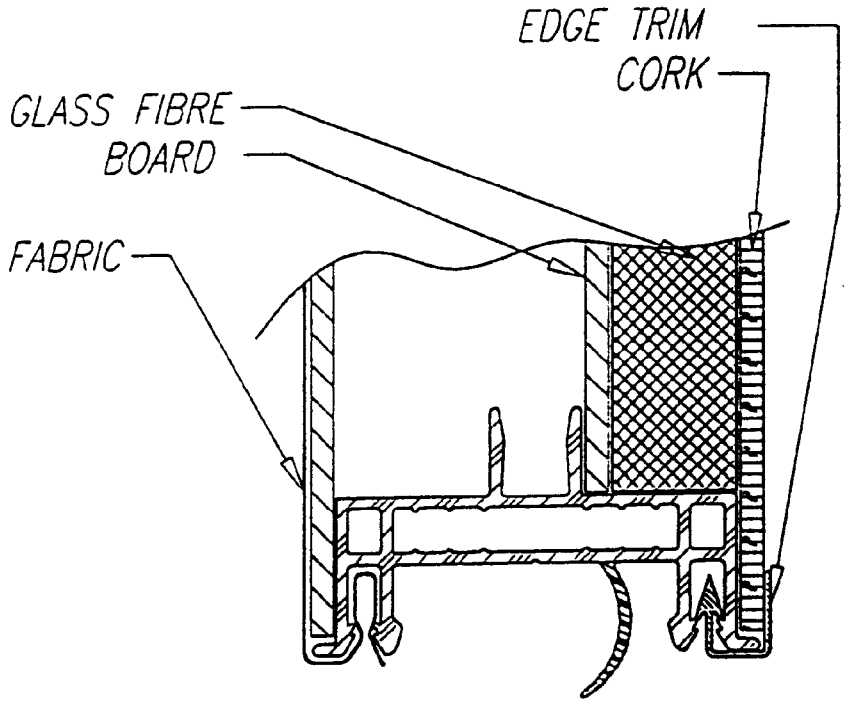
Figure 21H:
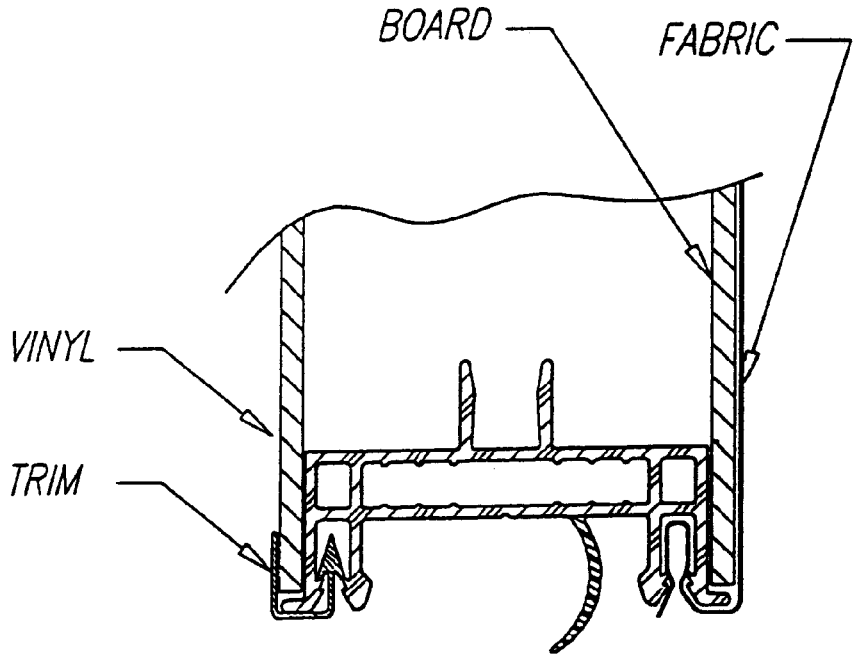
Figure 21I:
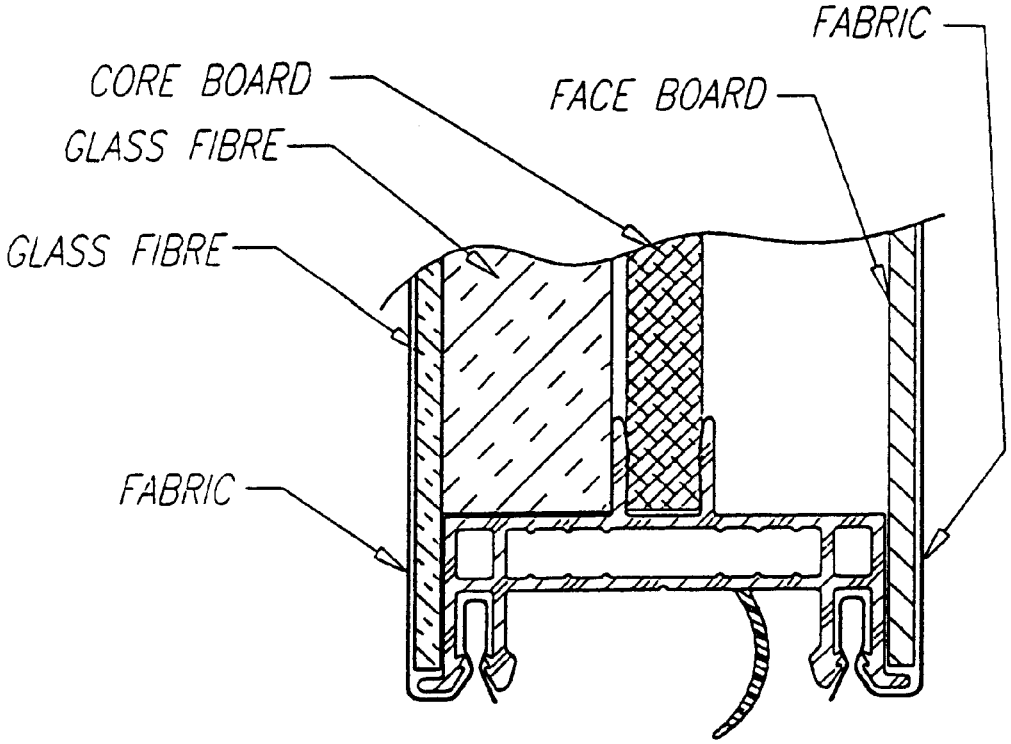
Figure 21J:
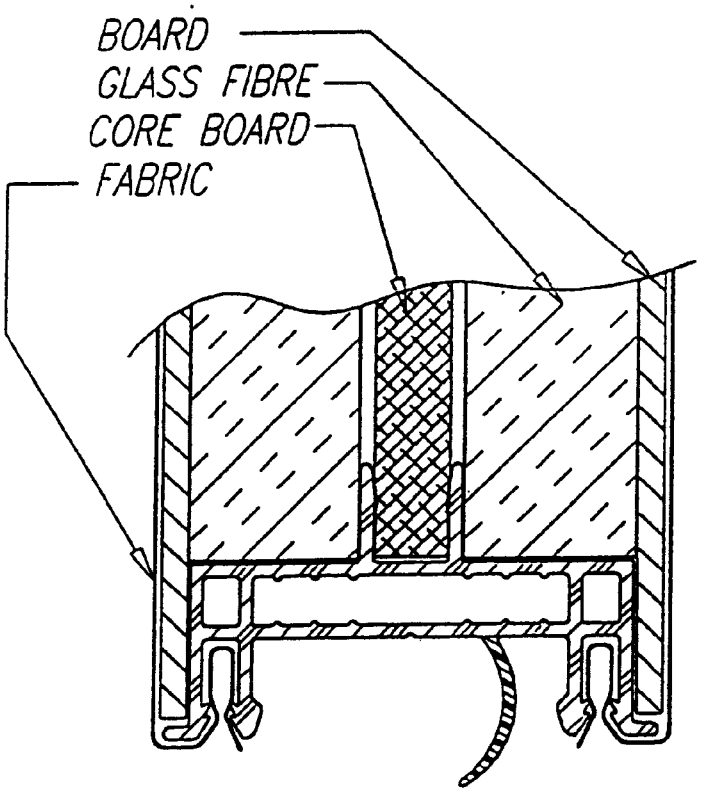
Figure 21K:
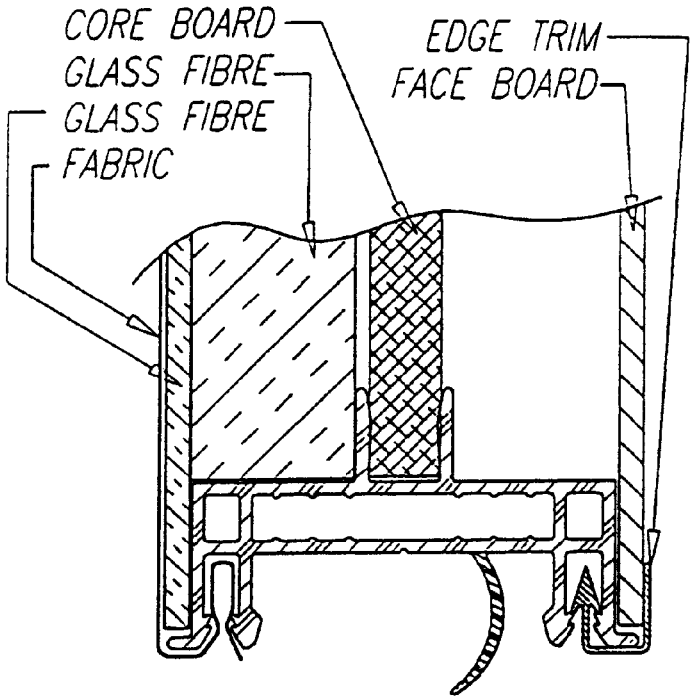
Figure 21L:
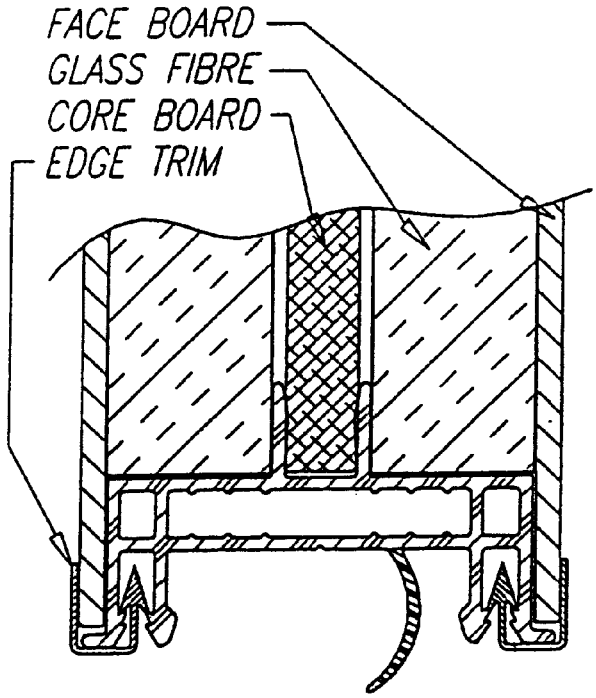
Figure 21M:
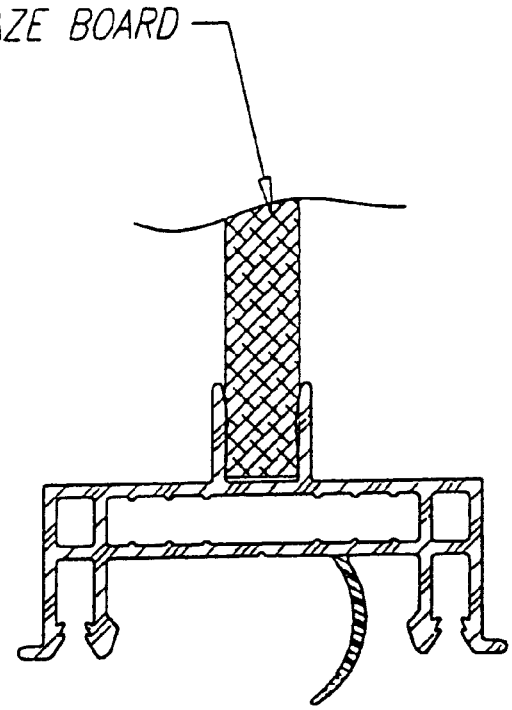
Figure 21N:
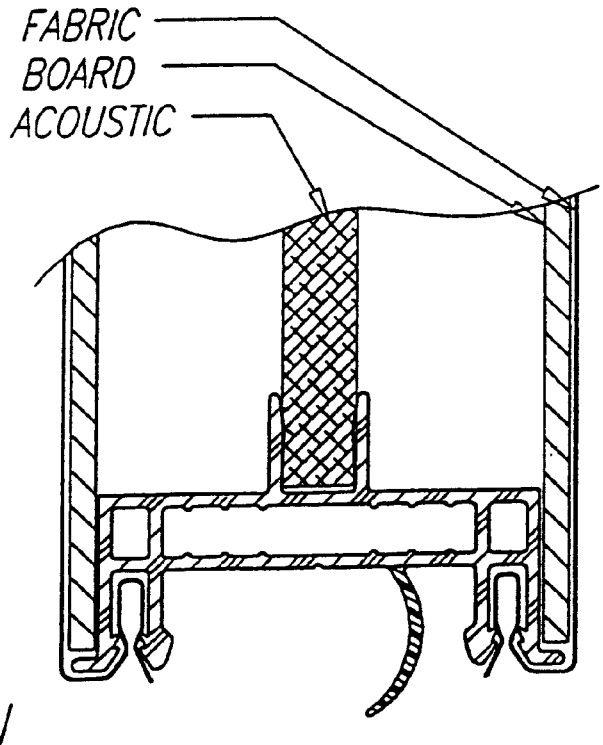
Figure 21O:
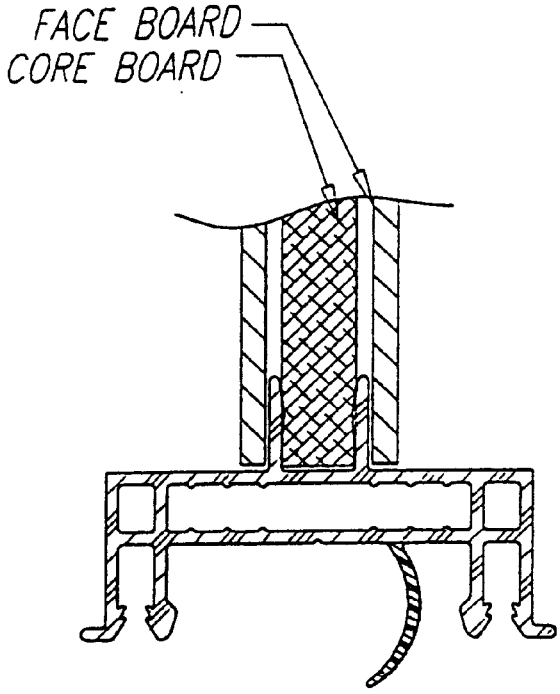
Figure 21P:
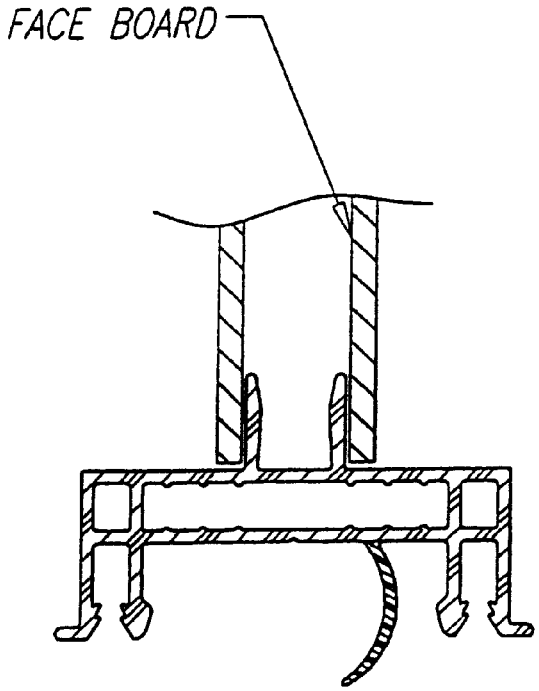
Figure 22:
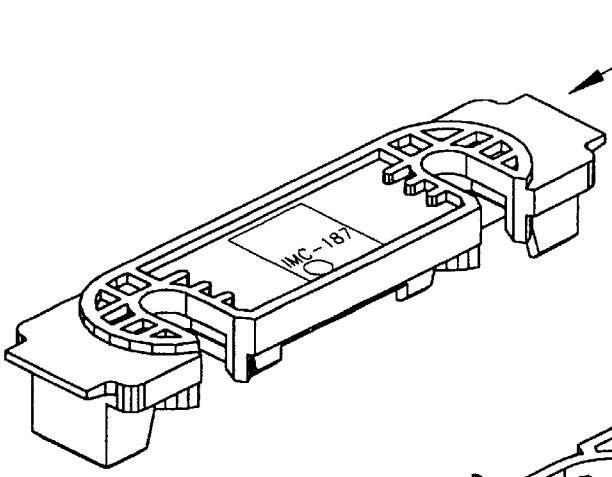
FIGS. 22–25 are perspective views of a panel-to-panel straight connector, a panel-to-panel perpendicular connector, a panel-to-post connector and a transition panel, connector respectively.
Figure 23:
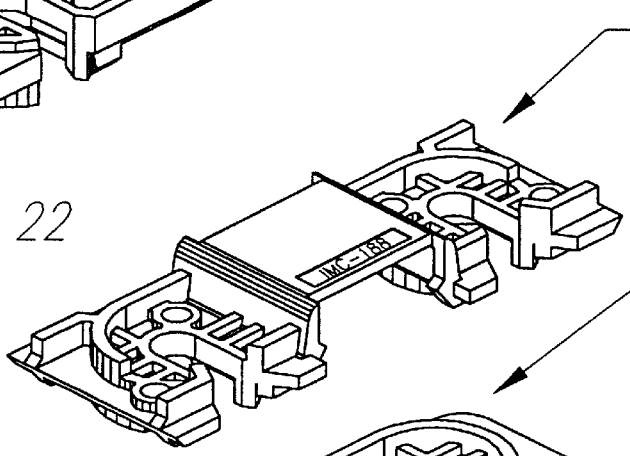
Figure 24:
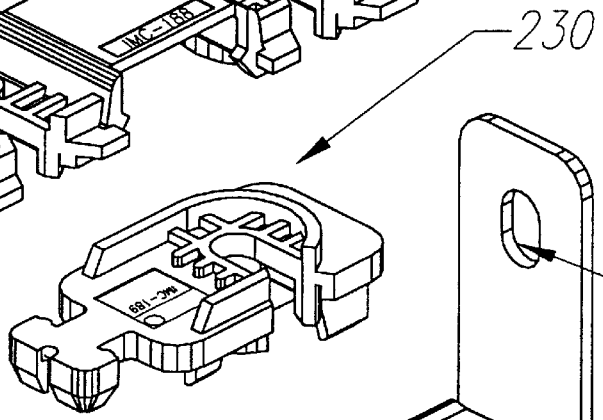
Figure 25:
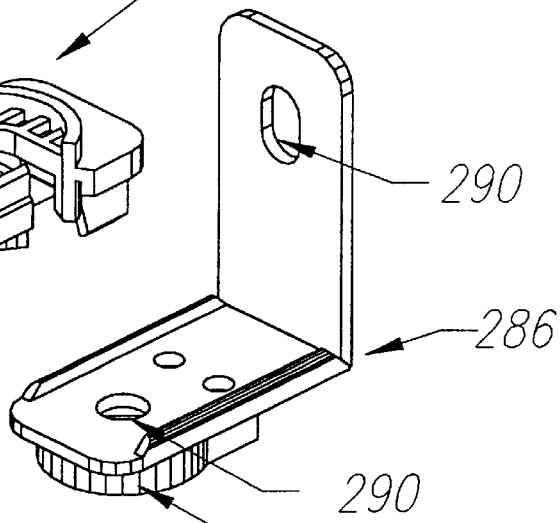
Figure 26:
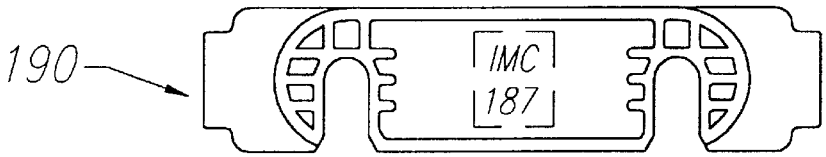
FIGS. 26–29 are top plan views of a modified form of the four connectors referred to in connector with FIGS. 22–25 in the same order.
Figure 27:
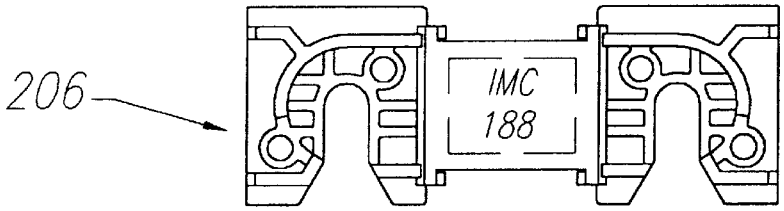
Figure 28:
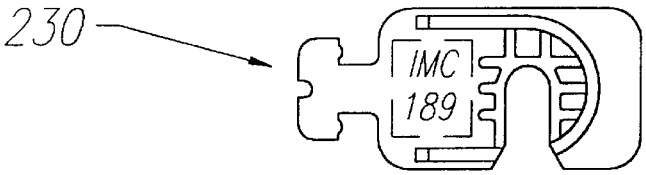
Figure 29:
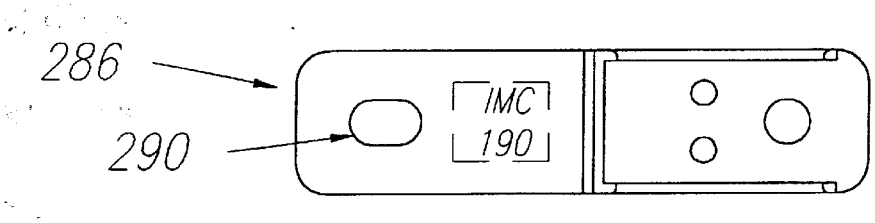

FIGS. 21A–21P illustrate the tremendous number of varieties of combinations of panel configurations and coverings made possible by the present invention.

FIG. 21A shows an acoustic panel arrangement wherein there is disposed a central core board 170 located in the center channel 128 defined by the further flanges 126, with rectangular batts of glass fibre 172 being disposed in flanking relation to the core board 170. The major faces of the panel are defined by rigid glass fibre reinforced sheets 174 covered with an exterior layer of fabric 176, the marginal edges of which are secured in the previously noted retaining grooves.

FIG. 21B is a relatively simple structure with the interior of the panel being entirely hollow and the major surfaces being defined by a pair of rigid sheets 174 covered with any desired fabric material 176.

FIG. 21C is another variation wherein the panel is provided with cork facing boards 178 with a pair of rigid boards 180 being disposed in flanking relation to the further flanges 126 referred to previously. Relatively thick fibre boards 182 are provided on each side immediately inwardly of the cork facing boards 178.

FIG. 21D shows a simple arrangement employing either two glazing panels 182 or two vinyl faced panels 184, both of which are secured in place by the previously noted edge trim strip 166, glue 164 or tape 162.

It is unnecessary to describe the structures illustrated in FIGS. 21E–21P in further detail as the various permutations and combinations of structural arrangements will be readily apparent from the drawings and the notes thereon.

The various types of panel connectors will now be described, beginning with the panel-to-panel straight connector 190 illustrated in FIGS. 22, 26, 30 and 31–35.

Figure 30:
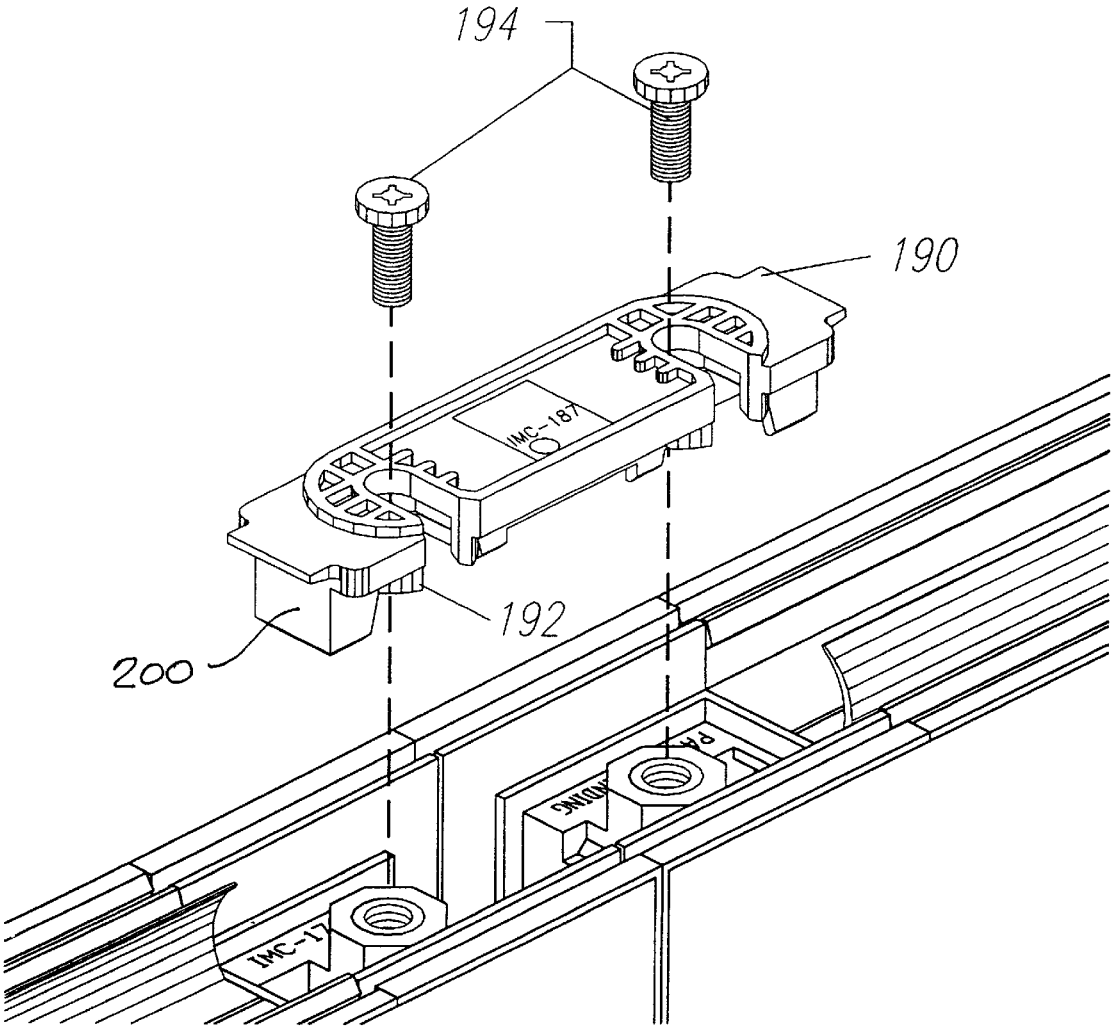
FIG. 30 is a perspective view illustrating application of a panel-to-panel straight connector.
Figure 31:
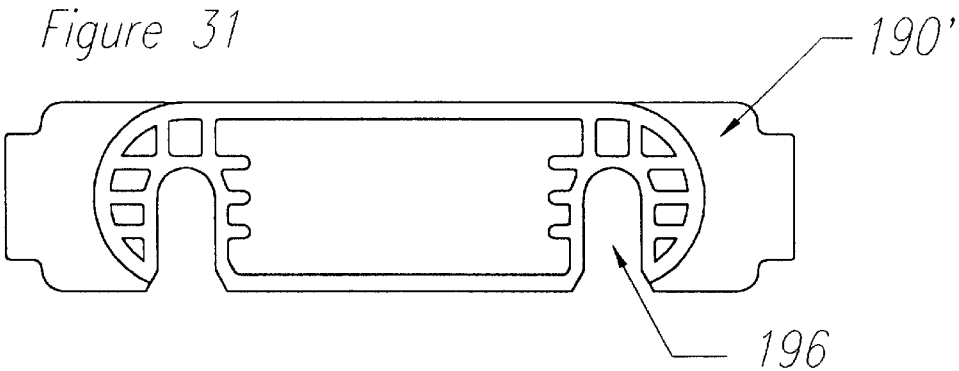
FIGS. 31–35 are top plan, side elevation, first and second end elevation views and bottom plan views respectively of a panel-to-panel straight connector as previously illustrated in FIG. 22 for example.
Figure 32:
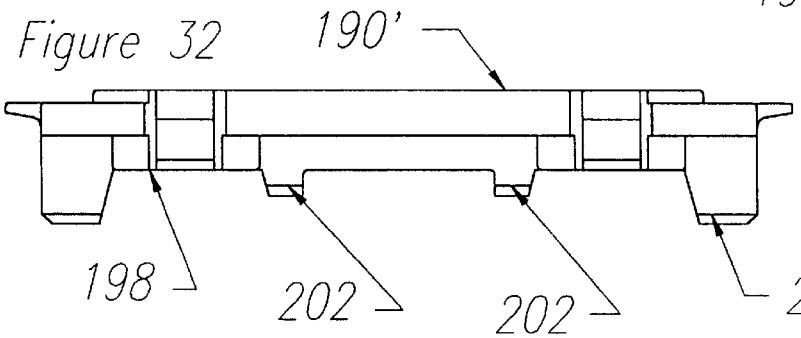
Figure 34:
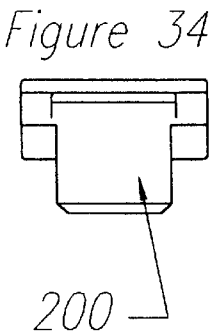
Figure 35:
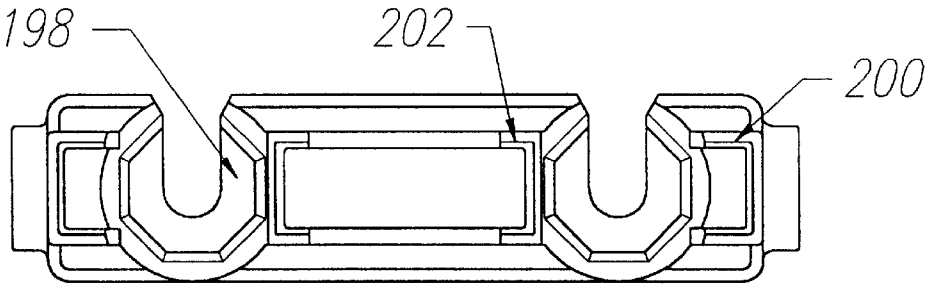
Figure 33:
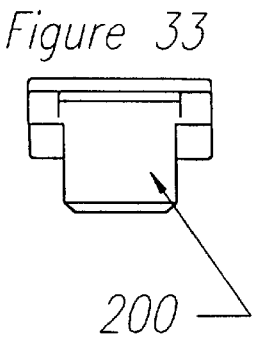
Figure 37:
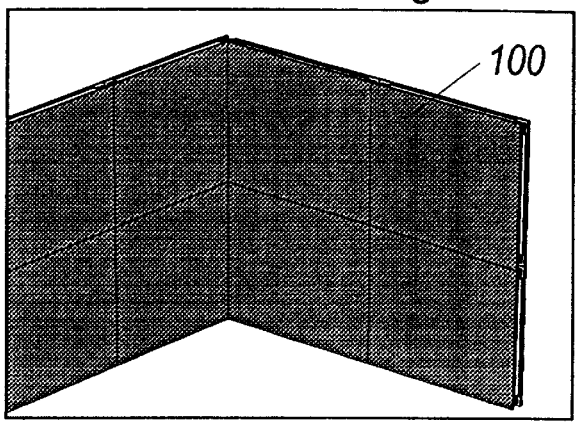
FIGS. 36–39 are perspective views illustrating the manner in which the panel-to-panel perpendicular connector of FIG. 23 is utilized to secure panels together at right angles to one another.
Figure 36:
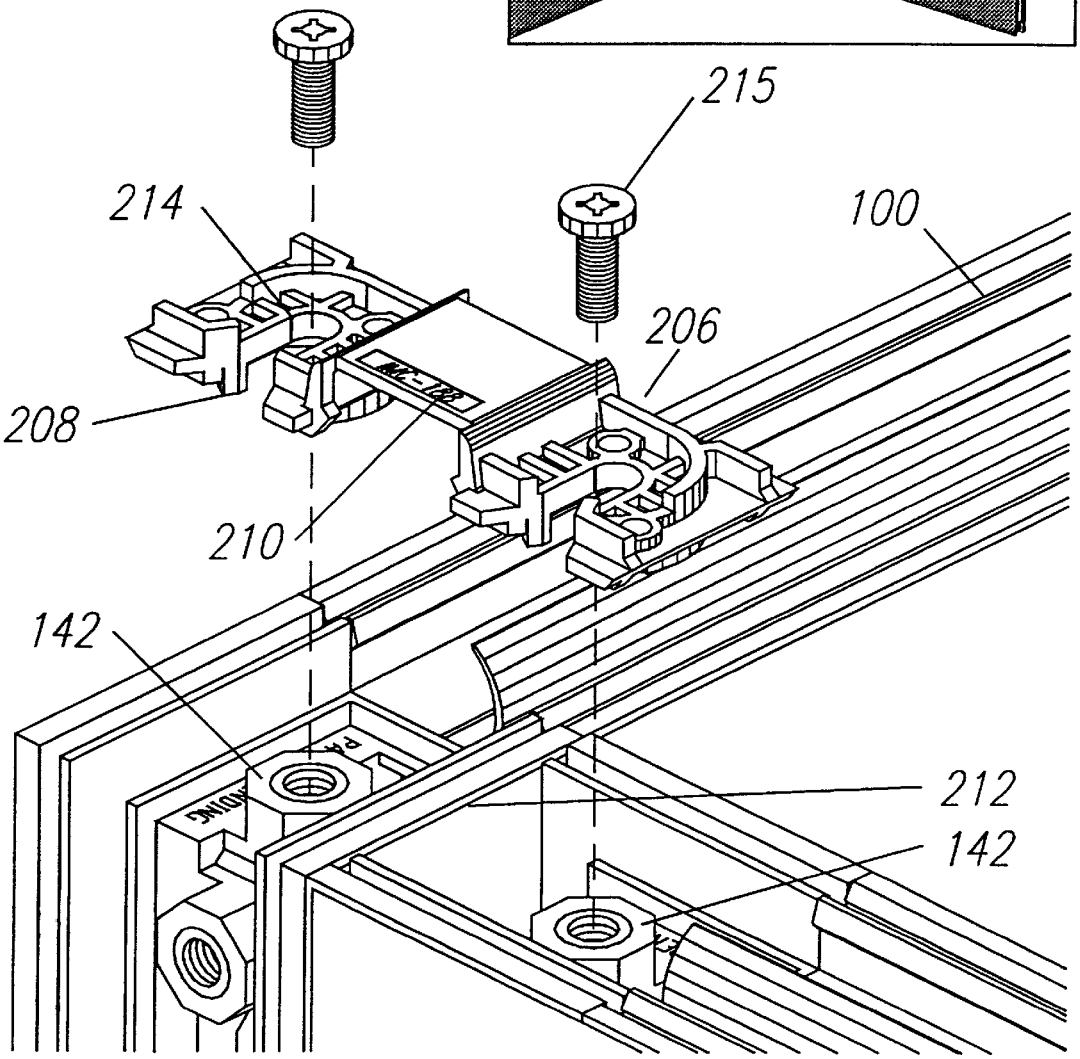
Figure 39:
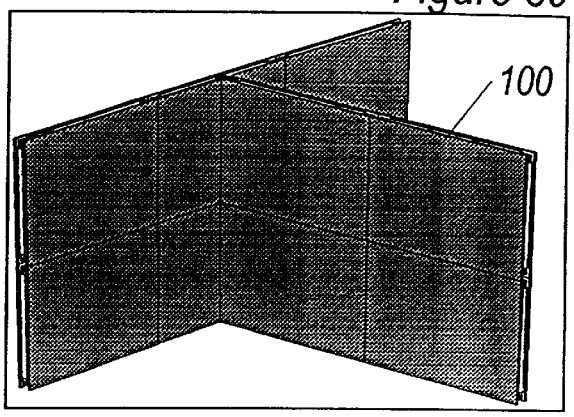

The function of the straight connector is best illustrated in FIG. 30. It will be seen here that the straight connector 190 secures two panels 100 together edge-to-edge in a straight or co-planar relationship. The connector 190 is used in the horizontal orientation illustrated in FIG. 30 as well as in a vertical orientation at the end of a panel section when one panel is stacked vertically on another panel (as will be seen hereinafter with reference to FIG. 63).

The connector 190 includes a somewhat elongated body having stiffening ribs as noted hereafter. The undersurface of the connector is provided with a spaced apart pair of shallow sockets 198 each of which is provided with an octagonal opening which is sized to receive the octagonal bosses 142 which are provided on the corner connectors of the adjacent panels as described previously. Once the straight connector 190 has been positioned, a pair of screws 194 are inserted through openings provided in the opposing ends of the connector 190, which screws are threaded downwardly into the threaded central portions of the octagonal bosses 142 thereby to secure the straight connector firmly in place. The upper and lower surfaces of the connector 190 are provided with ribs to add strength so that the connector may resist twisting or bending due to panel movement. The connector is provided with slots or cut-outs 196 which serve to allow the connector to fit around the glides (not shown) provided on the bottom edges of pre-joined panels. These slots or cut-outs 196 lead into the respective sockets 198 of octagon shape. Other features include a downwardly extending lug 200 disposed at each of the opposing ends of the connector. These lugs 200 are designed to fit into the rectangular 146 apertures provided in the corner connectors adjacent the octagonal bosses 142 thereon. When fitted together these lugs 200 assist in supporting the connector 190 by preventing bending or twisting thereof relative to the corner connector 110. To further enhance this capability, the connectors are also provided with a pair of relatively short lugs 202, each being located in spaced relation to the associated primary lug 200 on the opposite side of the octagonal socket 198 referred to above. These short lugs 202 are shaped to cooperate and to enter into the previously referred to additional notches 156 which are provided on each corner connector 110 intermediate the two bosses 142 with these elements again helping to prevent rotation of the panel-to-panel straight connectors relative to the corner connectors.

The panel-to-panel perpendicular connectors 206 will now be described with reference to FIGS. 23, 27, FIGS. 36–43. The function of the panel-to-panel perpendicular connector is best illustrated in FIGS. 36–39. In this form of perpendicular connector 206, the connector is again provided with a somewhat elongated body, the opposing end portions of the body having a pair of shallow downwardly extending sockets 208 having octagonal recesses therein designed to snugly receive therein the octagonal bosses 142 of the respective corner connectors of panels 100 which are arranged at right angles to one another. The opposing end portions of the connector are joined together via a somewhat raised or arched intermediate section 210 which provides sufficient clearance as to allow the connector to bridge or extend over the marginal edge 212 of the panel which is extending at right angles to the connector. As with the straight connector, the opposing end portions of the perpendicular connector 206 are provided with openings 214 for receiving a pair of screws 215 which extend into the bosses as previously described thereby to hold the panel-to-panel perpendicular connector firmly in place.

Figure 38:
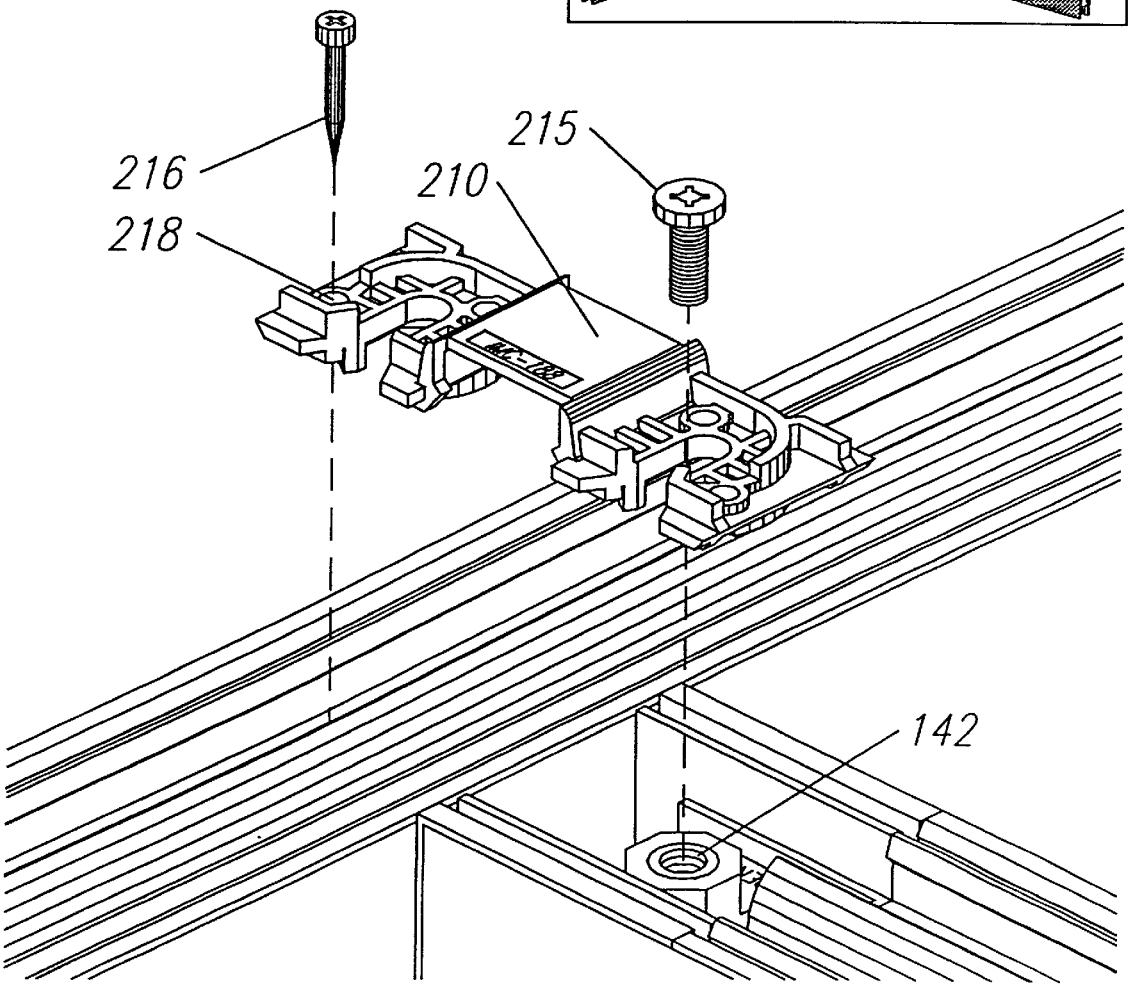
Figure 40:
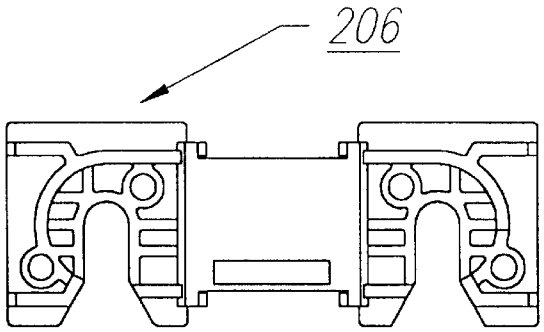
FIGS. 40–43 are top plan, front elevation, end elevation and bottom plan views respectively of the panel-to-panel perpendicular connector.
Figure 41:
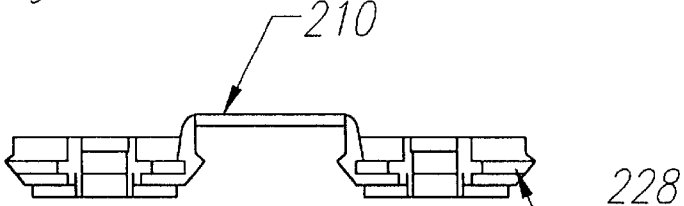
Figure 42:
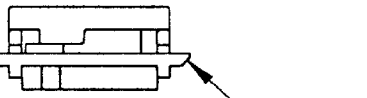
Figure 43:
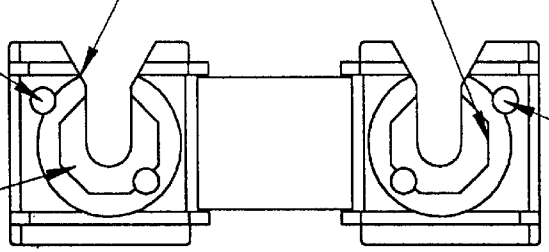

It should be noted that the perpendicular connector is used both at the top and the bottom of the panel to provide a firm attachment. Additionally, as illustrated in FIG. 38, the perpendicular connector 206 allows panels to be connected at right angles to one another at any point along the panel. Hence, as shown in FIG. 38, a self-tapping screw 216 passes downwardly through an additional hole 218 provided outwardly of the previously mentioned opening 214 for receiving the primary attachment screw, this self-tapping screw being threaded downwardly into the marginal frame member 108 at the selected location, with the other end of the perpendicular connector 206 being fixed to the boss 142 on the corner connector 110 of the next adjacent panel and secured by means of the primary screw 215. The perpendicular connector also has a series of outwardly projecting bevelled pairs of straight ledges 228 effectively surrounding the respective sockets 208, the pairs of ledges 228 being at right angles to one another and being spaced to provide for a snap-fit engagement of the ledges with and between the distal edge enlargements 119 of the secondary flanges of the corner connectors 110. The tight snap-fit engagement provided by these ledges 228 secures the perpendicular connectors 206 in place and further resists rotation of the connector about its associated boss when in use. This compensates for the absence of lugs (e.g. lugs 200) on the perpendicular connectors.

Referring to FIGS. 40–43, various stiffening ribs are provided on connector 206 to provide the necessary strength and rigidity. A slot or cut-out portion 222 leads into each of the sockets 208 thus allowing the connector 206 to readily be placed around the glides (not shown) typically provided at the bottom of the panel assembly. The opposing end portions of the perpendicular connector are provided with the pair of smaller holes 218 to receive the self-tapping screws in the manner illustrated in FIG. 38 so that the connector 206' may be secured to an adjacent panel at any point along that panel as described above.

Panel-to-post connectors 230, as well as corner post configurations 232, are illustrated in FIGS. 24, 28 and 44–52. Before describing this particular form of connector it seems advisable to describe the post 232 per se. The post comprises a hollow extrusion which is symmetrical about mutually transverse axes. The central core of the post is of square cross-section having a double wall construction with the inner wall 234 being connected to the outer wall 236 via diagonally disposed webs. The four corners of the post are defined by respective square cross-section tubular elements 238, each disposed outboard of its associated corner of the rectangular core via a short diagonally arranged web portion 240. Each tubular element 238 is provided with a pair of sloping shoulder-like profiles 242 which are dimensioned, shaped and spaced apart from one another so as to correspond with the profiles formed at the distal ends of the secondary flanges 118 of the peripheral frame members 108 thereby to permit various forms of connectors and trim strips to be snap-fitted thereonto.

Disposed between and spaced from the tubular elements 238 at the four corners of the post are spaced pairs of outwardly projecting somewhat L-shaped elements 244 directed toward each other and forming respective re-entrant channels 246 extending along each of the four sides of the corner post 232. These re-entrant channels 246 are provided (adjacent opposing sides of the mouth of the channel), with inwardly directed semi-circular grooves 248 within these re-entrant channels being dimensioned and configured to receive the head portion of a panel-to-post connector to be described hereinafter. As will be seen hereinafter, these semi-circular grooves 248 cooperate with correspondingly shaped ribs formed on the head of the connector to assist in preventing the head of the connector from twisting out of the channel in the post during use.

Figure 46:
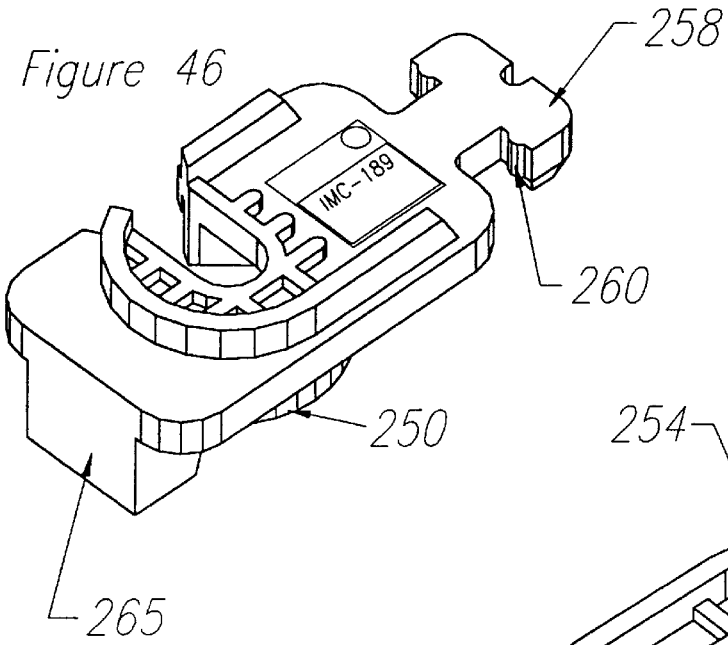
FIGS. 46, 47 and 48 are perspective views taken from differing angles of the panel-to-post connector.
Figure 47:
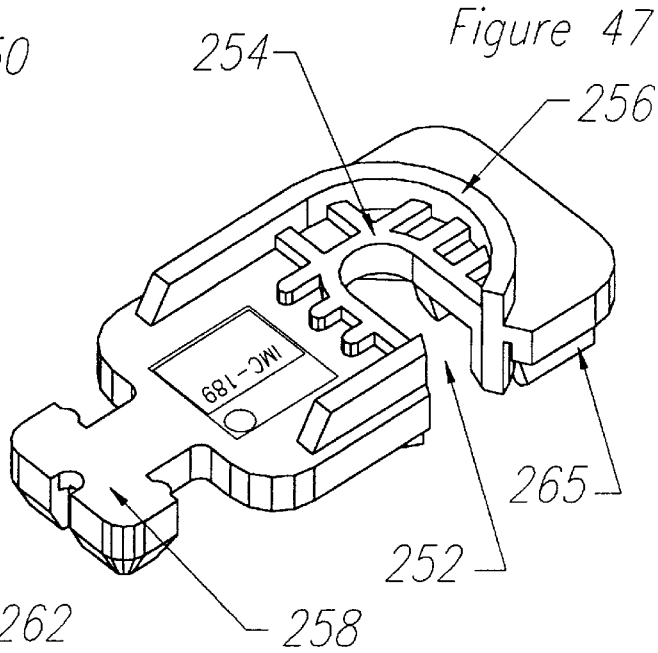
Figure 48:
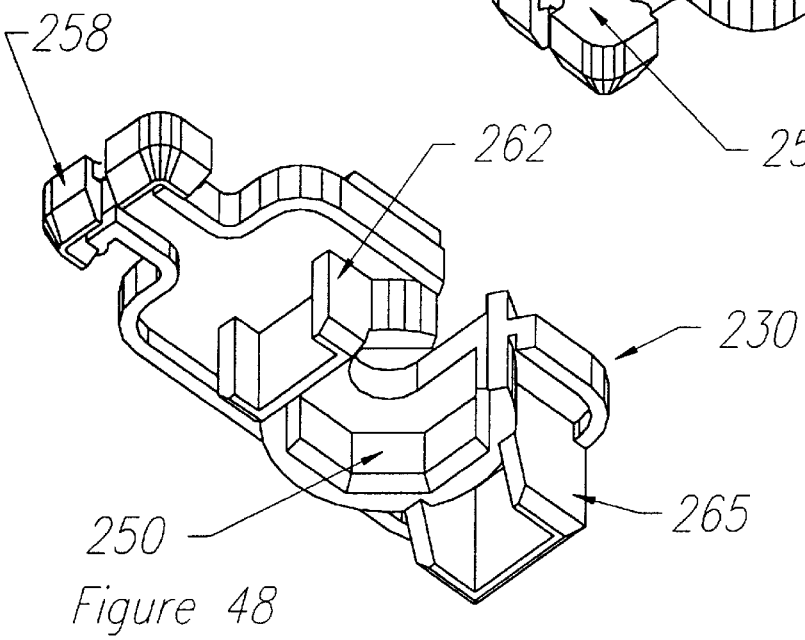

The panel-to-post connector 230 per se is illustrated in several drawings, especially FIGS. 46–48. The panel-to-post connector 230 includes a body portion having, adjacent one end thereof, a downwardly extending socket 250 of octagonal configuration for receiving the octagonal boss 142 of the panel corner connector. A slot or cut-out 252 in the side of the connector leads into this octagonal socket and allows the connector to be installed at the bottom of a panel by fitting around the panel glide although of course it will be realized that this same form of connector is quite suitable for use at the top of a panel as well. A rib pattern 254 is provided around this slot to create an elevated surface so that the nut on the glide (not shown) may be seen from the bottom of the panel as it is being tightened up against this connector. The top surface of the connector is also provided with a supporting rib 256 which strengthens the connector and helps to prevent it from twisting and bending in any way which would compromise its connection with the corner connector 110.

The opposing end of the panel-to-post connector 230 is provided with the previously mentioned generally T-shaped head 258 which is designed to fit into the previously described channels 246 provided along each of the four sides of the post. On opposing sides of the neck of the T-head are provided the aforementioned shallow ribs 260 which mate with the shallow grooves 248 provided adjacent the mouth of the channel to secure the head 258 of the panel-to-post connector 230 in position and to aid in preventing it from accidentally twisting out of position once seated in the post channel.

With reference to FIG. 48, it will also be noted that the lower surface of the connector 230 is provided at its one end distant from the head, with a downwardly depending lug 265 dimensioned and arranged to fit downwardly into the previously described aperture 146 in the corner connector to provide additional support for the connection between the corner connector 110 and the panel-to-post connector. An additional short lug 262 is positioned on the opposite side of the octagonal socket which fits into the notch 156 of the panel corner connector, again to provide additional stability.

Figure 44:
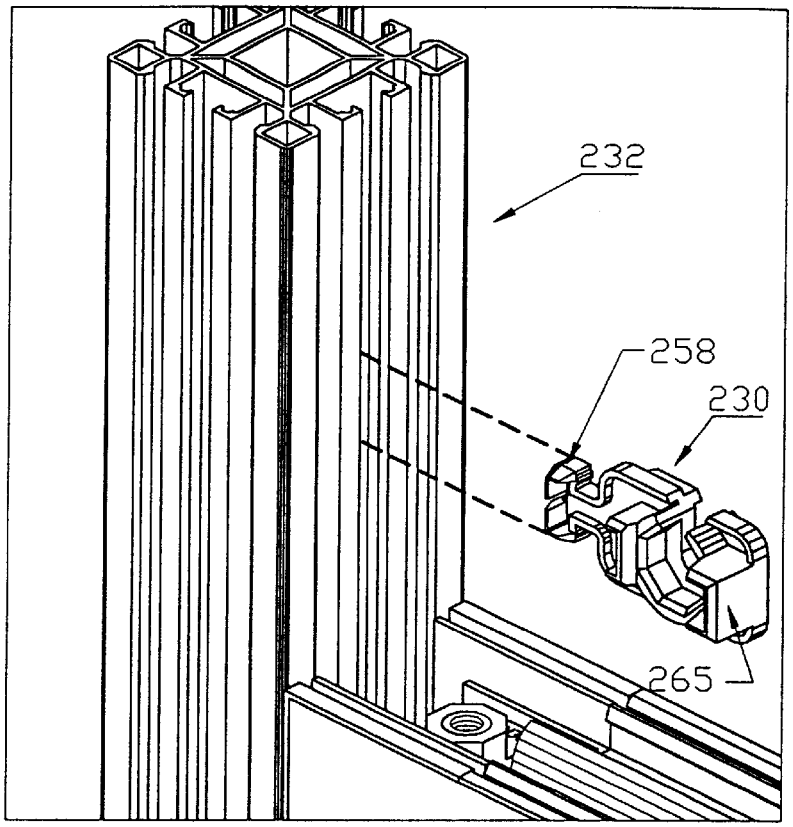
FIGS. 44 and 45 are perspective views illustrating the manner in which the panel-to-post connector of FIG. 24 is utilized to secure a panel to a corner post.
Figure 45:
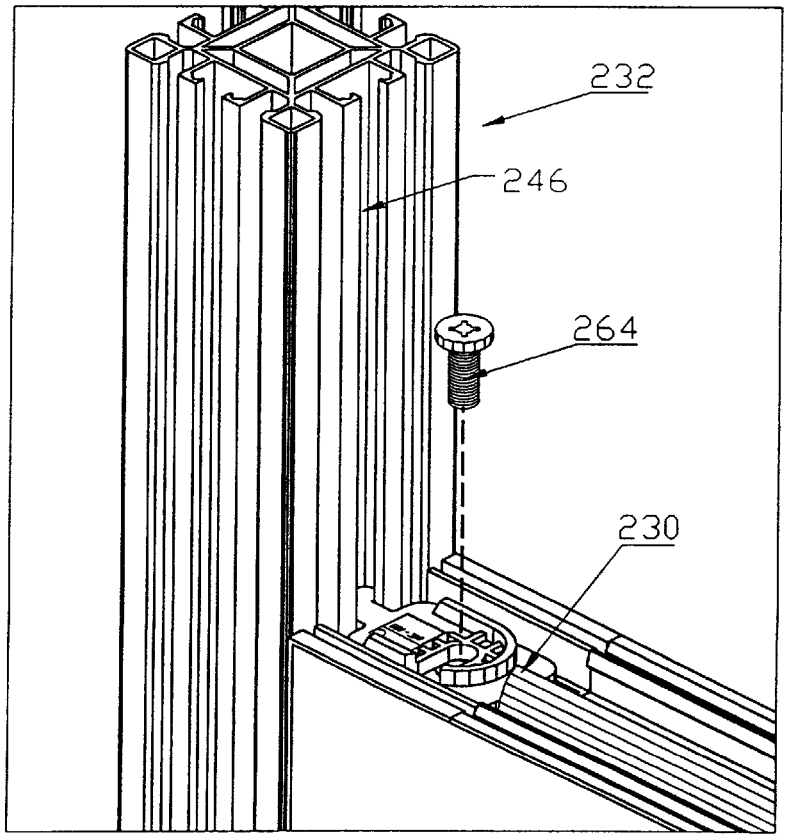
Figure 49:
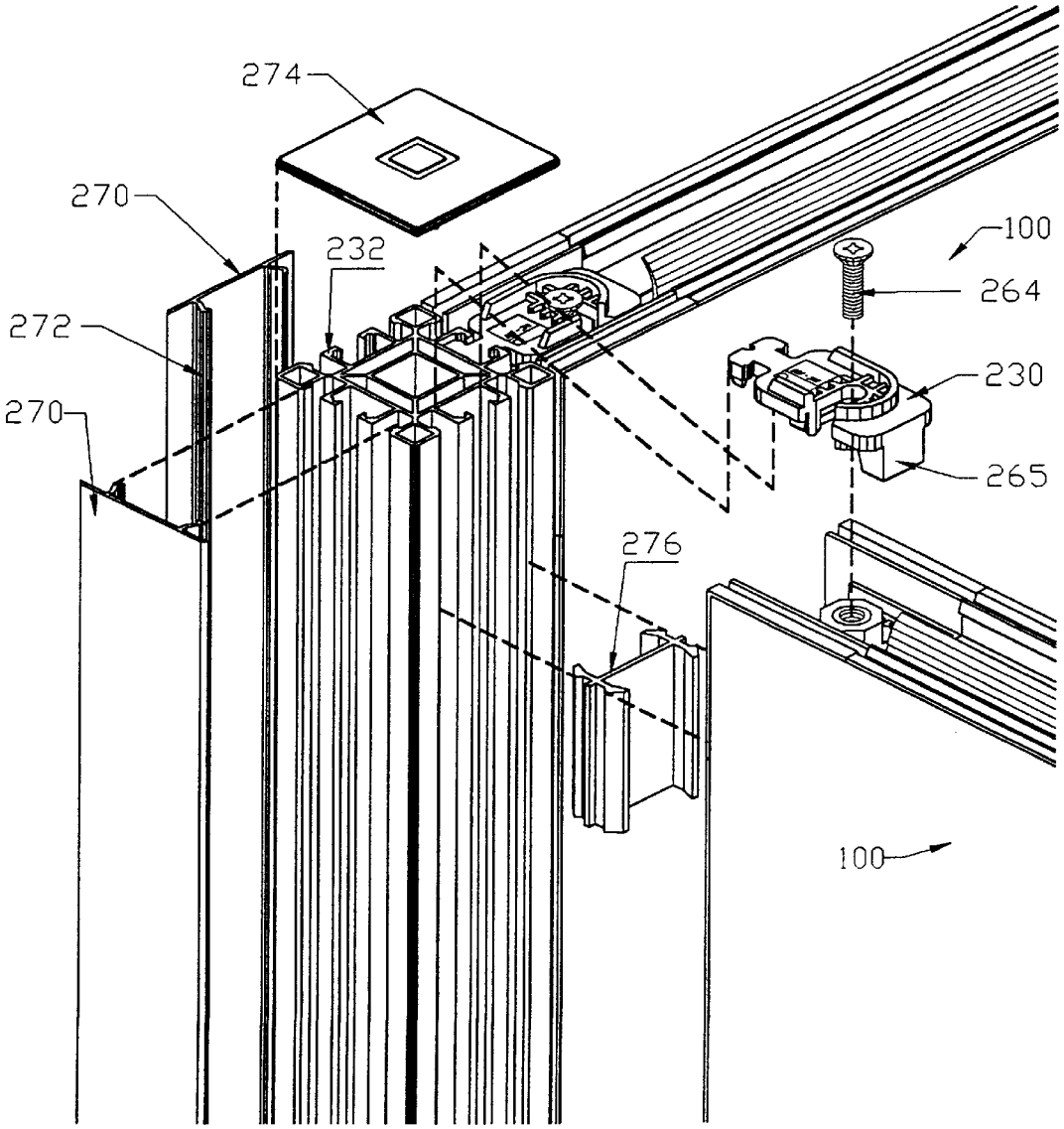
FIG. 49 is a further perspective exploded view illustrating various components, including the panel-to-post connector, panels and the like associated with the corner post.
Figure 50:
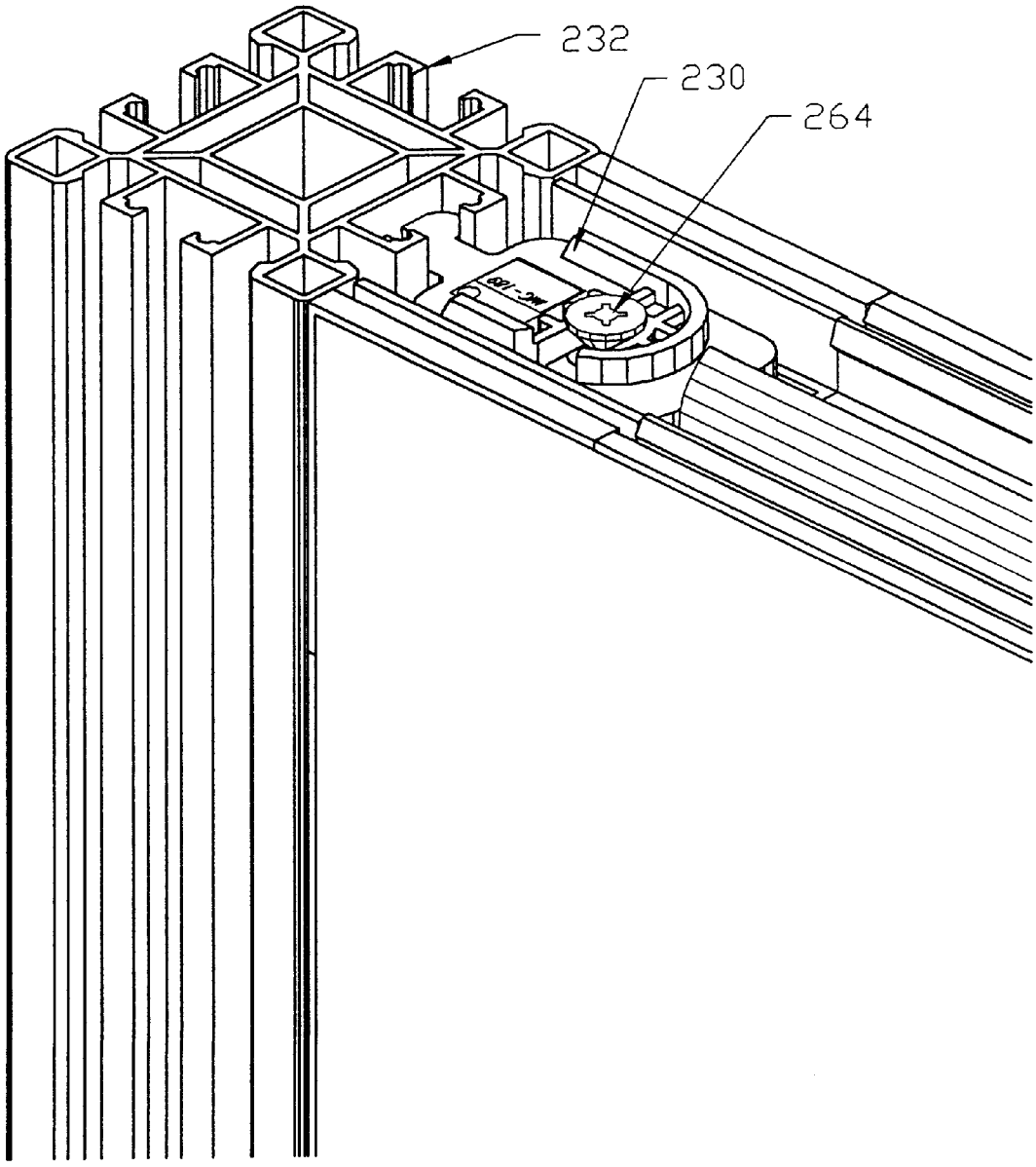
FIG. 50 is a further perspective view illustrating a panel secured to the corner post by way of the panel-to-post connector.

The manner of installing the panel-to-post connector 230 is illustrated in FIGS. 44, 45 and 49. With reference to FIG. 44, the connector 230 is oriented as shown and the head 258 is inserted into the channel 246 in the side of the post 232 following which the connector is rotated 90° into the horizontal position and then lowered downwardly such that the octagonal boss 142 on the panel corner connector engages the octagonal socket 250 on the underside of the panel-to-post connector. Following this, a screw 264 is inserted as illustrated in FIG. 45 to secure the components together.

Figure 53:
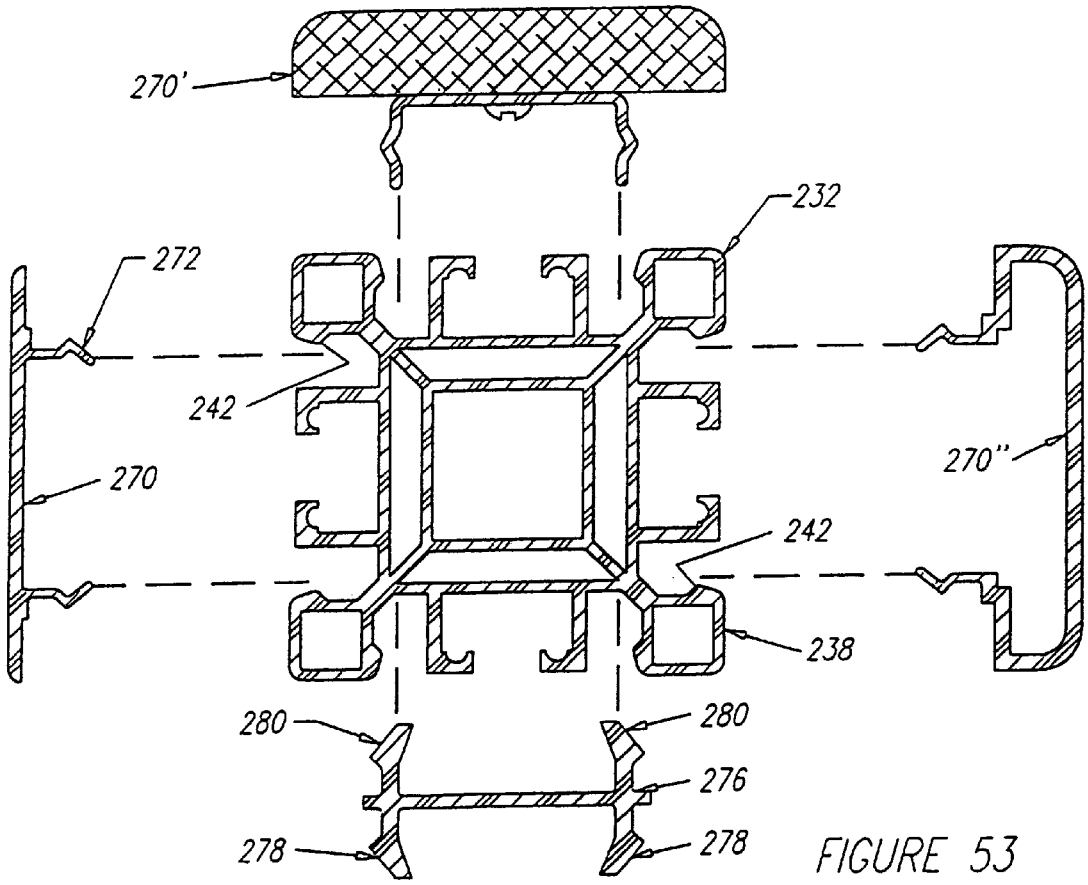
FIG. 53 is a further top plan view of a corner post illustrating the manner in which it cooperates with various decorative trim sections and/or H-connectors.

The assembly procedure is further illustrated in FIG. 49. In FIG. 49 a pair of panels 100 are to be effectively joined at right angles to one another by way of the vertical corner post. For this arrangement, four panel-to-post connectors 230 are required, two for each panel, one at the top and one at the bottom of same. Also illustrated in FIG. 49 are a pair of flat trim strips 270, one of which is illustrated in FIG. 53, such trim strips having spaced apart snap-in flanges 272 which come into snap-fitting engagement with the shoulder-like profiles 242 formed on the tubular corner elements 238 of the post. Also shown is a square top plate 274 which is provided with suitable means (not shown) for effecting engagement with the top of the post to provide an attractive appearance.

Figure 51:
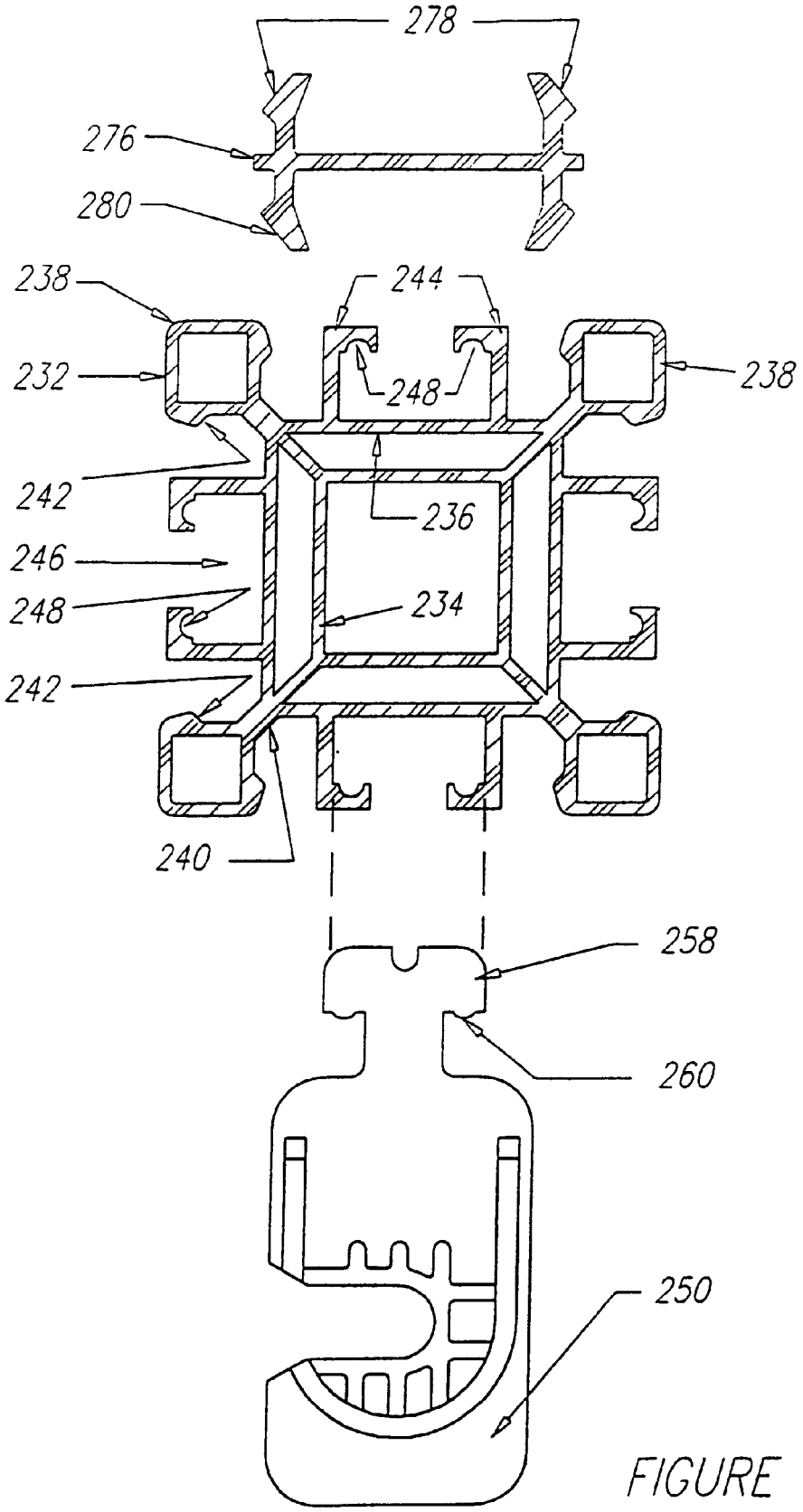
FIG. 51 is a top plan view of a corner post illustrating its several features and the manner in which it cooperates with an H-connector as well as the panel-to-post connector.
Figure 52:
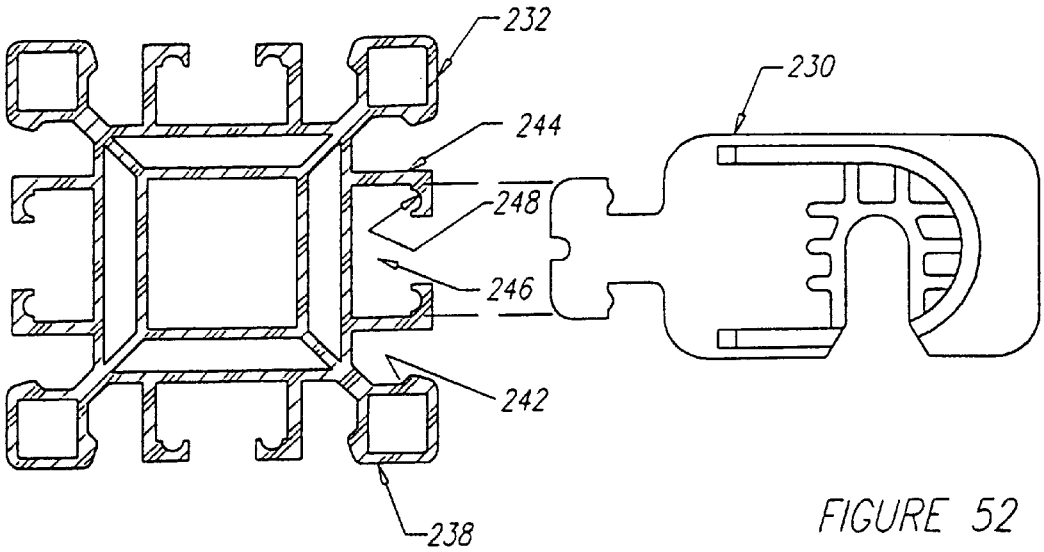
FIG. 52 is a further to plan view of the corner post illustrating further the manner in which it cooperates with the panel-to-post connector.

FIGS. 49, 51 and 53 illustrate, among other things, the H-connector 276 which is provided with opposing pairs 278, 280 of ramped shoulder defining formations extending outwardly from opposing faces of a central web and which engage the shoulder-like profiles 242 formed on the tubular elements 238 at the four corners of the post 232 and which are also engageable with the enlarged formations formed on the distal edges of the secondary flanges 118 of the panel frame members 108. Hence, the H-connector thereby provides convenient panel-to-panel edge connections and panel-to-post connections thereby to supplement the action provided by the various panel-to-panel and panel-to-post connectors described above and also to aid in alignment of the panels and securement together during installation procedures.

Figure 54:
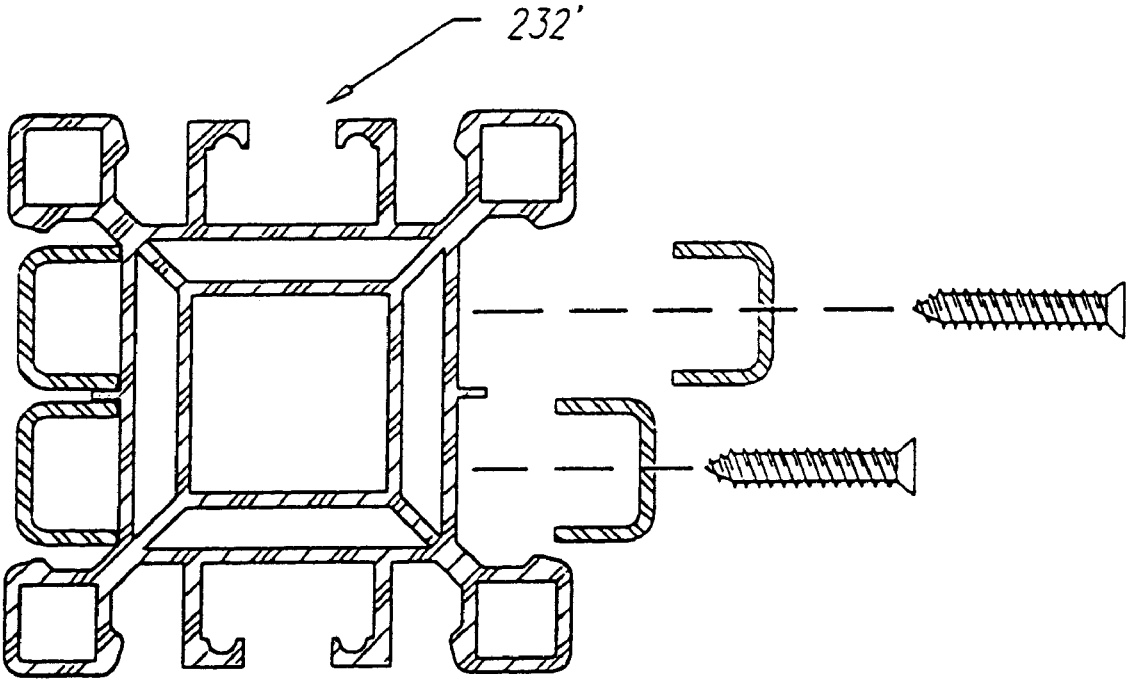
FIGS. 54 and 55 illustrate a modified corner post profiles.
Figure 55:
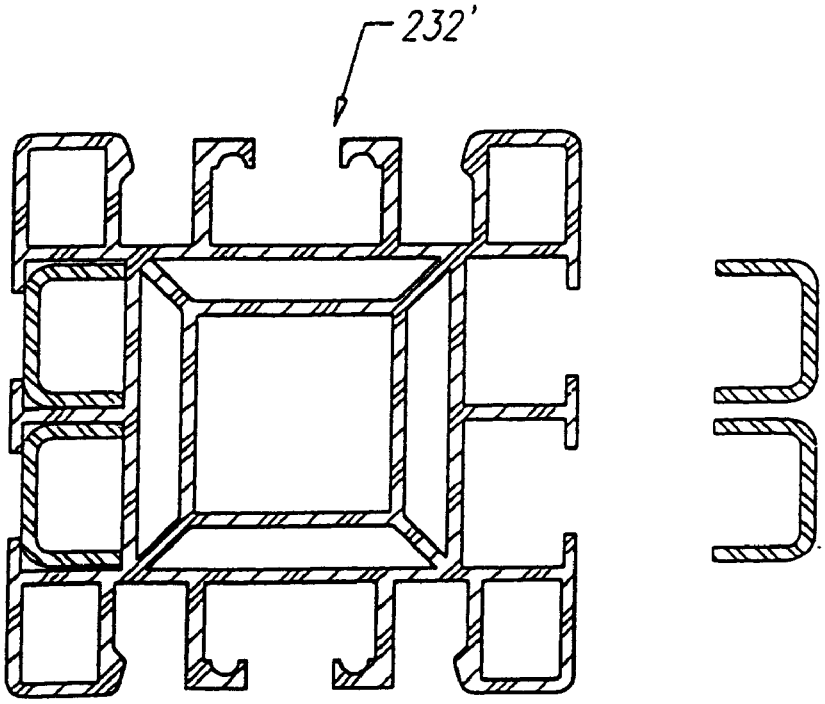

It might also be pointed out here that other forms of post profiles or cross-sections are possible. Reference is had here to FIGS. 54 and 55 which illustrate some possible variations of posts (232' and 232").

A still further type of connector is known as a transition panel connector 286, this connector being illustrated in FIGS. 25, 29 and FIGS. 57A and 59A with the use of same being illustrated in FIGS. 56–59 (including FIGS. 57A and 59A). The transition connector 286 of FIG. 25 comprises two body portions integrally formed at right angles to one another with one portion having an octagonal socket 288 formed thereon and with both portions also having an aperture 290 extending therethrough for receiving a screw. This transition connector 286 is very useful when joining panels together which are of unequal height. For example, as shown in FIG. 56, the lower height panel 100' is provided with a transition connector 286 at its one end with the socket 288 of the transition connector being mounted on the octagonal boss 142 of the panel corner connector and secured in place by a screw. Then, a self-tapping screw (not shown) is inserted through the aperture in the other section of the connector 286 and screwed into the central portion of the vertical frame member 108 of the next adjacent panel.

In FIG. 57A a modified transition connector 286' is provided with an octagonal socket 288' on both body portions, each portion having an aperture 290 for receiving a screw. Thus, corner connectors of equal height panels may be secured to one another as in FIG. 57A via their respective bosses 142 which seat in the sockets 288' and are held in place by a pair of screws extending through apertures 290' into these bosses.

FIG. 59A shows the same transition connector 286' with auxiliary apertures 292 at the distal end of the two body portions which receive self-tapping screws 294 which thread into a frame member 108 at the location determined by the respective heights of the adjacent panels.

FIGS. 56–58 illustrate the manner in which the several different types of connectors, namely the H-connectors 276, the panel-to-panel straight connectors 190, the panel-to-post connectors 230 and transition connectors 286 are utilized to effect securement of the several panels.

FIGS. 60 and 61 illustrate the manner in which the panels are joined horizontally by means of the H-connector 276. With reference to FIG. 61-1, the panels 100 are brought into general alignment and one panel is moved toward the other in the direction of the arrow. This panel is then angled slightly relative to the other panel (FIG. 61-2) to bring the H-connector 276 into partial engagement following which the panels are realigned with one another and pushed together (FIG. 61-3) to snap the H-connector into place in engagement with the vertical frame members 108 of the adjacent panels. The required panel-to-panel straight connectors 190 are then installed as described previously.

With reference to FIG. 62, which relates to the joining of panels vertically, firstly a plurality of H-connectors 276 are installed as shown (Fig.62-1). The side connector is then engaged first (FIG. 62-2) and then the panel is forced downwardly to engage the lower H-connectors 276 making use of a rubber mallet if necessary (Fig.62-3).

The several steps involved in the joining of panels together utilizing H-connectors 276, panel-to-panel straight connectors 190 and panel-to-post connectors 230 are illustrated in FIGS. 63-1 to FIG. 63-5. The relative positions of the panels 100 and post 232 and the locations of the several connectors 190, 230 and 276 are clearly shown in the illustrations and a further verbal description at this point is believed to be unnecessary. Following step 5, to continue adding panels, one starts again with step 1 and repeats the same sequence of steps.

Preferred embodiments of the invention have been described and illustrated by way of example. Those skilled in the art will realize that various modifications and changes may be made while still remaining within the spirit and scope of the invention. Hence the invention is not to be limited to the embodiments as described but, rather, the invention encompasses the full range of equivalencies as defined by the appended claims.

What is claimed is:

1. A partition panel of generally rectangular outline having a plurality of marginal edges and a plurality of corners, and a perimeter frame assembly comprising a plurality of frame members extending along the marginal edges of the panel, and a plurality of corner connectors each located at a respective one of the corners of the panel and attaching between adjacent ends of said frame members, said frame members including spaced primary flanges, said frame members each further including a double-walled web extending between said primary flanges and providing a lengthwise extending hollow cavity, each corner connector including a pair of tongues each fitting tightly into adjacent ends of the frame members via the associated hollow cavities to secure said frame members together at said corners of the panel, and wherein said primary flanges are each provided with an outwardly directed ledge, said ledges being disposed adjacent the marginal edges of the panel such that said ledges at least partly encompass a rectangular area, and a sheet of rigid material seated in said rectangular area in close juxtaposition to said primary flanges to define a major face of the panel with said ledges extending along the perimeter of the rigid sheet and encompassing the latter.

2. The partition panel of claim 1 wherein each said corner connector has shoulders thereon which butt-up against respective adjacent ends of the perimeter frame members when the tongues of the corner connectors are fully inserted into said hollow cavities of said frame members, said tongues being in a close friction fit within said cavities.

3. The partition panel of claim 1 wherein the corner connectors and the frame members are provided with grooves therein which engage marginal portions of fabric material extending over at least one of the major faces of the panel to provide an exterior covering therefor.

4. The partition panel of claim 1 wherein said frame members comprise plastics extrusions of uniform cross-section throughout their lengths, said spaced primary flanges having a U-shaped groove therebetween directed outwardly of the panel and said corner connectors also having spaced corner flanges thereon mating with said primary flanges and having U-shaped recesses therebetween mating with the U-shaped recesses of said frame members.

5. A partition panel of generally rectangular outline having opposed major faces, a plurality of marginal edges and a plurality of corners, and a perimeter frame assembly comprising a plurality of frame members extending along the marginal edges of the panel, and a plurality of corner connectors each located at a respective one of the corners of the panel and attaching between adjacent ends of said frame members, said frame members including spaced primary flanges, said frame members each further including a double-walled web extending between said primary flanges and providing a lengthwise extending hollow cavity, each corner connector including a pair of tongues each fitting tightly into adjacent ends of the frame members via the associated hollow cavities to secure said frame members together at said corners of the panel, and wherein said frame members comprise plastics extrusions of uniform cross-section throughout their lengths, each frame member including a flexible rib extending therealong intermediate said primary flanges and projecting outwardly of the margins of the partition panel for contacting a frame member of an adjacent panel when in use to prevent light and hinder sound transmission therebetween.

6. The partition panel of claim 5 wherein each said corner connector has shoulders thereon which butt-up against respective adjacent ends of the perimeter frame members when the tongues of the corner connectors are fully inserted into said hollow cavities of said frame members, said tongues being in a close friction fit within said cavities, each corner connector having, adjacent a proximal end of each of said tongues, a respective boss, said bosses being at right angles to one another and each of which bosses is adapted to mate with a corresponding recess in a panel connector for securing adjacent panels together or a panel to a post.

7. The partition panel of claim 6 wherein each corner connector has a pair of apertures therein each of which is adjacent a respective one of said bosses and being adapted to receive a lug of a panel connector.

8. The partition panel of claim 5 and wherein said primary flanges are each provided with an outwardly directed ledge, said ledges being disposed adjacent the marginal edges of the panel such that said ledges substantially encompass a rectangular area, and a sheet of rigid material seated in said rectangular area in close juxtaposition to said primary flanges to define a major face of the panel with said ledges extending along the perimeter of the rigid sheet and encompassing the latter.

9. The partition panel of claim 5 wherein a wall of said double-walled web of each frame member has a spaced pair of further flanges extending therealong and defining a center channel supporting one or more rigid panels in a plane intermediate the planes defined by said major faces of the panel either within said center channel or to one or both sides thereof in engagement with a respective one of said further flanges.

10. The partition panel of claims 7 wherein said frame members comprise extrusions of uniform cross-section throughout their lengths, said spaced primary flanges having a U-shaped groove therebetween directed outwardly of the panel and said corner connectors also having spaced corner flanges thereon co-operating with said primary flanges and defining U-shaped recesses mating with the U-shaped recesses of said frame members, said bosses being disposed between said spaced corner flanges of said corner connectors.

11. A partition panel of generally rectangular outline having a plurality of marginal edges and a plurality of corners, and a perimeter frame assembly comprising a plurality of frame members extending along the marginal edges of the panel, and a plurality of corner connectors each located at a respective one of the corners of the panel and attaching between adjacent ends of said frame members, said frame members including spaced primary flanges, said frame members each further including a double-walled web extending between said primary flanges and providing a lengthwise extending hollow cavity, each corner connector including a pair of tongues each fitting tightly into adjacent ends of the frame members via the associated hollow cavities to secure said frame members together at said corners of the panel.

12. The partition panel of claim 11 wherein a wall of said double-walled web of each frame member has a spaced pair of further flanges extending therealong and defining a center channel supporting one or more rigid panels in a plane intermediate the planes defined by said major faces of the panel either within said center channel or to one or both sides thereof in engagement with a respective one of said further flanges.

13. The partition panel of claim 11 wherein each said corner connector has formations thereon defining spaced-apart grooves communicating with and generally co-planar with corresponding grooves in said frame members, and a covering material extending over at least one of said major faces and having marginal edges engaged and held in said grooves all around the perimeter of the panel including its corners.

14. The partition panel of claim 11 wherein each said corner connector has shoulders thereon which butt-up against respective adjacent ends of the perimeter frame members when the tongues of the corner connectors are fully inserted into said hollow cavities of said frame members, said tongues being in a close friction fit within said cavities, each corner connector having, adjacent a proximal end of each of said tongues, a respective boss, said bosses being at right angles to one another and each of which bosses is positioned and adapted to mate with a corresponding recess in a panel connector for securing adjacent said panels together or to a post.

15. The partition panel of claim 14 wherein each corner connector has a pair of apertures therein each of which is adjacent a respective one of said bosses and being adapted to receive a lug of a panel connector.

16. The partition panel of claim 15 wherein said frame members comprise plastics extrusions of uniform cross-section throughout their lengths, each frame member including a flexible rib extending therealong intermediate said primary flanges and projecting outwardly of the margins of the partition panel for contacting a frame member of an adjacent panel when in use to prevent light and hinder sound transmission therebetween.

17. A corner connector adapted to be located at a corner of a partition panel to secure together, when in use, elongated frame members disposed generally at right angles to one another, said corner connector having a pair of tongues at right angles to one another adapted to be snugly fitted into end portions of lengthwise extending hollow cavities in said frame members, each corner connector having shoulders defined thereon which are adapted to butt-up against respective adjacent ends of the elongated frame members when said tongues are fully inserted into said hollow cavities, each corner connector having, adjacent a proximal end of each of said tongues, a respective boss, said bosses being at right angles to one another and either of which bosses depending on the orientation of a panel with which, when in use, they are associated, is positioned and adapted to mate, in use, with a corresponding recess in a panel connector for securing adjacent partition panels together or, alternatively, to a post.

18. A corner connector as in claim 17 when adapted for use with frame members having flanges having a U-shaped groove therebetween, said corner connector having spaced corner flanges thereon defining said shoulders adapted to abut the ends of the frame members, said corner flanges having U-shaped recesses therebetween adapted to mate with the U-shaped recesses of the frame members and said bosses being located between said spaced corner flanges.

19. The corner connector of claim 18 further having a pair of apertures therein each of which is located adjacent a respective one of said bosses for simultaneously receiving therein a lug of a panel connector as and when the latter is engaged with the boss next adjacent thereto thereby firmly securing said panel connector relative to said corner connector.

20. The corner connector of claim 17 wherein said bosses are of polygonal configuration to mate with a similarly shaped socket in a panel connector when installed thereon.

21. A panel-to-panel connector adapted to extend between adjacent corners of adjacent panels to secure them together, each of which panels comprises a plurality of frame members extending along the marginal edges of the panel with a plurality of corner connectors each located at a respective corner of the panel and forming an attachment between adjacent ends of said frame members, each corner connector having at least one boss thereon, and wherein the panel-to-panel connector defines a body having a pair of non-circular sockets therein spaced apart and located adjacent opposing ends of said connector body, each socket being thus adapted to non-rotatably receive therein a respective boss of each of the panel corner connectors associated with the adjacent panels.

22. The panel-to-panel connector of claim 21 when adapted to secure adjacent panels together in generally co-planar relationship and further including a pair of lugs extending from the connector body, each lug being adjacent a respective one of said sockets and each being adapted to enter into an associated aperture located in the corner connector adjacent each said boss to help prevent rotation of the panel to panel connector about the bosses of the corner connectors of the adjacent panels.

23. The panel-to-panel connector of claim 21 when adapted to secure adjacent panels together at right angles to one another, the connector having an arched intermediate section between said opposing ends to allow the connector to bridge and extend over a marginal edge of a panel at right angles to the connector.

24. The panel-to-panel connector of claim 23 further including pairs of ledges flanking the respective sockets for snap-fit engagement with U-shaped recesses defined in the corner connectors and/or frame members of the panels to prevent rotation of the panel-to-panel connector about said bosses.

25. The panel-to-panel connector of claim 21 including a slot or a cut-out portion leading into each socket from the exterior of the connector body to enable placement of the connector around a glide on the bottom edge of the panel.

26. The panel-to-panel connector of claim 21 wherein the connector body has openings therein co-operating with each said socket for enabling fasteners to be screwed into said bosses through said openings to hold the connector in place.

27. A panel-to-post connector adapted to secure a panel to a vertical post having a channel defining a re-entrant groove extending along at least one face of the post and wherein the panel comprises a plurality of frame members extending along the marginal edges of the panel with a plurality of corner connectors each located at a respective corner of the panel and forming an attachment between adjacent ends of said frame members, each corner connector having at least one boss thereon, said panel-to-post connector defining a body with a socket located adjacent one end thereof shaped to non-rotatably receive the boss of the panel corner connector therein, and the opposing end of the body having a generally T-shaped head adapted to be received and retained in the re-entrant groove defined by said channel, and further including a lug adjacent said socket adapted to fit into an aperture in the corner connector to help avoid twisting of the connector around said boss during use.

28. The panel-to-post connector of claim 27 wherein said T-shaped head has ribs thereon adapted to co-operate with grooves in said channel to help avoid twisting of the head of the connector out of channel when in use.

29. The panel-to-post connector according to claim 27 wherein said socket is of polygonal outline shape for non-rotatably engaging the correspondingly shaped boss of the panel corner connector.

30. The panel-to-post connector according to claim 27 wherein the connector body has at least one opening therein co-operating with said socket for enabling a fastener to be screwed into said boss through said opening to hold the connector in place on said boss.

31. A corner post for use in a panel system, said post having a plurality of corners and having, as seen in cross-section, a central core and a plurality of spaced apart tubular corner elements each defining one of the corners of the post and secured to said central core and extending parallel thereto, and a plurality of channel defining means extending lengthwise of said core and secured thereto intermediate associated pairs of said tubular corner elements and defining re-entrant grooves for receiving connector elements therein.

32. The corner post of claim 31 wherein said tubular corner elements are provided with sloping profiles adapted to provide for a snap-fit engagement between associated pairs of said corner elements and selected connector elements and/or trim sections.

33. A partition panel of generally rectangular outline having a plurality of marginal edges and a plurality of corners, and a perimeter frame assembly comprising a plurality of frame members extending along the marginal edges of the panel, a plurality of corner connectors each located at a respective one of the corners of the panel and attaching between adjacent ends of said frame members, each corner connector including a pair of tongues each fitting into adjacent ends of the frame members to secure said frame members together at said corners of the panel, and wherein each said corner connector has shoulders thereon which butt-up against respective adjacent ends of the perimeter frame members when the tongues of the corner connectors are fully fitted into said frame members, each corner connector having, adjacent a proximal end of at least one of said tongues, an associated boss and said boss being positioned and adapted to non-rotatably mate with a complimentary recess in a panel connector for securing adjacent such panels together or for securing the panel to a post.

34. The partition panel of claim 33 therein each corner connector has at least one aperture therein adjacent said boss and being adapted to receive a lug of a panel connector to further prevent rotation of a panel connector about the boss when positioned thereon.

35. A panel assembly comprising a plurality of panels each being of generally rectangular outline having a plurality of marginal edges and a plurality of corners, and a perimeter frame assembly comprising a plurality of frame members extending along the marginal edges of the panel, a plurality of corner connectors each located at a respective one of the corners of the panel and attaching between adjacent ends of said frame members, each corner connector including a pair of tongues each fitting into adjacent ends of the frame members to secure said frame members together at said corners of the panel, and wherein each said corner connector has shoulders thereon which butt-up against respective adjacent ends of the perimeter frame members when the tongues of the corner connectors are fully fitted into said frame members, each corner connector having, adjacent a proximal end of at least one of said tongues, an associated boss and said boss being positioned and adapted to non-rotatably mate with a complimentary recess in a panel connector for securing adjacent such panels together or for securing the panel to a post, and further including panel-to-panel connectors securing adjacent pairs of said partition panels together, each said panel-to-panel connector extending between an adjacent pair of said panels and having a pair of said recesses each receiving a respective one of the bosses on said corner connectors of the adjacent panels.

36. The panel assembly of claim 35 wherein the panel-to-panel connector defines a connector body having a pair of said recesses in the form of sockets therein spaced apart and located adjacent opposing ends of said connector body, each socket non-rotatably receiving therein a respective boss of each of the panel corner connectors associated with the adjacent panels.

37. The panel assembly of claim 36 wherein said panel-to-panel connector secures adjacent panels together in generally co-planar relationship and further includes a pair of lugs extending from the connector body, each lug being adjacent a respective one of said sockets and each being disposed in an associated said aperture located in the corner connector adjacent each said boss to help prevent rotation of the panel-to-panel connector about the bosses of the corner connectors of the adjacent panels.

38. The panel assembly of claim 35 wherein said panel-to-panel connector is adapted to secure adjacent panels together at right angles to one another, the connector body having an arched intermediate section between said opposing ends to allow the panel-to-panel connector to bridge and extend over a marginal edge of a panel at right angles to the panel-to-panel connector.

39. A partition panel of generally rectangular outline having a plurality of marginal edges and a plurality of corners, and a perimeter frame assembly comprising a plurality of frame members extending along the marginal edges of the panel, a plurality of corner connectors each located at a respective one of the corners of the panel and attaching between adjacent ends of said frame members, said frame members including spaced primary flanges, said frame members each further including a double-walled web extending between said primary flanges and providing a lengthwise extending hollow cavity, each corner connector including a pair of tongues each fitting into adjacent ends of the frame members via the associated hollow cavities to secure said frame members together at said corners of the panel, and wherein each said corner connector has shoulders thereon which butt-up against respective adjacent ends of the perimeter frame members when the tongues of the corner connectors are fully inserted into said hollow cavities of said frame members, each corner connector having, adjacent a proximal end of each of said tongues, a respective boss, each boss extending normal to its associated tongue and either of which bosses, depending on panel orientation, is positioned and adapted to mate with a recess of complimentary shape in a panel connector for securing adjacent such panels together or for securing the panel to a post.

40. The partition panel of claim 39 wherein each said boss is of non-circular shape to inhibit rotation of a mating panel connector when installed thereon, each corner connector having a pair of apertures therein, each of which is adjacent a respective one of said bosses and being adapted to receive a lug of a panel connector to help prevent rotation of the panel connector when installed thereon.

41. A panel assembly comprising a plurality of panels each of which is of generally rectangular outline having a plurality of marginal edges and a plurality of corners, and a perimeter frame assembly comprising a plurality of frame members extending along the marginal edges of the panel, a plurality of corner connectors each located at a respective one of the corners of the panel and attaching between adjacent ends of said frame members, said frame members including spaced primary flanges, said frame members each further including a double-walled web extending between said primary flanges and providing a lengthwise extending hollow cavity, each corner connector including a pair of tongues each fitting into adjacent ends of the frame members via the associated hollow cavities to secure said frame members together at said corners of the panel, and wherein each said corner connector has shoulders thereon which butt-up against respective adjacent ends of the perimeter frame members when the tongues of the corner connectors are fully inserted into said hollow cavities of said frame members, each corner connector having, adjacent a proximal end of each of said tongues, a respective boss, each boss extending normal to its associated tongue and either of which bosses, depending on panel orientation, is positioned and adapted to mate with a recess of complimentary shape in a panel connector for securing adjacent such panels together or for securing the panel to a post, each said boss being of non-circular shape to inhibit rotation of a mating panel connector when installed thereon, each corner connector having a pair of apertures therein, each of which is adjacent a respective one of said bosses and being adapted to receive a lug of a panel connector to help prevent rotation of the panel connector when installed thereon, and further including panel connectors in the form of panel-to-panel connectors securing adjacent pairs of said panels together, each said panel-to-panel connector extending between an adjacent pair of said panels and having a pair of said recesses each receiving a respective one of the bosses on said corner connectors of the adjacent panels.

42. The panel assembly of claim 41 wherein the panel-to-panel connector defines a connector body having a pair of said recesses in the form of sockets therein spaced apart and located adjacent opposing ends of said connector body, each socket non-rotatably receiving therein a respective boss of each of the panel corner connectors associated with the adjacent panels.

43. The panel assembly of claim 42 wherein said panel-to-panel connector secures adjacent panels together in generally co-planar relationship and further includes a pair of lugs extending from the connector body, each lug being adjacent a respective one of said sockets and each being disposed in an associated said aperture located in the corner connector adjacent each said boss to help prevent rotation of the panel-to-panel connector about the bosses of the corner connectors of the adjacent panels.

44. The panel assembly of claim 41 wherein said panel-to-panel connector secures adjacent panels together at right angles to one another, the connector body having an arched intermediate section between said opposing ends to allow the panel-to-panel connector to bridge and extend over a marginal edge of one of said panels.

* * * * *